US007959253B2

(12) United States Patent
Nunokawa

(10) Patent No.: US 7,959,253 B2
(45) Date of Patent: Jun. 14, 2011

(54) PRINTING METHOD, TEST PATTERN, METHOD OF PRODUCING TEST PATTERN, AND PRINTING APPARATUS

(75) Inventor: Hirokazu Nunokawa, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 124 days.

(21) Appl. No.: 12/404,373

(22) Filed: Mar. 16, 2009

(65) Prior Publication Data

US 2009/0179980 A1 Jul. 16, 2009

Related U.S. Application Data

(62) Division of application No. 10/852,657, filed on May 25, 2004, now Pat. No. 7,524,012.

(30) Foreign Application Priority Data

May 26, 2003 (JP) ..... 2003-148294
May 26, 2003 (JP) ..... 2003-148295
May 11, 2004 (JP) ..... 2004-141576
May 21, 2004 (JP) ..... 2004-151286

(51) Int. Cl.
*B41J 29/393* (2006.01)
*B41J 29/38* (2006.01)
*B41J 2/01* (2006.01)

(52) U.S. Cl. ..... 347/19; 347/16; 347/104

(58) Field of Classification Search ..... 347/16, 347/19, 104
See application file for complete search history.

(56) References Cited

U.S. PATENT DOCUMENTS

| | | | |
|---|---|---|---|
| 6,669,320 | B2 | 12/2003 | Hayashi et al. |
| 6,769,759 | B2 | 8/2004 | Yamasaki et al. |
| 6,783,203 | B2 | 8/2004 | Fujimori |
| 6,832,825 | B1 | 12/2004 | Nishikori et al. |
| 6,963,423 | B2 | 11/2005 | Ogasahara et al. |
| 7,222,928 | B2 | 5/2007 | Fujimori |
| 2002/0175966 | A1 | 11/2002 | Yoshimura et al. |
| 2003/0222961 | A1 | 12/2003 | Nakajima |

FOREIGN PATENT DOCUMENTS

| | | | |
|---|---|---|---|
| JP | 2001-001584 | A | 1/2001 |
| JP | 2001-71475 | A | 3/2001 |
| JP | 2001-162912 | A | 6/2001 |
| JP | 2002-144637 | A | 5/2002 |
| JP | 2002-331692 | A | 11/2002 |
| JP | 2003-025555 | A | 1/2003 |
| JP | 2001-63078 | A | 3/2003 |

*Primary Examiner* — Matthew Luu
*Assistant Examiner* — Jannelle M Lebron
(74) *Attorney, Agent, or Firm* — Sughrue Mion, PLLC

(57) ABSTRACT

A printing method of the present invention is a printing method for forming, on a medium, a plurality of correction patterns each including a pre-carry pattern and a post-carry pattern, and includes: forming the pre-carry pattern on the medium, carrying the medium in a carrying direction after forming the pre-carry pattern, and then forming the post-carry pattern on the medium after carrying the medium. In the printing method of the present invention, the plurality of correction patterns are formed on the medium lined up in a direction that intersects the carrying direction. With this printing method, it is possible to form a greater number of correction patterns in a narrow region on the medium.

23 Claims, 41 Drawing Sheets

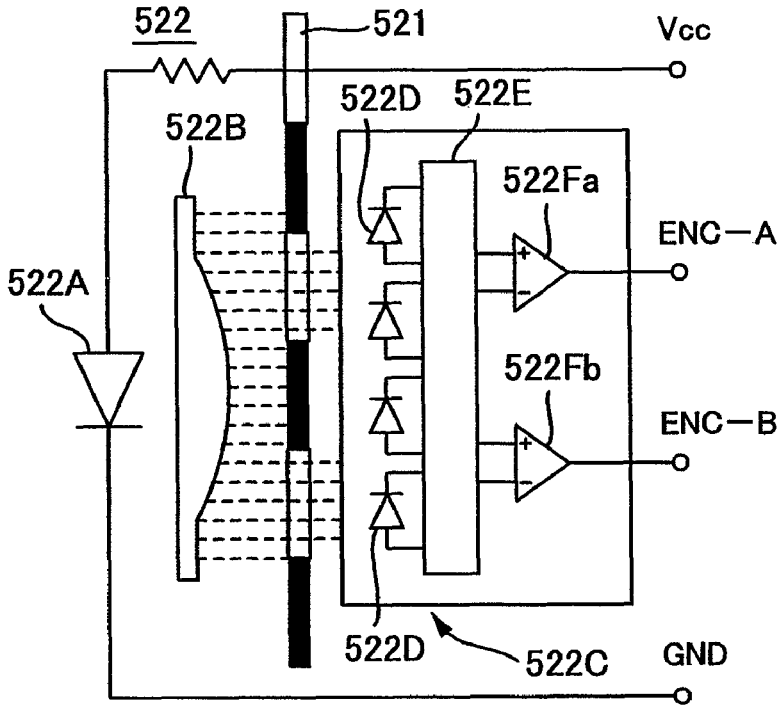
FIG.10
FIG.11A
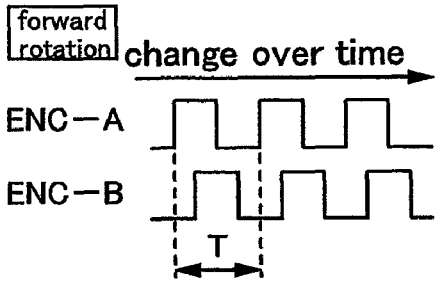
FIG.11B
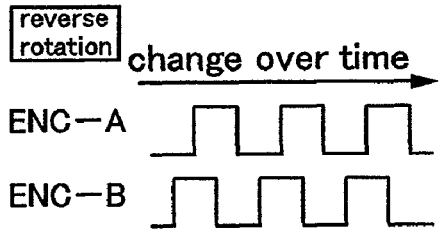

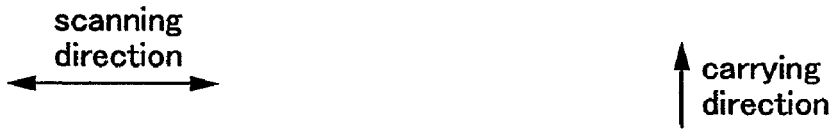
FIG.25A
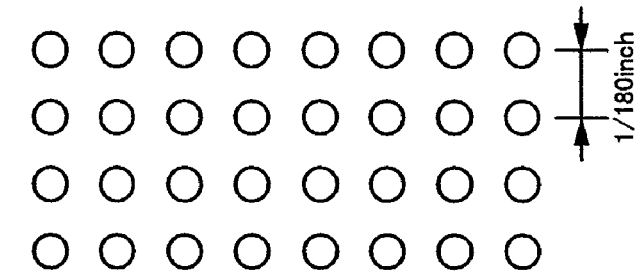
FIG.25B
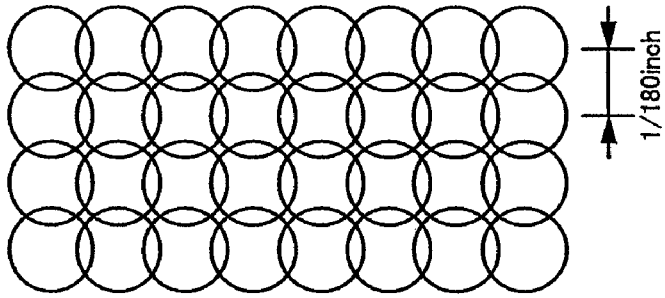
FIG.25C
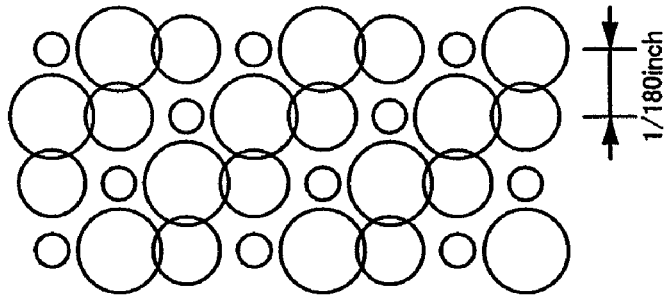
FIG.25D
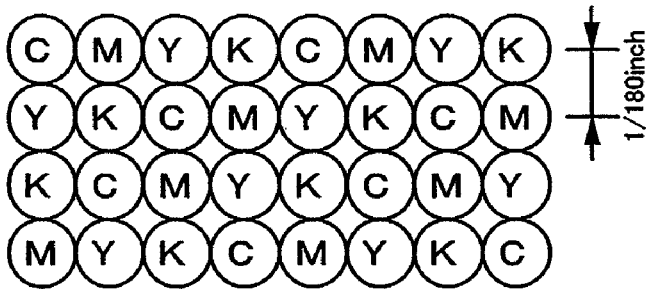

number=1
(correction amount +4C)

number=2
(correction amount +2C)

number=3
(correction amount ±0)

number=4
(correction amount −2C)

number=5
(correction amount −4C)

PRINTING METHOD, TEST PATTERN, METHOD OF PRODUCING TEST PATTERN, AND PRINTING APPARATUS

CROSS-REFERENCE TO RELATED APPLICATIONS

This is a Divisional Application of U.S. Ser. No. 10/852,657 filed May 25, 2004, which claims priority from Japanese Patent Application No. 2003-148294 filed on May 26, 2003, Japanese Patent Application No. 2003-148295 filed on May 26, 2003, Japanese Patent Application No. 2004-141576 filed on May 11, 2004, and Japanese Patent Application No. 2004-151286 filed on May 21, 2004, which are herein incorporated by reference.

BACKGROUND OF THE INVENTION

1. Field of the Invention

The present invention relates to printing methods, test patterns, methods for producing test patterns, and printing apparatuses.

2. Description of the Related Art

Inkjet printers for printing by ejecting ink are known as an example of printing apparatuses for printing images on various types of media, such as paper, cloth, and film. In such inkjet printers, printing is carried out by alternately repeating the processes of ejecting ink from nozzles and moving the medium in the carrying direction.

FIG. 45A is an explanatory diagram of printing using such an inkjet printer. A head 41 having a plurality of nozzles is moved in a scanning direction and ink is ejected from the nozzles, forming on the paper a band-shaped print image fragment BP1 having the width of the head. Next, a carry unit carries the paper in the carrying direction by a carry amount that corresponds to the width of the head 41. The printer then repeats the same ejection operation and carrying operation to form on the paper a print image in which the print image fragments BP2, BP3, are joined in the carrying direction.

The carry unit for performing the carrying operation carries paper using structural elements such as motors and gears, and therefore, there are instances in which the carry amount comes to include error.

FIG. 45B is an explanatory diagram of printing in a case where there is carry error. When the carry unit carries the paper by a larger carry amount than the carry amount defined as the target (target carry amount) due to carry error, a gap occurs between print image fragments, resulting in a light-colored striped pattern (also referred to as "bright banding," "white banding," and "light banding") like at the border between the print image fragment BP1 and the print image fragment BP2. On the other hand, when the carry unit carries the paper by a smaller carry amount than the target carry amount, overlap between print image fragments occurs due to the carry error, resulting in a dark-colored striped pattern (also referred to as "dark banding," "black banding," and "thick banding") like at the border between the print image fragment BP2 and the print image fragment BP3. The occurrence of such banding leads to a drop in the image quality.

Accordingly, the target carry amount is corrected during the carrying operation in order to limit the impact of such carry errors (for example, see JP 2001-71475A).

(1) To determine a correction amount for the target carry amount, a pattern for testing (test pattern) is printed as a means for detecting the amount of carry error. A plurality of correction patterns in which a correction amount for the target carry amount is changed in a stepwise manner are printed in the test pattern. Then, by selecting the most suitable pattern from among the plurality of correction patterns, the carry error is detected and a correction amount that allows suitable correction to be executed is determined.

Each correction pattern formed in the test pattern corresponds to a specific correction amount. Thus, it is preferable that as many correction patterns as possible are formed in a narrow region on the paper.

(2) Each of the correction patterns in the test pattern have a reference pattern serving as a reference and a comparative pattern formed adjacent in the carrying direction to the reference pattern. Carrying by the carry unit is performed between formation of the reference pattern and formation of the comparative pattern, and by changing this carry amount for each correction pattern, the spacing between the reference pattern and the comparative pattern of each correction pattern is altered, resulting in a correction amount that differs for each correction pattern. An appropriate correction amount is then chosen by selecting the pattern with the most suitable spacing between the reference pattern and the comparative pattern.

As discussed above, a plurality of correction patterns are formed by altering the carry amount of the carry that is performed between formation of the reference pattern and formation of the comparative pattern for each correction pattern, thus changing the spacing between the reference pattern and the comparative pattern in a stepwise manner. Therefore, if the carrying by the carry unit is not accurate, then the spacing between the reference pattern and the carrying pattern of each correction pattern will become unsuitable. However, as discussed above, when the carry amount of the carry that is performed between formation of the reference pattern and formation of the comparative pattern is different for each correction pattern, it is difficult to make the carry unit perform carrying accurately.

SUMMARY OF THE INVENTION (1) It is a first object of the present invention to form a greater number of correction patterns in a narrow region on a medium.

A first aspect of the invention for achieving the foregoing object is a printing method for forming a plurality of correction patterns on a medium, comprising the steps of:

preparing the medium onto which the correction patterns are to be formed; and forming each of the correction patterns on the medium by forming a pre-carry pattern on the medium, carrying the medium, and then forming a post-carry pattern on the medium;

wherein the plurality of correction patterns are formed on the medium lined up in a direction that intersects the carrying direction.

(2) It is a second object of the present invention to set the spacing between a reference pattern and a comparative pattern to an appropriate spacing for each correction pattern when printing a plurality of correction patterns.

A second aspect of the invention for achieving the foregoing object is a printing method for forming, on a medium, a plurality of correction patterns each including a pre-carry pattern and a post-carry pattern, comprising: forming the pre-carry pattern on the medium, carrying the medium in a carrying direction after forming the pre-carry pattern, and then forming the post-carry pattern on the medium after carrying the medium; wherein the plurality of correction patterns are formed on the medium lined up in a direction that intersects the carrying direction.

Features and objects of the present invention other than the above will become clear by reading the description of the present specification with reference to the accompanying drawings.

BRIEF DESCRIPTION OF THE DRAWINGS

FIG. 10 is an explanatory diagram of the structure of the rotary encoder.

FIG. 11A is a timing chart of the waveform of the output signal during forward rotation. FIG. 11B is a timing chart of the waveform of the output signal during rotation in reverse.

FIG. 25, in FIGS. 25A to 25D, shows examples of the dots making up the band patterns.

Figure 1:
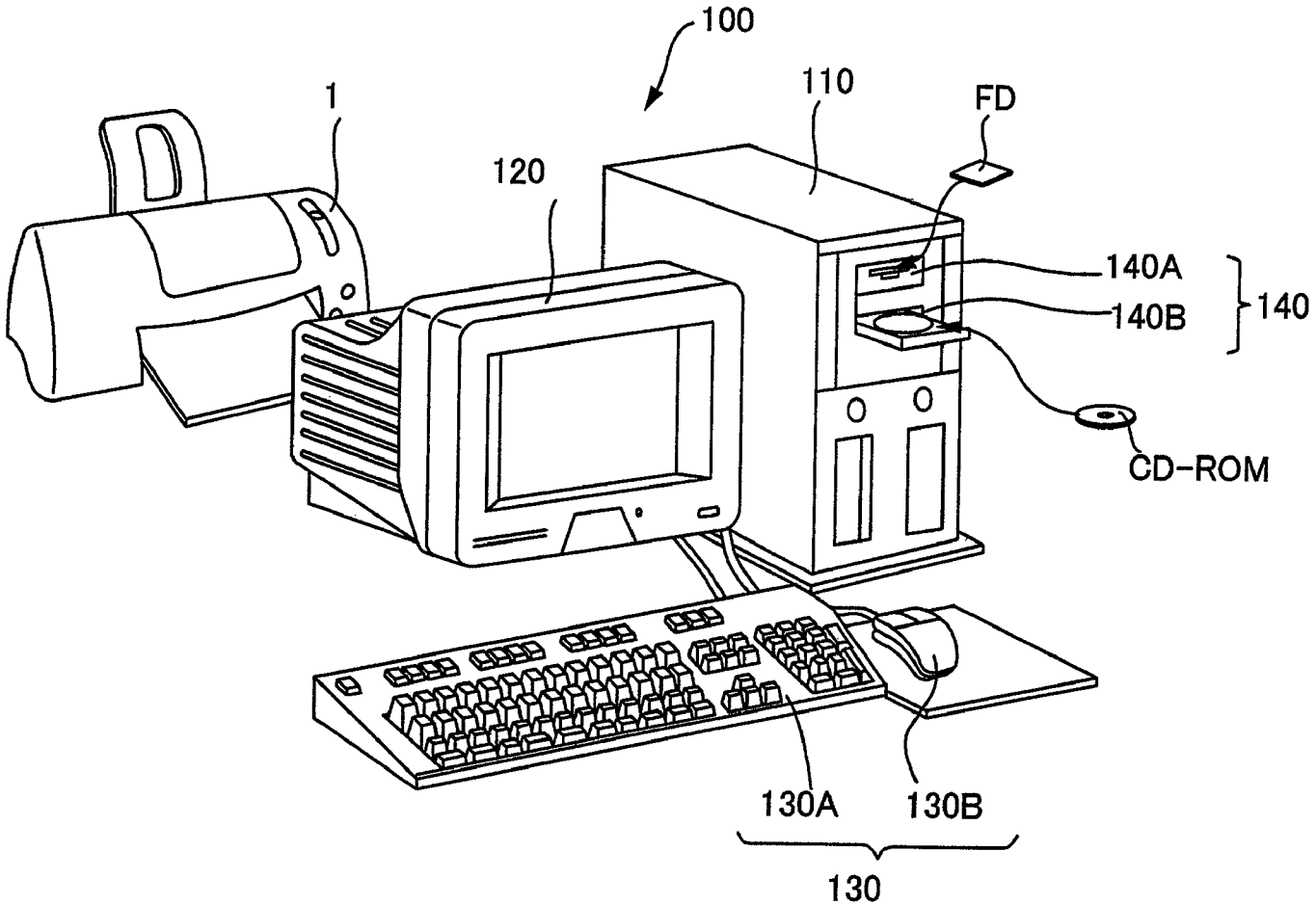
FIG. 1 is an explanatory diagram of the overall configuration of a printing system.

In order to facilitate a more complete understanding of the present invention and the advantages thereof, reference is now made to the following description taken in conjunction with the accompanying drawings.

DESCRIPTION OF PREFERRED EMBODIMENTS

Overview of the Disclosure

At least the following matters will be made clear by the explanation in the present specification and the description of the accompanying drawings.

A printing method for forming a plurality of correction patterns on a medium, comprises the steps of:

preparing the medium onto which the correction patterns are to be formed; and forming each of the correction patterns on the medium by forming a pre-carry pattern on the medium, carrying the medium, and then forming a post-carry pattern on the medium;

wherein the plurality of correction patterns are formed on the medium lined up in a direction that intersects the carrying direction.

With this printing method, it is possible to form an even greater number of correction patterns in a narrow region on the medium.

In the foregoing printing method, it is preferable that either the pre-carry patterns or the post-carry patterns of the plurality of correction patterns are each formed at the same position with respect to the carrying direction, and the other patterns are each formed at different positions with respect to the carrying direction. With this printing method, it is possible to form an even greater number of correction patterns in a narrow region on the medium.

In the foregoing printing method, it is preferable that, after the other pattern of one correction pattern has been formed on the medium, the medium is carried, and then the other pattern of another correction pattern is formed on the medium. With this printing method, the carry amount by which carrying is performed between formation of the pre-carry pattern and formation of the post-carry pattern of one correction pattern and the carry amount by which carrying is performed between formation of the pre-carry pattern and formation of the post-carry pattern of another correction pattern are different. Thus, the spacing between the pre-carry pattern and the post-carry pattern is different for each correction pattern.

In the foregoing printing method, it is preferable that a plurality of nozzles lined up in the carrying direction are moved, and the pre-carry patterns and the post-carry patterns are formed using the nozzles that are moved. It is also preferable that either the pre-carry patterns or the post-carry patterns of the plurality of correction patterns are each formed at the same position with respect to the carrying direction, and the other patterns are each formed at different positions with respect to the carrying direction; and the nozzles that form the other pattern of one correction pattern are different from the nozzles that form the other pattern of another correction pattern. With this printing method, the positions in the carrying direction of the nozzles that are used when forming each correction pattern are different, and thus the positions in the carrying direction of the patterns that are formed are different. In the foregoing printing method, it is preferable that the nozzles are capable of forming dots of a plurality of sizes on the medium; and at least either one of the pre-carry patterns and the post-carry patterns are made of the dots of a plurality of sizes. Because the most suitable correction pattern for a test pattern made of only large dots and the most suitable correction pattern for a test pattern made of only small dots can be different due to the effects of how the ink dries and how the ink bleeds, with this printing method it is possible to select the most suitable correction pattern using a test pattern made of dots of a plurality of sizes, and thus it is possible to specify an average correction amount. It is also preferable that at least either one of the pre-carry patterns and the post-carry patterns are made of a plurality of dots of different colors. Because the influence of assembly error and dimension tolerance, for example, of the nozzles for various colors can lead to the most suitable correction patterns for test patterns made of different colors being different, with this printing method it is possible to specify an average correction amount by selecting the most suitable correction pattern using a test pattern made of dots of different colors. It is also preferable that a length in the carrying direction of a region in which the plurality of correction patterns are formed is shorter than twice the length from a most upstream nozzle to a most downstream nozzle of the plurality of nozzles. With this printing method, it is possible to form a large number of correction patterns in a narrow region in which only a single correction pattern can be formed in the carrying direction.

In the foregoing printing method, it is preferable that an upstream side roller positioned on the upstream side of a print region and a downstream side roller positioned on the downstream side of the print region are capable of carrying the medium in the carrying direction; and the correction patterns are formed on the medium when the medium is carried by either one of the upstream side roller and the downstream side roller. The carrying state using two rollers is different from the carrying state using a single roller. With the present printing method, it is possible to form many correction patterns in a narrow print region when the medium is carried by a single roller. It is also preferable that a correction amount for a carry amount when carrying the medium using the upstream side roller and the downstream side roller is different from a correction amount for a carry amount when carrying the medium using the one of the rollers. Because the carrying state using two rollers is different from the carrying state using a single roller, a correction amount is set for each of these carrying states. It is preferable that a shape of the downstream side roller is different from a shape of the upstream side roller. If the shape of the two rollers is different, then the carrying state using two rollers and the carrying state using a single roller becomes different. With this printing method, it is possible to form many correction patterns in a narrow print region when the medium is carried by a single roller. It is preferable that a shape of a driven roller in opposition to the downstream side roller is different from a shape of a driven roller in opposition to the upstream side roller. If the shape of the driven rollers is different, then the carrying state using two rollers and the carrying state using a single roller will become different carrying states. With this printing method, it is possible to form many correction patterns in a narrow print region when the medium is carried by a single roller. It is preferable that a carrying velocity of the downstream side roller is different from a carrying velocity of the upstream side roller. If the carrying velocities of the two rollers are different, then the carrying state using two rollers and the carrying state using a single roller will become different carrying states. With this printing method, it is possible to form many correction patterns in a narrow print region when the medium is carried by a single roller.

In the foregoing printing method, an upstream side roller positioned on the upstream side of a print region and a downstream side roller positioned on the downstream side of the print region may be capable of carrying the medium in the carrying direction; and the correction patterns may be formed on the medium when the medium is carried by the upstream side roller and the downstream side roller. As described above, with the present printing method, the state when forming the correction patterns is not limited only to a state in which carrying is being performed using one of the two rollers.

In the foregoing printing method, it is preferable that the pattern to be formed at the same position with respect to the carrying direction of one correction pattern is formed on the medium away from the pattern to be formed at the same position with respect to the carrying direction of another correction pattern. This printing method is convenient when the user is selecting the most suitable correction pattern from among a plurality of correction patterns. However, it is also possible for the pattern, which is to be formed at the same position with respect to the carrying direction, of one correction pattern to be formed on the medium in a single piece with the pattern, which is to be formed at the same position with respect to the carrying direction, of another correction pattern.

In the foregoing printing method, it is preferable that the medium is carried a plurality of times between formation of the pre-carry patterns and formation of the post-carry patterns. With this printing method, it is possible to detect the carry error that has accumulated during the plural number of carries performed between formation of the pre-carry patterns and formation of the post-carry patterns.

In the foregoing printing method, it is preferable that notation for identifying the correction patterns is appended to each of the correction patterns. This printing method is convenient when the user is selecting the most suitable correction pattern from among a plurality of correction patterns. It is also preferable that the notation is formed when the pre-carry patterns are formed. With this printing method, it is possible to form many correction patterns and also form notation for identifying the correction patterns in a narrow print region. It is also preferable that the notation is formed adjacent in the carrying direction to the correction patterns. With this printing method it is possible to shorten the spacing between the plurality of correction patterns, and thus many correction patterns can be formed in a narrow print region.

A test pattern comprises:

a plurality of correction patterns;

wherein each of the correction patterns has a pre-carry pattern formed before a medium is carried in a carrying direction, and a post-carry pattern formed after the medium has been carried in the carrying direction and that is formed adjacent in the carrying direction to the pre-carry pattern; and wherein the plurality of correction patterns are formed on the medium lined up in a direction that intersects the carrying direction.

With this test pattern, it is possible to form a greater number of correction patterns in a narrow region on a medium.

A method of producing a test pattern having a plurality of correction patterns, comprises:

preparing the medium onto which the correction patterns are to be formed; and forming each of the correction patterns on the medium by forming a pre-carry pattern on the medium, carrying the medium, and then forming a post-carry pattern on the medium;

wherein the plurality of correction patterns are formed on the medium lined up in a direction that intersects the carrying direction.

With this method for producing a test pattern, it is possible to form a greater number of correction patterns in a narrow region on a medium.

A printing apparatus for forming on a medium a plurality of correction patterns each having a pre-carry pattern and a post-carry pattern, comprises:

a carry unit for carrying the medium in a carrying direction;

wherein the pre-carry pattern is formed on the medium before the carry unit carries the medium in the carrying direction;

wherein the post-carry pattern is formed on the medium after the carry unit carries the medium in the carrying direction; and wherein the plurality of correction patterns are formed on the medium lined up in a direction that intersects the carrying direction.

With this printing apparatus, it is possible to form a greater number of correction patterns in a narrow region on a medium.

A printing method for forming, on a medium, a plurality of correction patterns each having a reference pattern serving as a reference and a comparative pattern formed adjacent in a carrying direction to the reference pattern, comprises:

ejecting ink from a partial nozzle group that is made of a part of a plurality of nozzles lined up in the carrying direction to form, on the medium, either one of the reference pattern and the comparative pattern;

carrying the medium in the carrying direction; and after the medium has been carried, ejecting ink from a nozzle group more downstream in the carrying direction than the partial nozzle group to form the other pattern on the medium;

wherein the nozzle group that is used to form the comparative pattern of one correction pattern is different from the nozzle group that is used to form the comparative pattern of another correction pattern.

With this printing method, it is possible to set the spacing between the reference pattern and the comparative pattern to an appropriate spacing for each correction pattern when printing a plurality of correction patterns.

In the foregoing printing method, it is preferable that the one pattern is formed by a nozzle group of the plurality of nozzles on the upstream side thereof in the carrying direction, and wherein the other pattern is formed by a nozzle group of the plurality of nozzles on the downstream side thereof in the carrying direction. With this printing method, carrying by the carry unit performed between formation of the reference pattern and formation of the comparative pattern is made large, and thus detection of carry error becomes easy.

In the foregoing printing method, it is preferable that the nozzle group that is used to form the reference pattern of one correction pattern is the same as the nozzle group that is used to form the reference pattern of another correction pattern. With this printing method, the spacing between the reference pattern and the comparative pattern of one correction pattern is different from the spacing between the reference pattern and the comparative pattern of another correction pattern. That is, it is possible to form, on the medium, a plurality of correction patterns whose spacing is different.

In the foregoing printing method, it is preferable that the plurality of nozzles are lined up at a predetermined spacing; and a spacing between the reference pattern and the comparative pattern of different ones of the plurality of correction patterns changes in a stepwise manner in increments of the predetermined spacing. With this printing apparatus, the spacing between the reference patterns and the correction patterns changes in a stepwise manner because the nozzles that are used when forming the correction patterns are shifted in one nozzle increments.

In the foregoing printing method, it is preferable that a carry amount carried by the carry unit between formation of the reference pattern and formation of the comparative pattern in one correction pattern is equal to the carry amount in another correction pattern. It is also preferable that the plurality of correction patterns are formed on the medium in the carrying direction. With this printing method, the spacing between the reference pattern and the comparative pattern of each correction pattern is not changed by changing in the carry amount, but rather is changed by changing the nozzles that are used, and thus the spacing of the correction patterns can be set to a correct spacing.

In the foregoing printing method, it is preferable that the plurality of correction patterns are formed on the medium in the direction in which the plurality of nozzles are moved. With this printing method, it is possible to form an even greater number of correction patterns in a narrow region on the medium. It is also preferable that a length in the carrying direction of a region in which the plurality of correction patterns are formed is shorter than twice the length from a most upstream nozzle to a most downstream nozzle of the plurality of nozzles. According to this printing method, it is possible to form many correction patterns in a narrow region in which only a single correction can be formed in the carrying direction.

In the foregoing printing method, it is preferable that an upstream side roller positioned on the upstream side of a print region and a downstream side roller positioned on the downstream side of the print region are capable of carrying the medium in the carrying direction; and the correction patterns are formed on the medium when the medium is carried by either one of the upstream side roller and the downstream side roller. The carrying state using two rollers is different from the carrying state using a single roller. With the present printing method, it is possible to form many correction patterns in a narrow print region when the medium is carried by a single roller. It is also preferable that a correction amount for a carry amount when carrying the medium using the upstream side roller and the downstream side roller is different from a correction amount for a carry amount when carrying the medium using the one of the rollers. Because the carrying state using two rollers is different from the carrying state using a single roller, a correction amount is set for each of these carrying states. It is preferable that a shape of the downstream side roller is different from a shape of the upstream side roller. If the shape of the two rollers is different, then the carrying state using two rollers and the carrying state using a single roller becomes different. With this printing method, it is possible to form many correction patterns in a narrow print region when the medium is carried by a single roller. It is preferable that a shape of a driven roller in opposition to the downstream side roller is different from a shape of a driven roller in opposition to the upstream side roller. If the shape of the driven rollers is different, then the carrying state using two rollers and the carrying state using a single roller will become different carrying states. With this printing method, it is possible to form many correction patterns in a narrow print region when the medium is carried by a single roller. It is preferable that a carrying velocity of the downstream side roller is different from a carrying velocity of the upstream side roller. If the carrying velocities of the two rollers are different, then the carrying state using two rollers and the carrying state using a single roller will become different carrying states. With this printing method, it is possible to form many correction patterns in a narrow print region when the medium is carried by a single roller.

In the foregoing printing method, an upstream side roller positioned on the upstream side of a print region and a downstream side roller positioned on the downstream side of the print region may be capable of carrying the medium in the carrying direction; and the correction patterns may be formed on the medium when the medium is carried by the upstream side roller and the downstream side roller. As described above, with the present printing method, the state when forming the correction patterns is not limited only to a state in which carrying is being performed using one of the two rollers.

In the foregoing printing method, it is preferable that the medium is carried a plurality of times between formation of the reference patterns and formation of the comparative patterns. With this printing method, it is possible to detect the carry error that has accumulated during the plural number of carries performed between formation of the reference patterns and formation the comparative patterns.

In the foregoing printing method, it is preferable that the nozzles are capable of forming dots of a plurality of sizes on the medium; and at least either one of the reference patterns and the comparative patterns are made of the dots of a plurality of sizes. Because the most suitable correction pattern for a test pattern made of only large dots and the most suitable correction pattern for a test pattern made of only small dots can be different due to the effects of how the ink dries or how the ink bleeds, with this printing method, it is possible to select the most suitable correction pattern using a test pattern made of dots of a plurality of sizes, and thus it is possible to specify an average correction amount. It is also preferable that at least either one of the reference patterns and the comparative patterns are made of a plurality of dots of different colors. Because the effects of assembly error and dimension tolerance, for example, of the nozzles for various colors can lead to the most suitable correction patterns for test patterns made of different colors being different, with this printing method it is possible to specify an average correction amount by selecting the most suitable correction pattern using a test pattern made of dots of different colors.

A method of producing a test pattern that includes a plurality of correction patterns each having a reference pattern serving as a reference and a comparative pattern formed adjacent in a carrying direction to the reference pattern, comprises:

ejecting ink from a partial nozzle group that is made of a part of a plurality of nozzles lined up in the carrying direction to form, on the medium, either one of the reference pattern and the comparative pattern;

carrying the medium in the carrying direction; and after the medium has been carried, ejecting ink from a nozzle group more downstream in the carrying direction than the partial nozzle group to form the other pattern on the medium;

wherein the nozzle group that is used to form the comparative pattern of one correction pattern is different from the nozzle group that is used to form the comparative pattern of another correction pattern.

With this method for producing a test pattern, it is possible to set the spacing between the reference pattern and the comparative pattern to an appropriate spacing for each correction pattern when printing a plurality of correction patterns.

A printing apparatus comprises:

a carry unit for carrying a medium in a carrying direction; and a carriage for moving a plurality of nozzles lined up in the carrying direction;

wherein the printing apparatus ejects ink from a partial nozzle group that is made of a part of the plurality of nozzles lined up in the carrying direction to form, on the medium, either one of the reference pattern and the comparative pattern;

wherein the printing apparatus carries the medium in the carrying direction;

wherein after the medium has been carried, the printing apparatus ejects ink from a nozzle group more downstream in the carrying direction than the partial nozzle group to form the other pattern on the medium; and wherein the nozzle group that is used to form the comparative pattern of one correction pattern is different from the nozzle group that is used to form the comparative pattern of another correction pattern.

With this printing apparatus, it is possible to set the spacing between the reference pattern and the comparative pattern to an appropriate spacing for each correction pattern when printing a plurality of correction patterns.

First Embodiment

===(1) Configuration of the Printing System===

An embodiment of a printing system (computer system) is described next with reference to the drawings. However, the description of the following embodiment also includes implementations relating to a computer program and a storage medium having recorded thereon the computer program, for example.

FIG. 1 is an explanatory drawing showing the external structure of a printing system. A printing system 100 is provided with a printer 1, a computer 110, a display device 120, an input device 130, and a record-and-play device 140. The printer 1 is a printing apparatus for printing images on a medium such as paper, cloth, or film. The computer 110 is electrically connected to the printer 1, and outputs print data corresponding to an image to be printed to the printer 1 in order to print the image with the printer 1. The display device 120 has a display, and displays a user interface such as an application program or a printer driver. The input device 130 is for example a keyboard 130A and a mouse 130B, and is used to operate an application program or adjust the settings of the printer driver, for example, in accordance with the user interface that is displayed on the display device 120. A flexible disk drive device 140A and a CD-ROM drive device 140B are employed as the record-and-play device 140.

A printer driver is installed on the computer 110. The printer driver is a program for achieving the function of displaying the user interface on the display device 120, and in addition it also achieves the function of converting image data that have been output from the application program into print data. The printer driver is stored on a storage medium (computer-readable storage medium) such as a flexible disk FD or a CD-ROM. Also, the printer driver can be downloaded onto the computer 110 via the Internet. It should be noted that this program can be made of codes for achieving various functions.

It should be noted that "printing apparatus" in a narrow sense means the printer 1, but in a broader sense it means the system constituted by the printer 1 and the computer 110.

===(1) Configuration of the Printer===

<(1) Regarding the Configuration of the Inkjet Printer>

Figure 2:
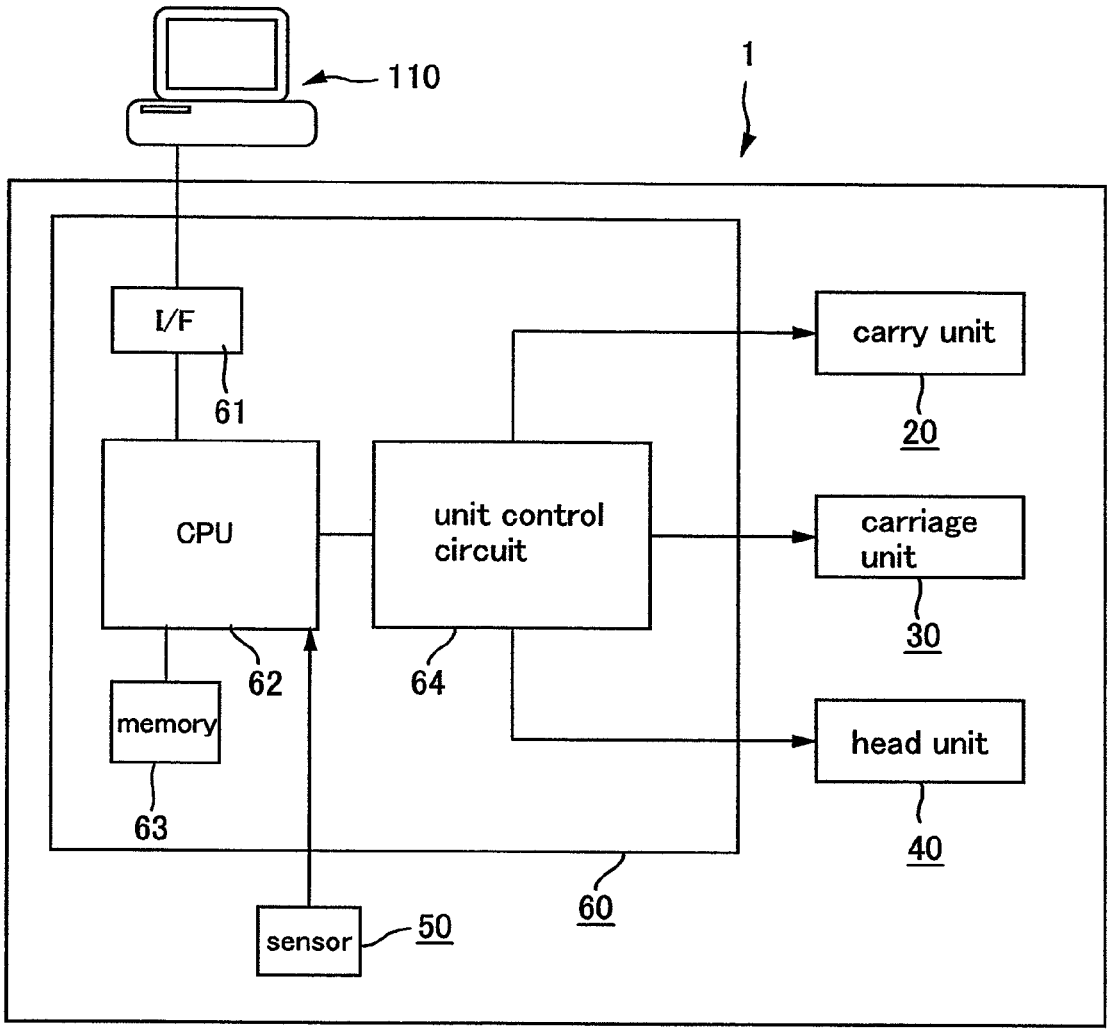
FIG. 2 is a block diagram of the overall configuration of a printer.
Figure 3:
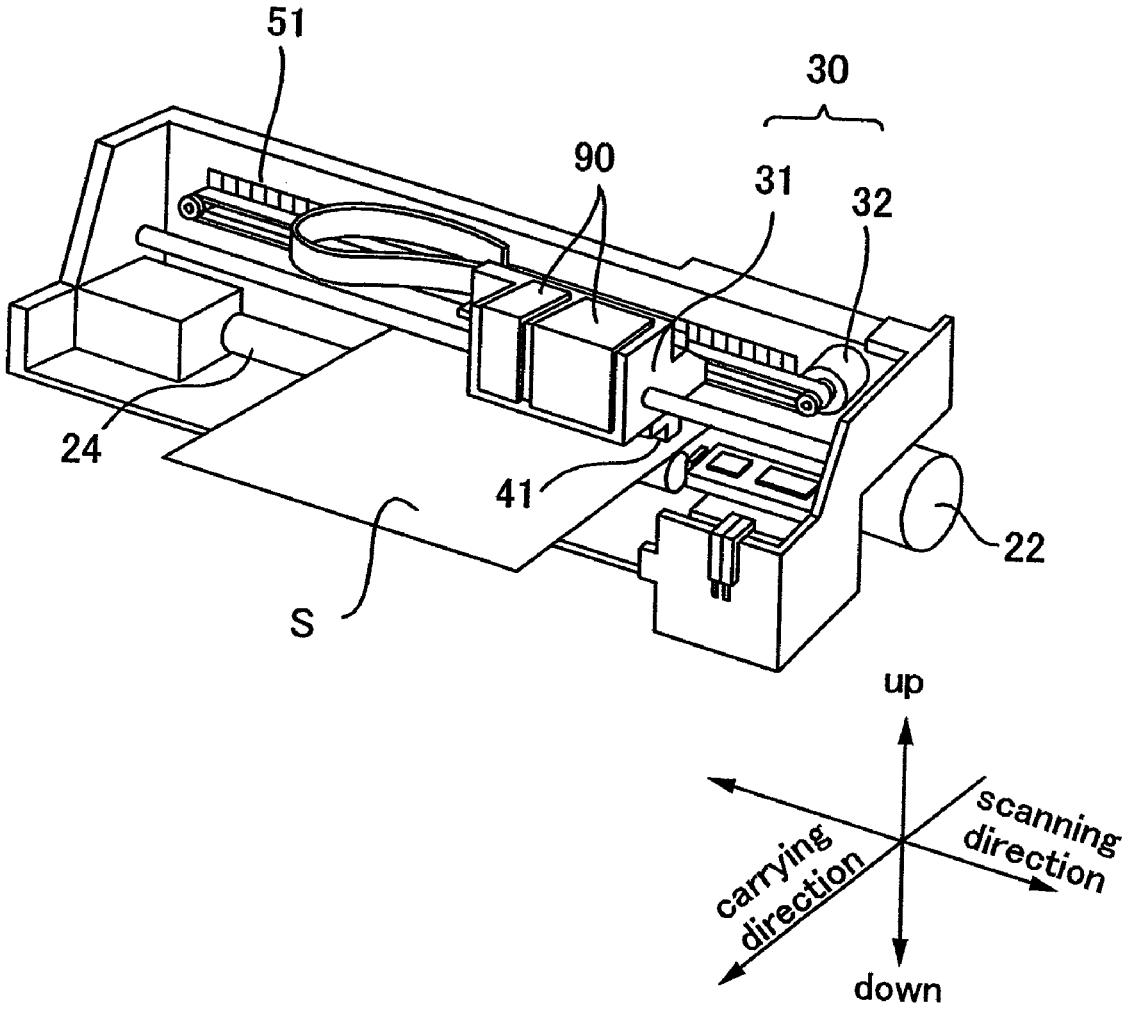
FIG. 3 is a schematic view of the overall configuration of the printer.
Figure 4:
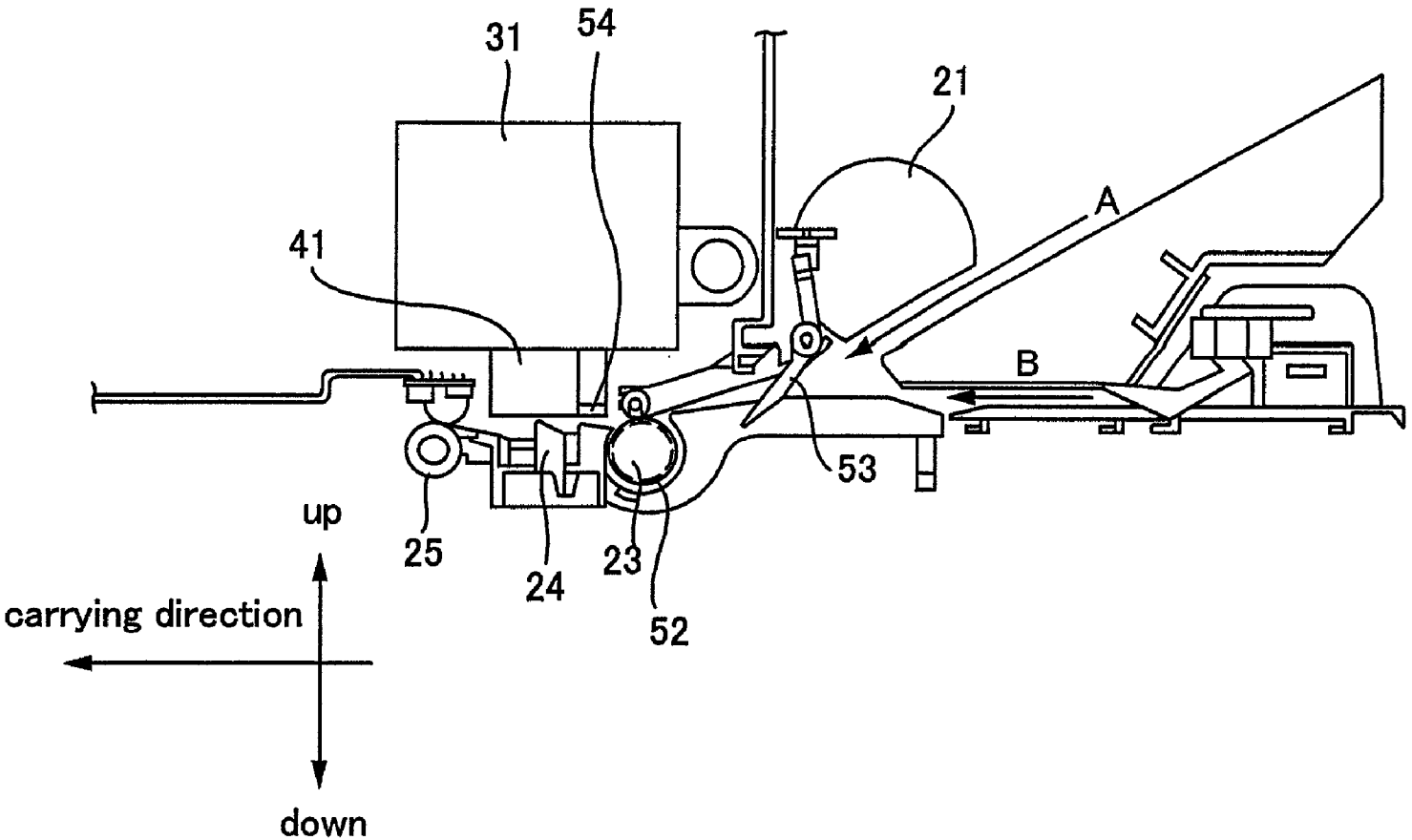
FIG. 4 is a transverse sectional view of the overall configuration of the printer.

FIG. 2 is a block diagram of the overall configuration of the printer of this embodiment. Also, FIG. 3 is a schematic diagram of the overall configuration of the printer of this embodiment. FIG. 4 is lateral sectional view of the overall configuration of the printer of this embodiment. The basic structure of the printer according to the present embodiment is described below.

The printer of this embodiment has a carry unit 20, a carriage unit 30, a head unit 40, a sensor 50, and a controller 60. The printer 1 that has received print data from the computer 110, which is an external device, controls the various units (the carry unit 20, the carriage unit 30, and the head unit 40) using the controller 60. The controller 60 controls the units in accordance with the print data that are received from the computer 110 to form an image on a paper. The sensor 50 monitors the conditions within the printer 1, and it outputs the results of this detection to the controller 60. The controller receives the detection results from the sensor, and controls the units based on these detection results.

The carry unit 20 is for feeding a medium (for example, paper S) into a printable position and carrying the paper in a predetermined direction (hereinafter, referred to as the "carrying direction") by a predetermined carry amount during printing. In other words, the carry unit 20 functions as a carrying mechanism for carrying paper. The carry unit 20 has a paper supply roller 21, a carry motor 22 (hereinafter, referred to as "PF motor"), a carry roller 23, a platen 24, and a paper discharge roller 25. However, the carry unit 20 does not necessarily have to include all of these structural elements in order to function as a carrying mechanism. The paper supply roller 21 is a roller for automatically supplying paper that has been inserted into a paper insert opening into the printer. The paper supply roller 21 has a transverse cross-sectional shape in the shape of the letter D, and the length of the circumference section thereof is set longer than the carrying distance to the carry motor 23, so that using this circumference section the paper can be carried up to the carry roller 23. The carry motor 22 is a motor for carrying paper in the paper carrying direction, and is constituted by a DC motor. The carry roller 23 is a roller for carrying the paper S that has been supplied by the paper supply roller 21 up to a printable region, and is driven by the carry motor 22. The platen 24 supports the paper S during printing. The paper discharge roller 25 is a roller for discharging the paper S for which printing has finished to outside the printer. The paper discharge roller 25 is rotated in synchronization with the carry roller 23.

The carriage unit 30 is for making the head move (perform scanning movement) in a predetermined direction (hereinafter, this is referred to as the "scanning direction"). The carriage unit 30 has a carriage 31 and a carriage motor 32 (also referred to as "CR motor"). The carriage 31 is capable of moving back and forth in the scanning direction (and accordingly, the head moves in the scanning direction). Also, the carriage 31 detachably retains an ink cartridge for accommodating ink. The carriage motor 32 is a motor for moving the carriage 31 in the scanning direction, and is constituted by a DC motor.

The head unit 40 is for ejecting ink onto paper. The head unit 40 has a head 41. The head 41 has a plurality of nozzles, which are ink ejecting sections, and ejects ink intermittently from each of the nozzles. The head 41 is provided in the carriage 31. Thus, when the carriage 31 moves in the scanning direction, the head 41 also moves in the scanning direction. A dot line (raster line) is formed on the paper in the scanning direction as a result of the head 41 intermittently ejecting ink while moving in the scanning direction.

The sensor 50 includes a linear encoder 51, a rotary encoder 52, a paper detection sensor 53, and an optical sensor 54, for example. The linear encoder 51 is for detecting the position of the carriage 31 in the scanning direction. The rotary encoder 52 is for detecting the amount of rotation of the carry roller 23. The paper detection sensor 53 is for detecting the position of the front end of the paper to be printed. The paper detection sensor 53 is provided in a position where it can detect the position of the front end of the paper as the paper is being fed toward the carry roller 23 by the paper supply roller 21. It should be noted that the paper detection sensor 53 is a mechanical sensor that detects the front end of the paper through a mechanical mechanism. More specifically, the paper detection sensor 53 has a lever that can be rotated in the carrying direction, and this lever is arranged such that it protrudes into the path over which the paper is carried. In this way, the front end of the paper comes into contact with the lever and the lever is rotated, and thus the paper detection sensor 53 detects the position of the front end of the paper by detecting movement of the lever. The optical sensor 54 is attached to the carriage 31. The optical sensor 54 detects whether or not the paper is present by its light-receiving section detecting reflected light of the light that has been irradiated onto the paper from the light-emitting section. The optical sensor 54 detects the position of the edge section of the paper while being moved by the carriage 41. The optical sensor 54 optically detects the edge section of the paper, and thus has higher detection accuracy than the mechanical paper detection sensor 53.

The controller 60 is a control unit for carrying out control of the printer. The controller 60 has an interface section 61, a CPU 62, a memory 63, and a unit control circuit 64. The interface section 61 exchanges data between the computer 110, which is an external device, and the printer 1. The CPU 62 is a computer processing device for carrying out overall control of the printer. The memory 63 is for reserving a working region and a region for storing the programs for the CPU 62, for instance, and has memory elements such as a RAM or an EEPROM. The CPU 62 controls the various units via the unit control circuit 64 in accordance with programs stored in the memory 63.

<(1) Regarding the Printing Operation>

Figure 5:
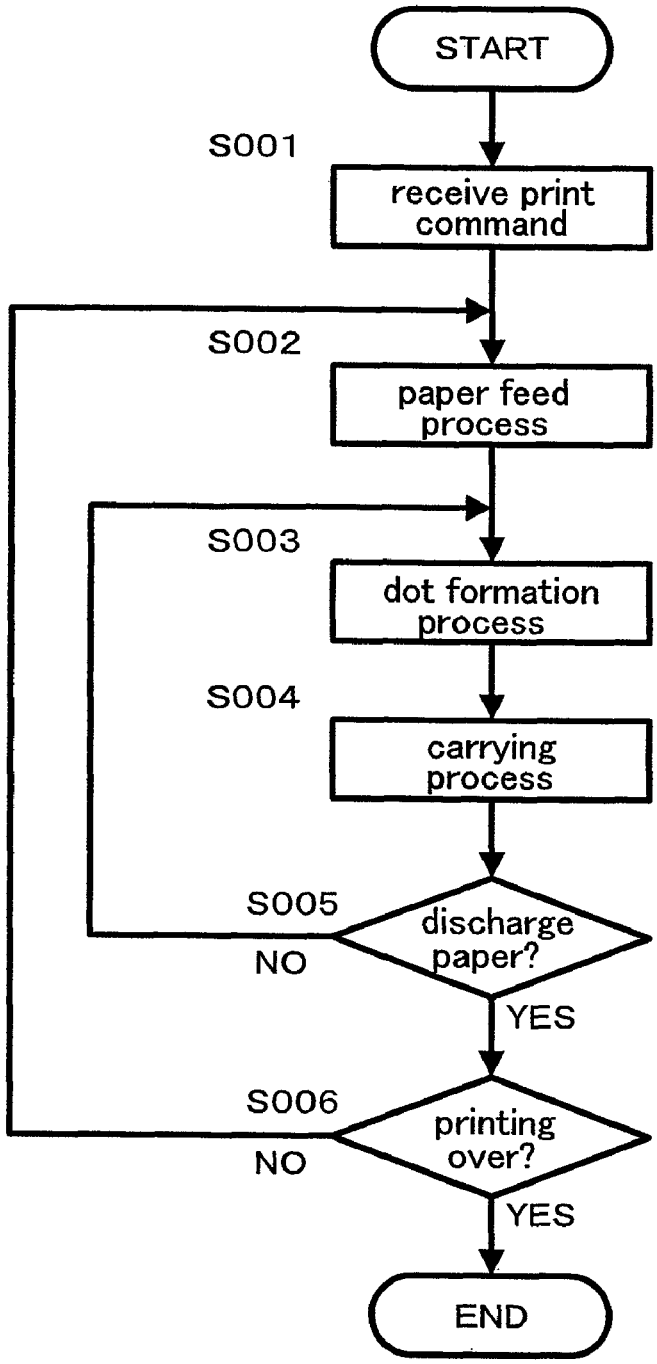
FIG. 5 is a flowchart of the processing during printing.

FIG. 5 is a flowchart of the processing during printing. The processes described below are executed by the controller 60 controlling the various units in accordance with a program stored in the memory 63. This program has codes for executing the various processes.

The controller 60 receives a print command via the interface section 61 from the computer 110 (S001). This print command is included in the header of the print data transmitted from the computer 110. The controller 60 then analyzes the content of the various commands included in the print data that is received and uses the units to perform the following paper supply process, carrying process, and ink ejection process, for example.

First, the controller 60 performs the paper supply process (S002). The paper supply process is a process for supplying paper to be printed into the printer and positioning the paper at a print start position (also referred to as the "indexed position"). The controller 60 rotates the paper supply roller 21 to feed the paper to be printed up to the carry roller 23. The controller 60 rotates the carry roller 23 to position the paper that has been fed from the paper supply roller 21 at the print start position. When the paper has been positioned at the print start position, at least some of the nozzles of the head 41 are in opposition to the paper.

Next, the controller 60 performs the dot formation process (S003). The dot formation process is a process for intermittently ejecting ink from a head that moves in the scanning direction so as to form dots on the paper. The controller 60 drives the carriage motor 32 to move the carriage 31 in the scanning direction. The controller 60 then causes the head to eject ink in accordance with the print data during the period that the carriage 31 is moving. Dots are formed on the paper when ink droplets ejected from the head land on the paper.

Next, the controller 60 performs the carrying process (S004). The carrying process is a process for moving the paper relative to the head in the carrying direction. The controller 60 drives the carry motor to rotate the carry roller and thereby carry the paper in the carrying direction. Through this carrying process the head 41 can form dots at positions that are different from the positions of the dots formed in the preceding dot formation process.

Next, the controller 60 determines whether or not to discharge the paper under printing (S005). The paper is not discharged if there are still data for printing on the paper which is currently being printed on. In this case, the controller 60 alternately repeats the dot formation and carrying processes until there is no longer data for printing, thereby gradually printing an image made of dots on the paper. When there are no longer data for printing on the paper which is currently being printed on, the controller 60 discharges that paper. The controller 60 discharges the printed paper to the outside by rotating the paper discharge roller. It should be noted that whether or not to discharge the paper can also be determined based on a paper discharge command included in the print data.

Next, the controller 60 determines whether or not to continue printing (S006). If the next sheet of paper is to be printed, then printing is continued and the paper supply process for the next sheet of paper is started. If the next sheet of paper is not to be printed, then the printing operation is ended.

<(1) Regarding the Nozzles>

Figure 6:
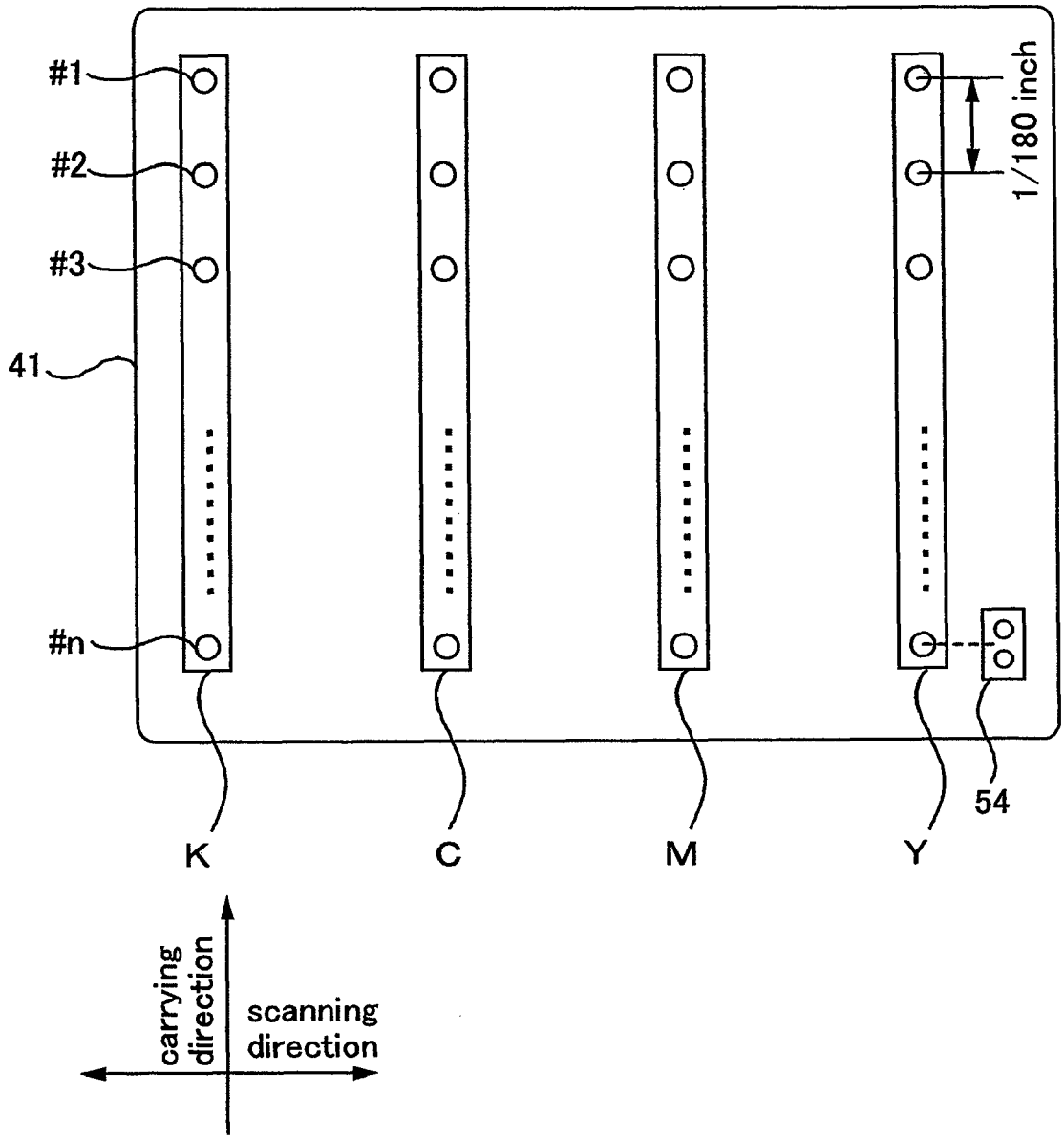
FIG. 6 is an explanatory diagram showing the arrangement of the nozzles.

FIG. 6 is an explanatory diagram showing the arrangement of the nozzles in the lower surface of the head 41. A black ink nozzle row K, a cyan ink nozzle row C, a magenta ink nozzle row M, and a yellow ink nozzle row Y are formed in the lower surface of the head 41. Each nozzle row is provided with a plurality of nozzles (in this embodiment, 180), which are ejection openings for ejecting the inks of the respectively colors.

The plurality of nozzles of the nozzle rows are arranged in a row at a constant spacing (nozzle pitch) in the carrying direction. In the present embodiment the nozzle pitch is 180 dpi (1/180 inch).

The nozzles of each nozzle row are each assigned numbers (#1 to #180) that become smaller the more downstream the nozzle. That is, the nozzle #1 is positioned more downstream in the carrying direction than the nozzle #180. Each nozzle is provided with a piezo element (not shown) as a drive element for driving the nozzle and causing it to eject an ink droplet. Also, the optical sensor 54 is provided substantially in the same position as the nozzle #180, which is on the most upstream side, as regards its position in the paper carrying direction.

<(1) Driving the Head>

Figure 7:
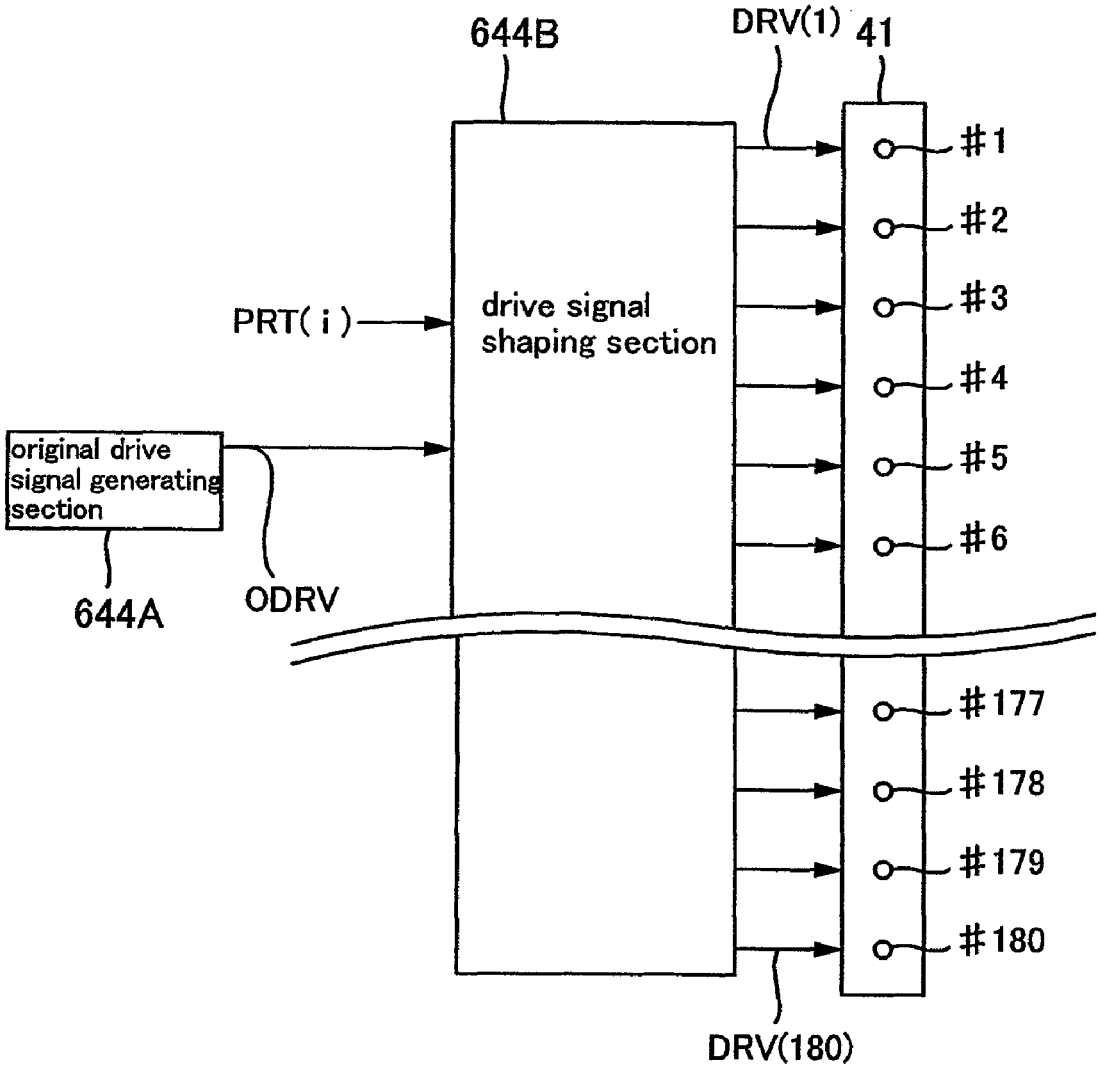
FIG. 7 is an explanatory diagram of the drive circuit of the head unit.

FIG. 7 is an explanatory diagram of the drive circuit of the head unit 40. This drive circuit is provided within the unit control circuit 64 mentioned earlier, and as shown in the figure, it is provided with an original drive signal generating section 644A and a drive signal shaping section 644B. A drive circuit for the nozzles #1 to #180 is provided for each nozzle row, that is, for each of the black (K), cyan (C), magenta (M), and yellow (Y) color nozzle rows. Also, driving of the piezo elements is carried out individually for each nozzle. The number in parentheses added to the end of each signal name in the diagram indicates the number of the nozzle to which that signal is supplied.

When a voltage of a predetermined duration is applied between electrodes provided on both ends of the piezo elements, the piezo elements expand for the duration of voltage application and deform a lateral wall of the ink channel. As a result, the volume of the ink channel shrinks in accordance with the expansion of the piezo elements, and an amount of ink that corresponds to this shrinkage is ejected from the nozzles #1 to #180 for each color as ink droplets.

The original drive signal generating section 644A generates an original signal ODRV that is used in common by the nozzles #1 to #180. The original signal ODRV is a signal that includes a plurality of pulses during the main-scanning period of a single pixel (time during which the carriage 41 crosses over the length of a single pixel).

The drive signal shaping section 644B receives an original signal ODRV that is output from the original drive signal generating section 644A together with a print signal PRT(i). The drive signal shaping section 644B shapes the original signal ODRV in correspondence with the level of the print signal PRT(i) and outputs it toward the piezo element of the respective nozzles #1 to #180 as a drive signal DRV(i). The piezo element of each nozzle #1 to #180 is driven in accordance with the drive signal DRV from the drive signal shaping section 644B.

<(1) Regarding the Head Drive Signals>

Figure 8:
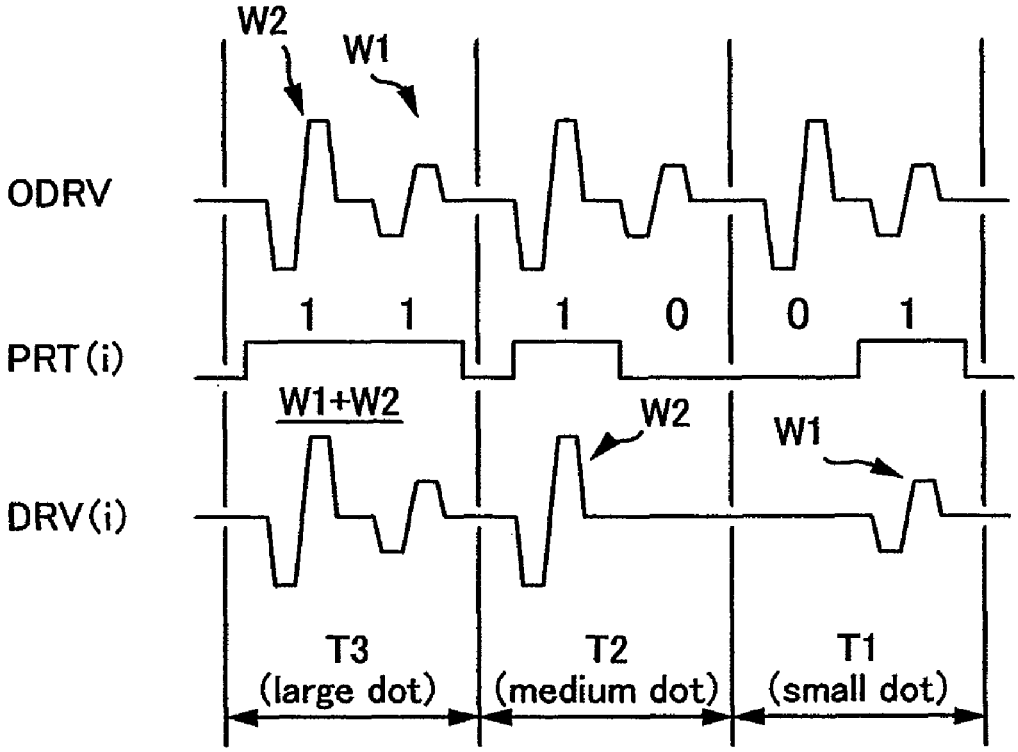
FIG. 8 is a timing charge for describing the various signals.

FIG. 8 is a timing chart for explaining these signals. That is, this diagram shows a timing chart for the various signals, namely an original signal ODRV, a print signal PRT(i), and a drive signal DRV(i).

The original signal ODRV is a signal that is supplied from the original drive signal generating section 644A and shared by the nozzles #1 to #180. In this embodiment, the original signal ODRV includes two drive pulses, namely a first pulse W1 and a second pulse W2, during the main-scanning period of a single pixel (period during which the carriage crosses over the length of a single pixel). It should be noted that the original signal ODRV is output from the original drive signal generating section 644A to the drive signal shaping section 644B.

The print signal PRT is a signal corresponding to the pixel data allocated to a single pixel. That is, the print signal PRT is a signal corresponding to the pixel data included in the print data. In this embodiment, each print signal PRT(i) is a signal having two bits of information per pixel. It should be noted that the drive signal shaping section 644B shapes the original signal ODRV in correspondence with the signal level of the print signal PRT and outputs the drive signal DRV.

The drive signal DRV is a signal that is obtained by blocking the original signal ODRV in correspondence with the level of the print signal PRT. That is, when the level of the print signal PRT is "1" then the drive signal shaping section 644B allows the pulse of the original signal ODRV to pass unchanged as the drive signal DRV. On the other hand, when the level of the print signal PRT is "0", the drive signal shaping section 644B blocks the pulse of the original signal ODRV. It should be noted that the drive signal shaping section 644B outputs the drive signal DRV to the piezo element provided for each nozzle. The piezo element is then driven in accordance with the drive signal DRV.

When the print signal PRT(i) corresponds to the two bits of data "01" then only the first pulse W1 is output in the first half of the pixel period. Accordingly, a small ink droplet is output from the nozzle, forming a small-sized dot (small dot) on the paper. When the print signal PRT(i) corresponds to the two bits of data "10" then only the second pulse W2 is output in the second half of a single pixel interval. Accordingly, a medium-sized ink droplet is ejected from the nozzle, forming a medium-sized dot (medium dot) on the paper. When the print signal PRT(i) corresponds to the two bits of data "11" then both the first pulse W1 and the second pulse W2 are output during a single pixel interval. Accordingly, a large ink droplet is ejected from the nozzle, forming a large-sized dot (large dot) on the paper.

As described above, the drive signal DRV(i) in a single pixel period is shaped such that it may have three different waveforms corresponding to the three different values of the print signal PRT(i).

(1) Carrying Process (1) Regarding the Carrying Process)

Figure 9:
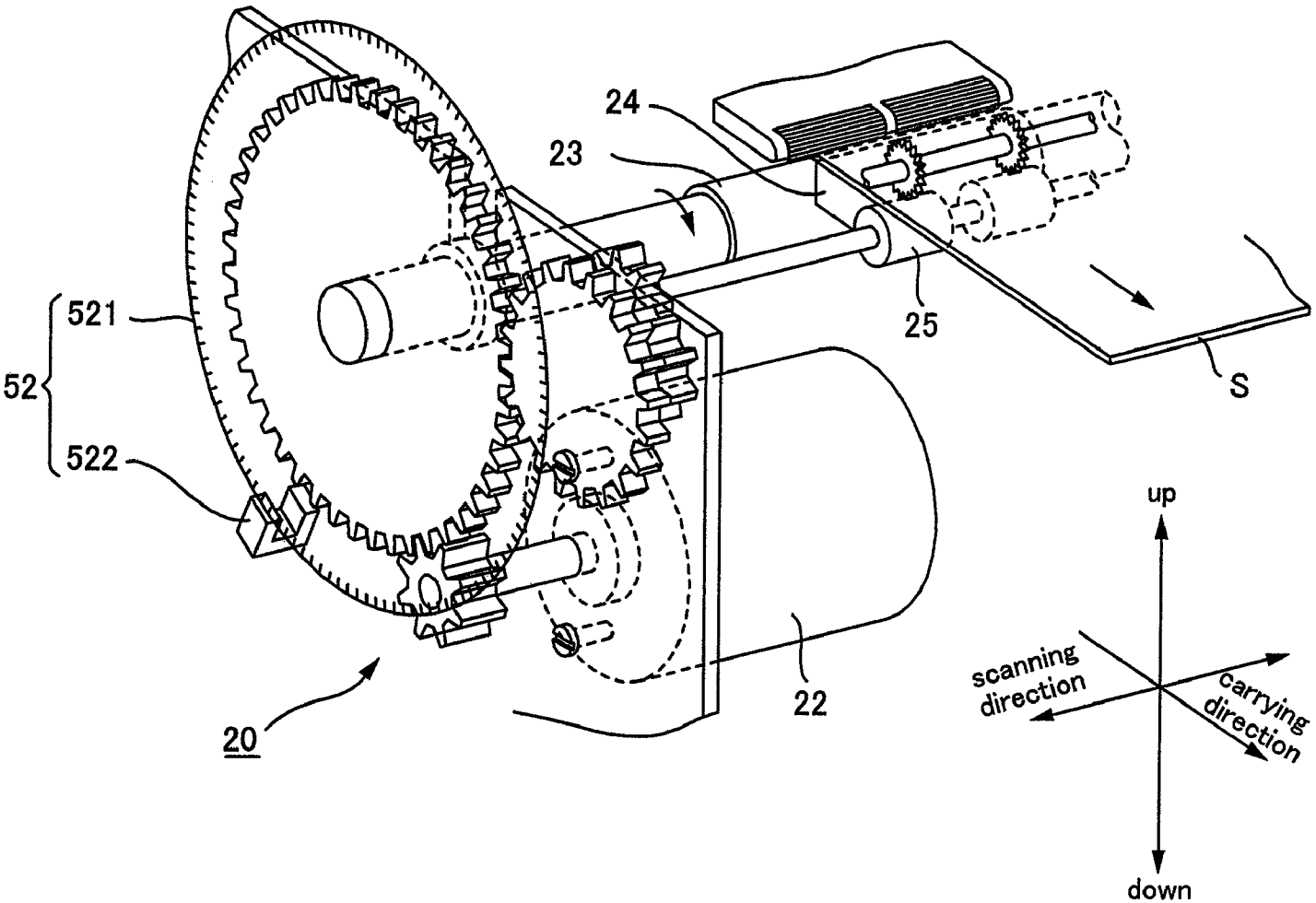
FIG. 9 is an explanatory diagram of the structure of the carry unit.

FIG. 9 is an explanatory diagram of the structure of the carry unit 20. It should be noted that in this diagram, structural elements that have already been described are assigned identical reference numerals and thus description thereof is omitted.

The carry unit 20 drives the carry motor 22 by a predetermined drive amount in accordance with a carry command from the controller. The carry motor 22 generates a drive force in the rotation direction that corresponds to the drive amount that has been ordered. The carry motor 22 then rotates the carry roller 23 using this drive force. The carry motor 22 also rotates the paper discharge roller 25 using this drive force. That is, when the carry motor 22 generates a predetermined drive amount, the carry roller 23 and the paper discharge roller 25 rotate by a predetermined rotation amount. When the carry roller 23 and the paper discharge roller 25 are rotated by the predetermined rotation amount, the paper is carried by a predetermined carry amount. Because the carry roller 23 and the paper discharge roller 25 rotate in synchronization, as long as the paper is in contact with at least one of the carry roller 23 and the paper discharge roller 25, it can be carried by the carry unit 20.

The amount that the paper is carried is determined according to the rotation amount of the carry roller 23. Consequently, if the rotation amount of the carry roller 23 can be detected, then it is also possible to detect the carry amount of the paper. Accordingly, the rotary encoder 52 is provided in order to detect the rotation amount of the carry roller 23.

<(1) Regarding the Structure of the Rotary Encoder>

FIG. 10 is an explanatory diagram of the structure of the rotary encoder. It should be noted that in this diagram, structural elements that have already been described are assigned identical reference numerals and thus description thereof is omitted.

The rotary encoder 52 has a scale 521 and a detecting section 522.

The scale 521 has numerous slits provided at a predetermined spacing. The scale 521 is provided in the carry roller 14. That is, the scale 521 rotates together with the carry roller 23 when the carry roller 23 is rotated. For example, when the carry roller 23 is rotated such that the paper S is carried by 1/1440 inch, the scale 521 is rotated by one slit with respect to the detecting section 522.

The detecting section 522 is provided in opposition to the scale 521, and is fastened on the main printer unit side. The detecting section 522 has a light-emitting diode 522A, a collimating lens 522B, and a detection processing section 522C. The detection processing section 522C is provided with a plurality of (for instance, four) photodiodes 522D, a signal processing circuit 522E, and two comparators 522Fa and 522Fb.

The light-emitting diode 522A emits light when a voltage Vcc is applied to it via resistors on both sides, and this light is incident on the collimating lens. The collimating lens 522B turns the light that is emitted from the light-emitting diode 522A into parallel light, and irradiates the parallel light on the scale 521. The parallel light that passes through the slits provided in the scale then passes through stationary slits (not shown) and is incident on the photodiodes 522D. The photodiodes 522D convert the incident light into electrical signals. The electrical signals that are output from the photodiodes are compared in the comparators 522Fa and 522Fb, and the results of these comparisons are output as pulses. Then, the pulse ENC-A and the pulse ENC-B that are output from the comparators 522Fa and 522Fb become the output of the rotary encoder 52.

<(1) Regarding the Signals of the Rotary Encoder>

FIG. 11A is a timing chart of the waveform of the output signal when the carry motor 22 is rotating forward. FIG. 11B is a timing chart of the waveform of the output signal when the carry motor 22 is rotating in reverse.

As shown in FIG. 11A and FIG. 11B, the phases of the pulse ENC-A and the pulse ENC-B are misaligned by 90 degrees both when the carry motor 12 is rotating forward and when it is rotating in reverse. When the carry motor 22 is rotating forward, that is, when the paper S is carried in the carrying direction, then the phase of the pulse ENC-A leads the phase of the pulse ENC-B by 90 degrees. On the other hand, when the carry motor 22 is rotating in reverse, that is, when the paper S is carried in the direction opposite the carrying direction, then the phase of the pulse ENC-A trails the phase of the pulse ENC-B by 90 degrees. A single period T of the pulses is the same as the time during which the carry roller 23 is rotated by the spacing between the slits of the scale 521 (for example, by 1/1440 inch (1 inch=2.54 cm)).

If the controller counts the number of pulse signals, then the rotation amount of the carry roller 23 can be detected, and thus the carry amount of the paper can be detected. Also, if the controller detects a single period T of the pulses, then the rotation velocity of the carry roller 23 can be detected, and thus the carry velocity of the paper can be detected.

<(1) Regarding the Flow of Carrying>

Figure 12:
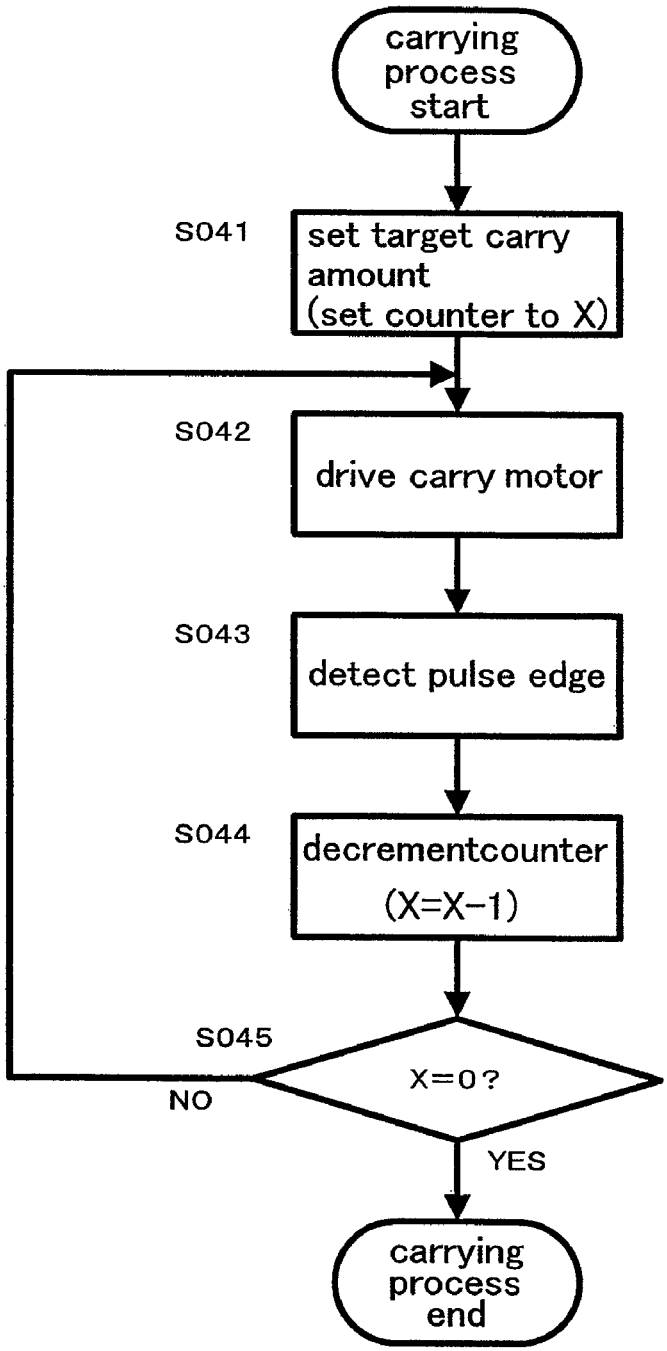
FIG. 12 is a flowchart of the carrying process.

FIG. 12 is a flowchart of the carrying process. The various operations that are described below are executed by the controller controlling the carrying unit 20 based on a program stored in the memory within the printer 1. Also, this program is made of codes for performing the various operations described below.

First, the controller sets a target carry amount (S041). The target carry amount is a value for determining the drive amount of the carry unit 20 in order for the carry unit 20 to carry the paper S by a carry amount that has been defined as a target. The target carry amount is determined based on carry command data (information about the target carry amount) included in the print data that are received from the computer side. Also, the target carry amount is set by the controller setting the value of the counter. In the following description the target carry amount is defined as X, and thus the controller sets the value of the counter to X.

Next, the controller drives the carry motor 22 (S042). When the carry motor 22 generates a predetermined drive amount, the carry roller 23 is rotated by a predetermined rotation amount. Then, the slit 521 provided on the carry roller 23 is also rotated when the carry roller 23 is rotated by the predetermined rotation amount.

Next, the controller detects the edge of the pulse signal of the rotary encoder (S043). That is, the controller detects the rising edge or the falling edge of the pulse ENC-A or the pulse ENC-B. For example, if the controller detects one edge, then this means that the carry roller 23 has carried the paper S by a carry amount of 1/1440 inch.

When the controller has detected an edge of the pulse signal of the rotary encoder, the controller decrements the value of the counter (S044). That is, if the value of the counter is X, then the controller sets the value of the counter to X−1 when it has detected one edge of the pulse signal.

Next, the controller repeats the operations of S042 to S044 until the value of the counter becomes zero (S045). That is, the controller drives the carry motor 22 until the same number of pulses as the value initially set in the counter has been detected. In this fashion, the carry unit 20 carries the paper S in the carrying direction by a carry amount that corresponds to the value initially set in the counter.

For example, for the carry unit 20 to carry the paper S by 90/1440 inch, the controller sets the value of the counter to 90, thereby setting the target carry amount. The controller then reduces the value of the counter each time that it detects a rising edge or a falling edge of the pulse signal of the rotary encoder. Then, when the value of the counter has reached zero, the controller ends the carrying operation. This is because the detection of 90 pulse signals means that the carry roller 23 has carried the paper S by 90/1440 inch. Consequently, if the controller sets the value of the counter to 90 as the setting of the target carry amount, then the result is that the carry unit 20 carries the paper S by 90/1440 inch.

It should be noted that in the foregoing description the controller detects the rising edge or the falling edge of the pulse ENC-A or the pulse ENC-B, but it is also possible for it is detect both edges of the pulse ENC-A and the pulse ENC-B. The cycles of the pulse ENC-A and the pulse ENC-B are equal to the slit spacing of the scale 521 and the phases of the pulse ENC-A and the pulse ENC-B are misaligned by 90 degrees, and therefore detection by the controller of one of the rising edge and the falling edge of the pulses means that the carry roller 23 has carried the paper by 1/5760 inch. In the present case, if the controller sets the value of the counter to 90, then the carry unit 20 carries the paper S by 90/5760 inch.

The foregoing description is for a single carrying operation. If the printer is to intermittently perform the carrying operation a plurality of times, then the controller sets the target carry amount (sets the value of the counter) each time the carrying operation is finished, and the carry unit 20 carries the paper S in accordance with the target carry amount that has been set.

Incidentally, the rotary encoder 52 directly detects the rotation amount of the carry roller 23, and strictly speaking, does not detect the carry amount of the paper S. That is, if slipping occurs between the carry roller 23 and the paper S, then the rotation amount of the carry roller 23 and the carry amount of the paper S do not match, and thus the rotary encoder 52 cannot accurately detect the carry amount of the paper S, resulting in a carry error (detection error). When slipping occurs between the carry roller 23 and the paper S in this manner, it is necessary for the controller to rotate the carry roller 23 by a larger carry amount than the target carry amount in order for the carry unit 20 to carry the paper S by the target carry amount. Accordingly, the controller is capable of correcting the target carry amount and setting the counter to a value that corresponds to the corrected target carry amount in order to carry the paper S by the most suitable carry amount.

In the embodiment described below, the rotary encoder is capable of detecting the rotation amount of the carry roller 23 in 1/5760 inch units. Also, the controller corrects the target carry amount using a minimum correction amount unit of 1/5760 inch.

===(1) Method for Determining the Correction Amount===

First, it is necessary to determine in advance the correction amount for the target carry amount prior to shipping the printer or at the user destination. Accordingly, the method for determining the correction amount is described below.

<Regarding the Procedure for Determining the Correction Amount>

Figure 13:
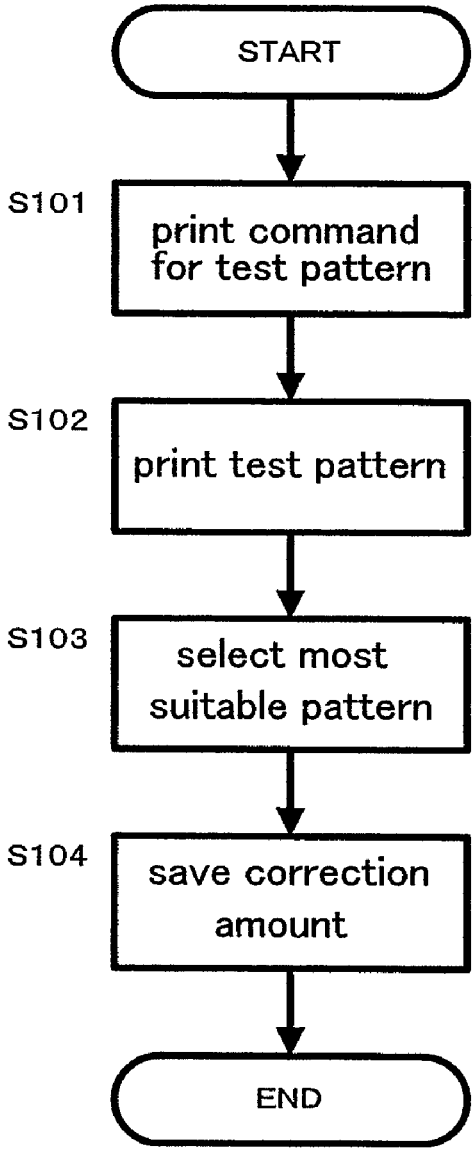
FIG. 13 is a flowchart for describing the procedure for determining the correction amount.

FIG. 13 is a flowchart for describing the procedure for determining the correction amount. The various operations of the printer that are described below are achieved in accordance with a program stored on the memory 63 in the printer. Also, this program is made of codes for performing the various operations described below.

Figure 14:
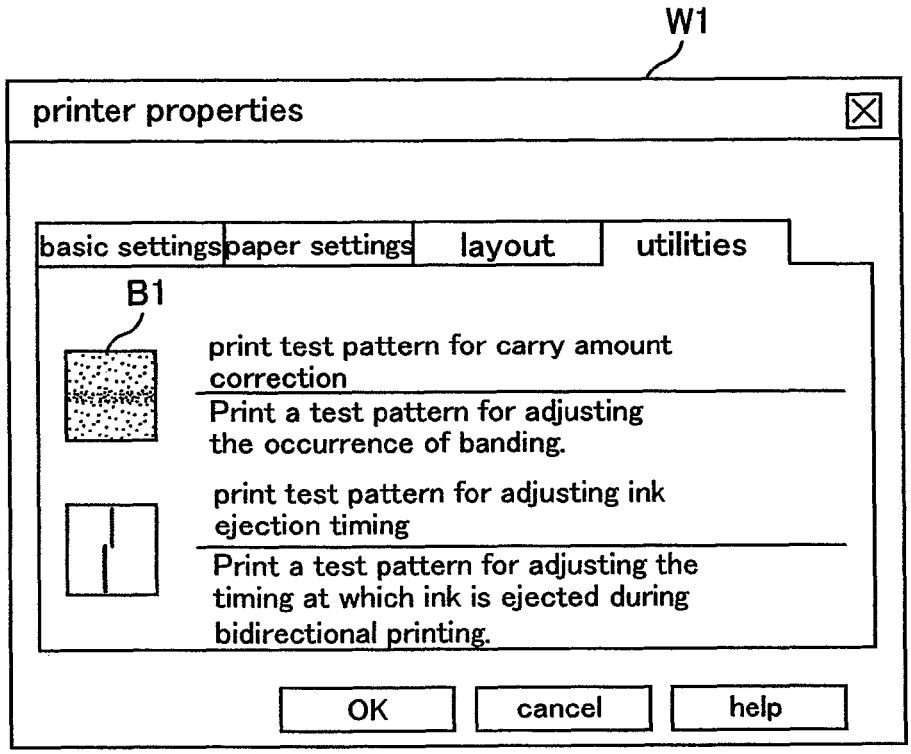
FIG. 14 is the command screen for printing the test pattern.

First, the printer receives a command signal ordering it to print a test pattern for carry amount correction (S101). This command signal can be received from the main computer unit or can be input through a button provided on the printer body. If the command for printing the test pattern is from the main computer unit, then a user interface such as that shown in FIG. 14 is displayed on the display device connected to the main computer unit. A button for ordering printing of the test pattern for carry amount correction is displayed within the window W1 displayed on the display device. When the user clicks this button, a signal ordering the test pattern to be printed is sent from the main computer unit to the printer 1.

Next, the printer prints a test pattern for carry amount correction (S102). After receiving the command signal, the printer searches for information on the test pattern for carry amount correction from among the test patterns in the memory 63. Then, the printer prints the test pattern on the paper S according to the information on the test pattern for carry amount correction.

Figure 15:
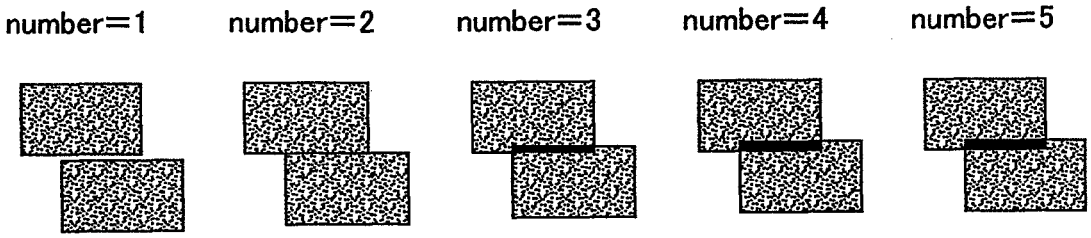
FIG. 15 is an example of the test pattern for carry amount correction.

FIG. 15 is an example of the test pattern for carry amount correction that is printed on the paper S. The test pattern that is printed on the paper has a plurality of correction patterns. For example, in the present embodiment, the test pattern that is printed on the paper has five correction patterns. The corrections patterns each have two band-shaped patterns. Hereinafter, the upper band-shaped pattern of the correction patterns is defined as the first band pattern, and the lower band-shaped pattern of the correction patterns is defined as the second band pattern. The distance between the first band pattern and the second band pattern differs for each correction pattern. The correction patterns thus correspond to specific correction amounts. For example, in the present embodiment, the distance between the first band pattern and the second band pattern, and by extension the corresponding correction amount, becomes progressively smaller from the left correction pattern. A white stripe (also referred to as "white banding" and "bright banding") or a black stripe (also referred to as "black banding" and "dark banding") occurs between the first band pattern and the second band pattern depending on the distance between the first band pattern and the second band pattern. However, very little banding occurs between the first band pattern and the second band pattern in the correction pattern that corresponds to the most suitable correction amount. For example, in this embodiment, very little banding occurs in the correction pattern indicated as "Number=2." The method for forming the test pattern for carry amount correction is described later.

Figure 16:
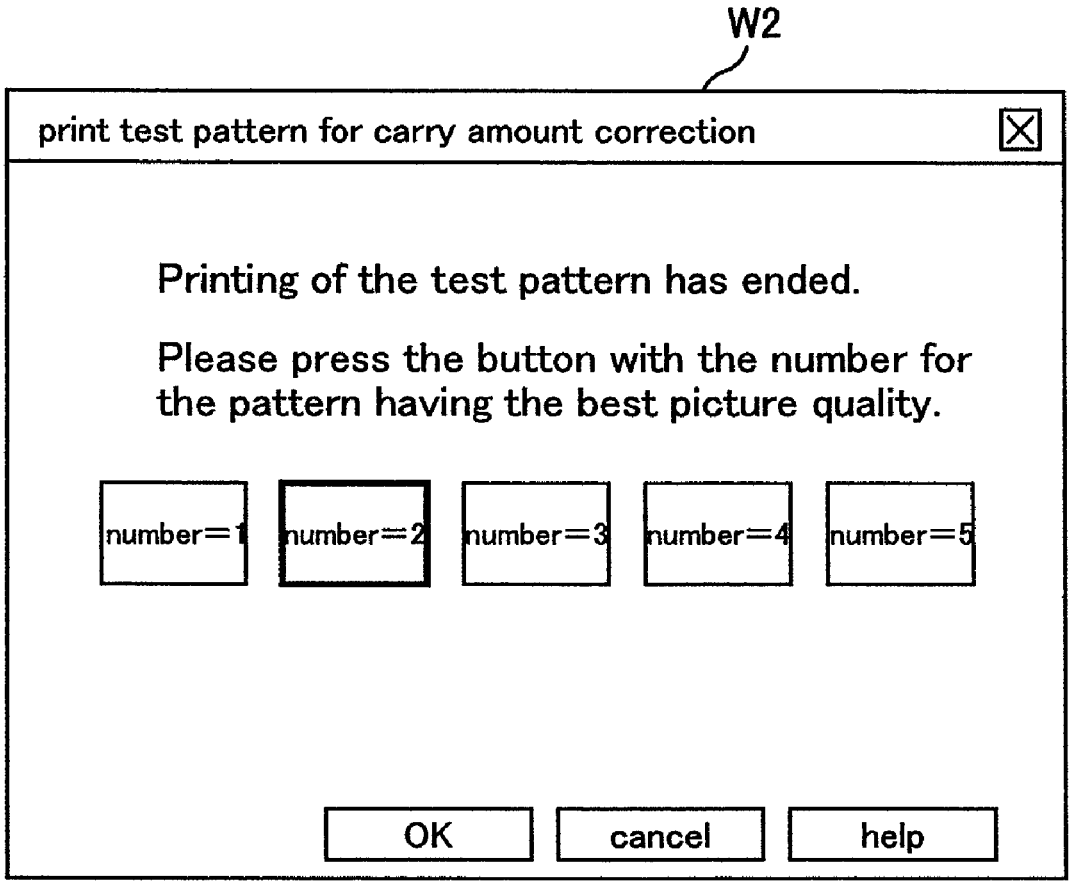
FIG. 16 is a screen for selecting the most suitable pattern.

After the test pattern for carry amount correction has been printed, the user carries out selection of the most suitable correction pattern from among the plurality of correction patterns that have been printed as the test pattern (S103). Selection of the most suitable pattern can be carried out on the main computer unit side or can be carried out on the printer body side. If selection of the most suitable pattern is carried out on the main computer unit side, then a user interface such as that shown in FIG. 16 is displayed on the display device connected to the main computer unit. A plurality of buttons are displayed in the window W2 that is displayed on the display device such that they correspond to the plurality of correction patterns that are printed. Then, by the user clicking one of these buttons, the correction pattern that corresponds to the button that has been clicked is selected as the most suitable pattern. For example, in the present embodiment the user clicks the button corresponding to "Number=2."

Next, the correction amount for correcting the carry amount is saved (stored) in the printer (S104). If selection of the most suitable pattern is performed on the main computer unit side, then information on the correction amount corresponding to the most suitable pattern (information on the carry amount) is sent from the computer to the printer. Then, the printer stores the information on the correction amount that is received in the memory 63 within the printer.

<(1) Correcting the Target Carry Amount>

Figure 17:
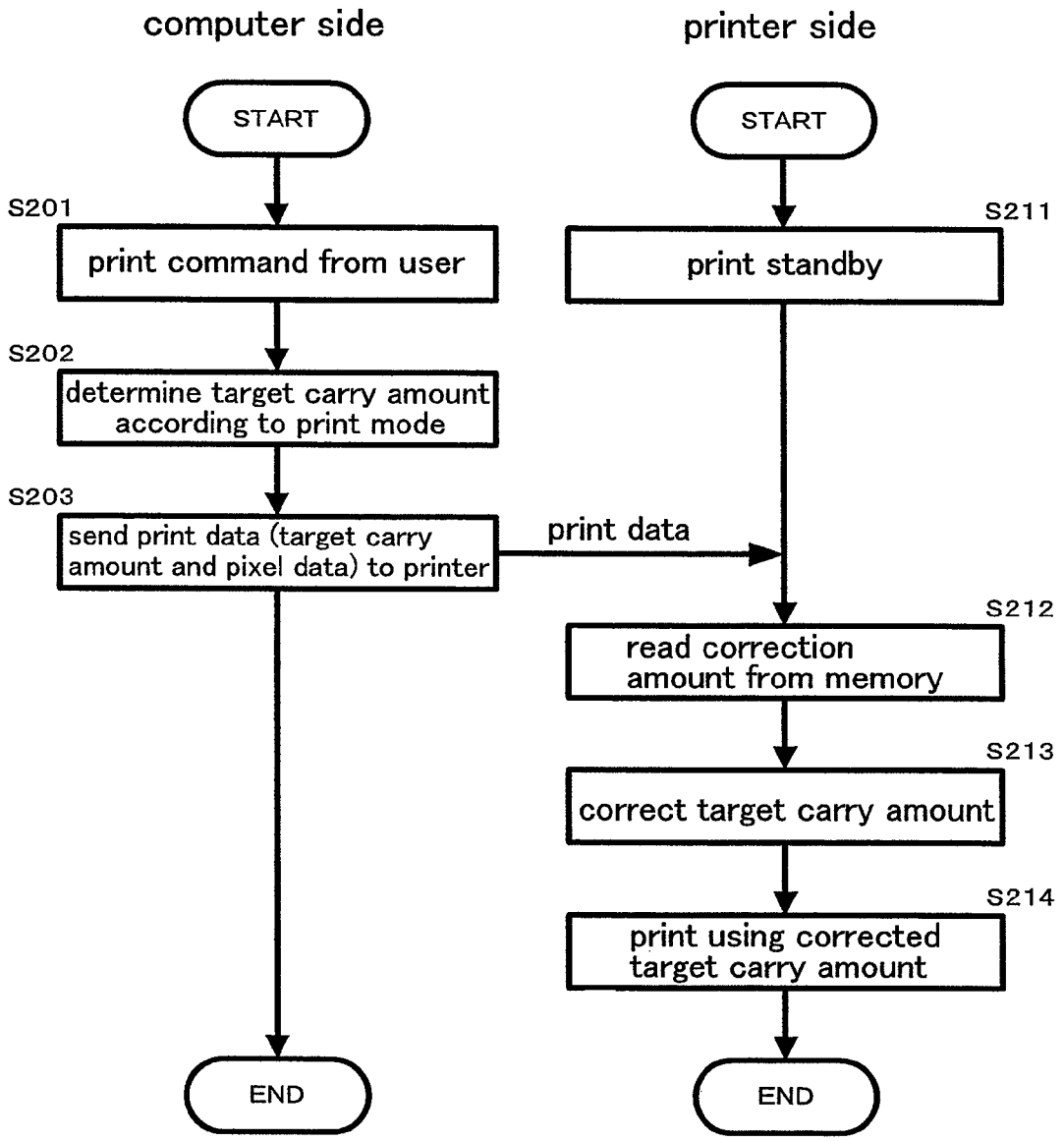
FIG. 17 is a flowchart of when forming an image on the paper.

FIG. 17 is a flowchart for describing the flow of operations when forming an image on the paper. The various operations of the printer that are described below are achieved in accordance with a program stored on the memory 63 in the printer. Also, the various operations of the main computer unit that are described below are achieved in accordance with a printer driver, which is a program stored in the main computer unit. Further, these programs are made of codes for performing the various operations described below.

First, the user turns on the power of the printer to set the printer into a print standby state (S211).

Then, the user performs a print command through an application that is operated on the computer side (S201). When the user performs the print command on the computer, setting of the print mode (print format) is carried out through the user interface of the printer driver. The printer driver is then capable of determining the target carry amount based on the print mode that has been set (S202). Also, the printer driver converts the image data, which is to be printed, into pixel data. This pixel data is data for pixels that corresponds to the resolution of the print mode that has been set.

The printer driver then transits print data that includes data on the target carry amount and the pixel data to the printer side (S203).

The printer receives the print data and reads the information on the correction amount that is stored in the memory (S212). Next, the printer corrects the target carry amount in accordance with the correction amount that has been read out (S213). Then, the value of the counter that is set during the carrying process is determined based on the corrected target carry amount. For example, if the paper S is to be carried by one inch, then unless the target carry amount is corrected, the value of the counter discussed above will be set to 5760, but if the carry amount that is stored on the memory corresponds to "+C(=+1/5760 inch), then the value of the counter becomes 5761 (=5760+1). Then, the printer carries out printing in accordance with the print data using the corrected target carry amount (S214). For example, even through carrying is performed with the value of the counter at 5761, the carry error and the correction amount cancel each other out and therefore the actual carry amount of the paper S becomes one inch. Because printing is carried out while the paper S is carried by the corrected target carry amount, the spacing in the carrying direction between the dots formed on the paper S is suitable, and thus a very precise image can be printed on the paper S.

===(1) Reference Description===

<(1) Regarding the Test Pattern of the Reference Example>

Figure 18:
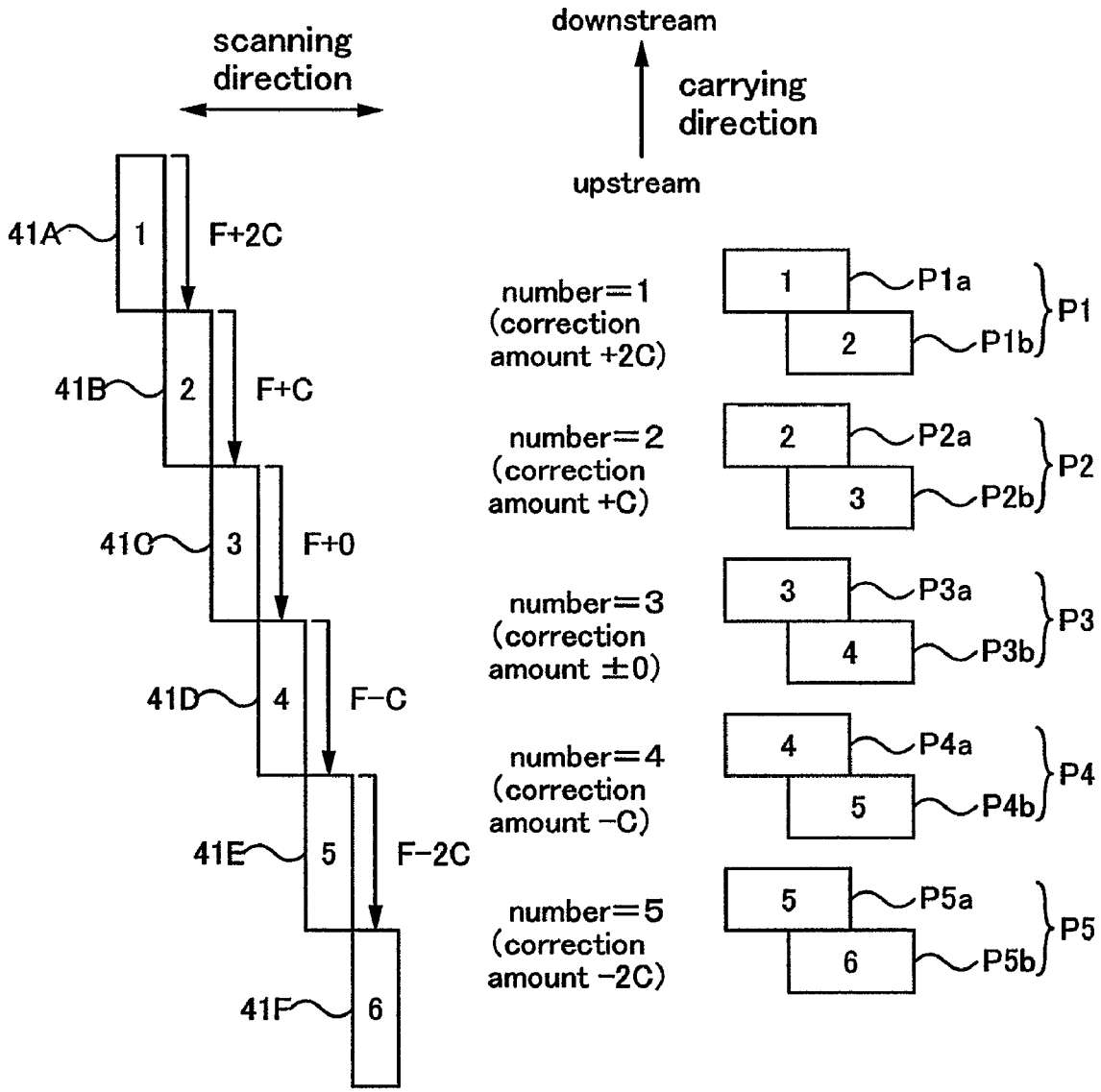
FIG. 18 is an explanatory diagram of the method for printing a test pattern according to a reference example.

FIG. 18 is an explanatory diagram of the method for printing the test pattern according to a reference example. The method for printing the test pattern of the reference example that is described below is performed during S102 mentioned above. It should be noted that the elongate shapes 41A to 41F that are drawn on the left side in the drawing indicate the positions of the head 41 with respect to the paper S, and are not printed on the paper S. Also, the numbers within the elongate shapes representing the head 41 indicate the number of the pass (a pass refers to the dot formation process of S003) of the relative position of the head. For example, the head 41C in the drawing indicates the relative position of the head 41 in the third pass. In this drawing it appears as if the head 41 is moving with respect to the paper S, but this drawing only shows the relative position between the head 41 and the paper S, and in practice, the relative positions of both are moving due to the paper S being carried in the carrying direction.

The correction patterns of the test pattern of the reference example are made of two band-shaped patterns (band patterns). Of the two band patterns, the band pattern (first band pattern) on the front end side of the paper (upper side in the drawing) is formed by the nozzles on the upstream side in the carrying direction (nozzle #180 side). On the other hand, of the two band patterns, the band pattern (second band pattern) on the rear end side of the paper (lower side in the drawing) is formed by the nozzles on the downstream side in the carrying direction (nozzle #1 side). Also, the first band pattern and the second band pattern are formed adjacent to one another in the carrying direction, and a boundary section is formed by these two band patterns. In this manner, the paper S is carried by substantially the width of the head 41 during the period between when the first band pattern has been formed until when the second band pattern is formed. Also, the two band patterns are formed shifted in the scanning direction such that the position of the boundary section formed by the two band patterns is clear. It should be noted that the numbers within the elongate shapes representing the band patterns in the figure indicate the number of the pass in which that pattern is formed.

The correction patterns are each formed by changing the carrying amount in a stepwise manner, and thus the state of the boundary section between the band patterns is different for each correction pattern. As a result, each correction pattern (or boundary section) corresponds to a different correction amount. As described below, with the method for printing a test pattern according to the reference example, the carry amount is changed in a stepwise manner in increments of C (=1/5760 inch) as the plurality of correction patterns (that is, boundary sections) are formed.

First, the paper S is carried such that the head 41 is positioned at the position of head 41A with respect to the paper S. Then, the first printing operation (pass 1) is performed, printing a first band pattern Pla of a correction pattern P1 denoted by "Number=1."

Next, the paper S is carried by the target carry amount F+2 C, thereby bringing the head 41 at the position of head 41B in the drawing with respect to the paper S. Here, the target carry amount F is a carry amount that substantially corresponds to the width of the head 41. For example, in a case where 180 nozzles are formed in the head 31 arranged at a spacing of 180 dpi, the target carry amount F is one inch. Then, the second dot formation operation (pass 2) is performed, printing a second band pattern P1*b* of the correction pattern P2 denoted by "Number=1." Thus, the correction pattern P1 denoted by "Number=1" is completed. When the second pass (pass 2: second dot formation process) is performed, the first band pattern P2*a* of the correction pattern P2 denoted by "Number=2" is printed at the same time that the second band pattern P1*b* is printed. That is, two band patterns (P1*b* and P2*a*) are printed in the second pass. A blank space is left as these two band patterns are formed.

Next, the paper S is carried by the target carry amount F+C, thereby bringing the head 41 at the position of head 41C in the drawing with respect to the paper S. Then, the third dot formation operation (pass 3) is performed, printing the second band pattern P2*b* of the correction pattern P2 denoted by "Number=2." Thus, the correction pattern P2 denoted by "Number=2" is completed. When the third pass (pass 3: third dot formation process) is performed, the first band pattern P3*a* of the correction pattern P3 denoted by "Number=3" is printed at the same time that the second band pattern P2*b* is printed. That is, two band patterns (P2*b* and P3*a*) are printed in the third pass. A blank space is left as these two band patterns are formed.

Then, substantially the same operations as the operations described above are performed to print the other correction patterns P3 to P5 on the print paper S. However, the target carry amount when carrying the paper S is changed in a stepwise manner in increments of C (=1/5760 inch) each time the paper S is carried by the width of the head. As a result, they are printed such that the spacing between the first band pattern and the second band pattern is different for each correction pattern.

With the method for printing a test pattern according to the reference example, carrying at a carry amount that is substantially equal to the width of the head is performed repeatedly to print a plurality of correction patterns (P1 to P5). Thus, the plurality of correction patterns (P1 to P5) that are printed on the paper S are arranged in the carrying direction. As a result, to print the test pattern of the reference example, it is necessary to secure a wide print region in the carrying direction.

<(1) Regarding the Difficulty of Printing the Test Pattern at the Lower End>

Figure 19A:
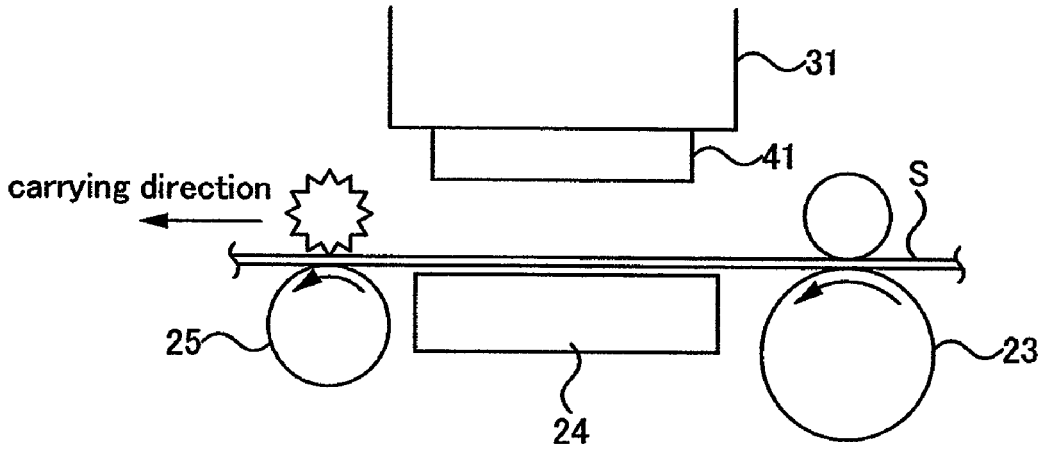
FIG. 19A is an explanatory diagram of a state during a normal carrying process.
Figure 19B:
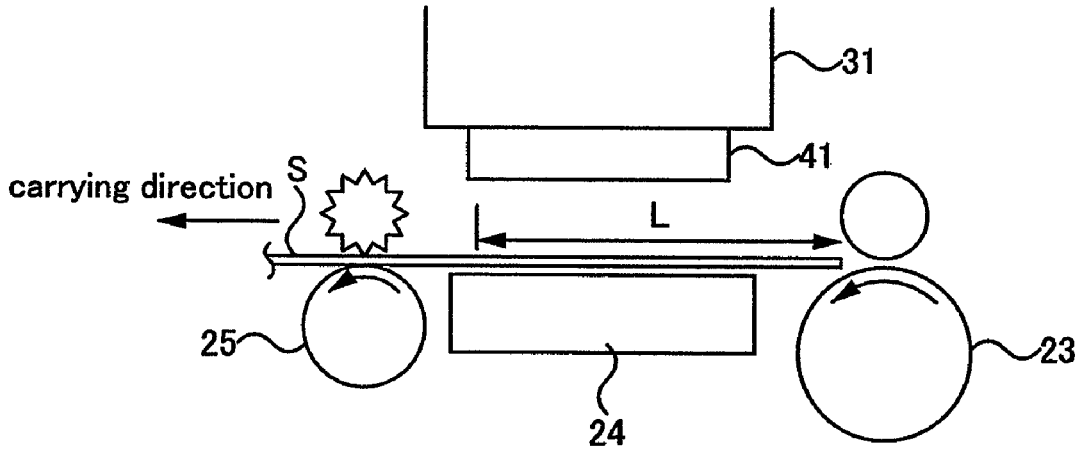
FIG. 19B is an explanatory diagram of a state during a carrying process after the rear end of the paper has passed the carry roller.

FIG. 19A is an explanatory diagram of a normal carrying process. FIG. 19B is an explanatory diagram of a carrying process after the rear end of the paper has passed the carry roller. In these drawings, structural elements that have already been described are assigned identical reference numerals and thus description thereof is omitted.

The carry roller 23 (upstream side roller) positioned on the upstream side of the print region and the paper discharge roller 25 (downstream side roller) positioned on the downstream side of the print region are rotated in synchronization with one another. Also, during the normal carrying process, the paper S is carried by these two rollers, the carry roller 23 and the paper discharge roller 25. Carrying of the paper S is almost always performed through this normal carrying process. That is, a wide print region is secured for the normal carrying process. For this reason, the correction amount of the target carry amount during the normal carrying process can be determined by printing the test pattern of the reference example.

However, the carrying states before and after the rear end of the paper S passes the carry roller 23 are different. For example, after the rear end of the paper S has passed the carry roller 23, the paper S is carried by only the paper discharge roller 25, and thus this becomes a different state from the state when the paper is carried by both rollers (the state of the normal carrying process). Also, the shape (for example, the radius and the cross-sectional shape) of the carry roller 23 and the paper discharge roller 25 is different. Further, the roller provided in opposition to the paper discharge roller 25 has a different shape from the driven roller on the carry roller 23 side, in order to reduce contact with the print surface. Also, to prevent creases from forming in the paper during the normal carrying process, the carrying velocity of the paper discharge roller 25 is designed to be slightly faster than the carrying velocity of the carry roller 23. Because of these factors, the carrying state after the rear end of the paper S has passed the carry roller 23 is different from the normal carrying process state.

Thus, although the paper S is carried by the same target carry amount, the carry amount of the paper after the rear end of the paper S has passed the carry roller 23 is different from the carry amount of the paper during the normal carrying process. In other words, even though the target carry amount has been corrected based on the correction amount for the normal carrying process, proper carrying will not be carried out (i.e., the paper S will be carried in a state where there is carry error) after the rear end of the paper S has passed the carry roller 23. Consequently, it is necessary to correct the target carry amount in accordance with a correction amount for carrying the rear end of the paper S after the rear end of the paper S has passed the carry roller 23.

Accordingly, it is necessary to print a test pattern in order to determine the correction amount for when carrying the rear end of the paper S. However, the test pattern for determining the correction amount for when carrying the rear end of the paper S must be printed under the same conditions as when carrying the rear end of the paper S. In other words, it is necessary to print this test pattern after the rear end of the paper S has passed the carry roller 23.

However, after the rear end of the paper S has passed the carry roller 23, there is only a narrow region in which the printer can print the paper S.

Figure 20:
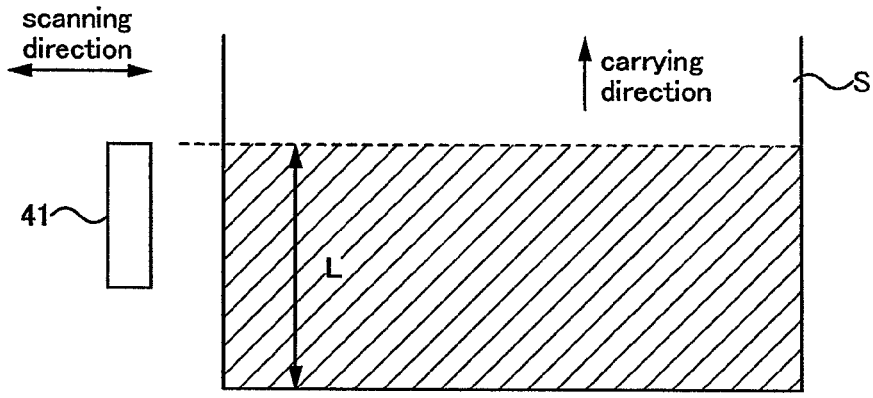
FIG. 20 is an explanatory diagram showing the positional relationship between the paper and the head when the rear end of the paper has passed the carry roller.

FIG. 20 is an explanatory diagram showing the positional relationship between the paper and the head when the rear end of the paper has passed the carry roller 23. In this drawing, structural elements that have already been explained are assigned identical reference numerals and therefore are not described.

The hatched section in the drawing indicates the region that can be printed by the head 41 after the rear end of the paper has passed the carry roller 23. This print region indicated by the hatched section is only secured for the length L in the carrying direction. This length L is determined based on the design positions of the structural elements (particularly the head 41 and the carry roller 23) of the printer. Normally, the head 41 and the carry roller 23 are positioned near one another in order to make the printer 1 compact, and thus the length L is not more than twice the width of the head (the length from the most upstream nozzle #180 to the most downstream nozzle #1). In the present embodiment, the width F of the head 41 is one inch (=2.54 cm), and the length L is approximately 3.5 cm.

Thus, the region that can be printed by the head 41 after the rear end of the paper has passed the carry roller 23 is a narrow region in the carrying direction. Since a print region that is wide in the carrying direction is required in order to print the test pattern described above, it is not possible to print the above test pattern after the rear end of the paper has passed the carry roller 23. If the test pattern of the reference example were to be printed in a print region having the length L in the carrying direction, it would be possible to print only one correction pattern.

Accordingly, in the present embodiment the test pattern is printed as follows.

===(1) Printing the Test Pattern of the Present Embodiment===

<(1) Method for Printing the Test Pattern>

Figure 21:
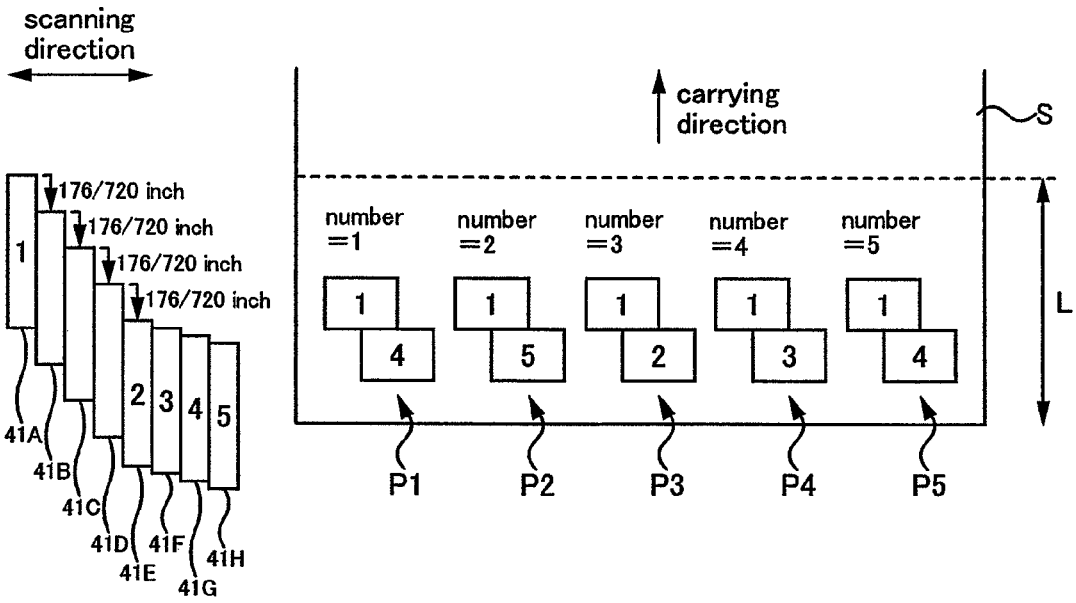
FIG. 21 is an explanatory diagram of the method for printing the test pattern according to the present embodiment.
Figure 22:
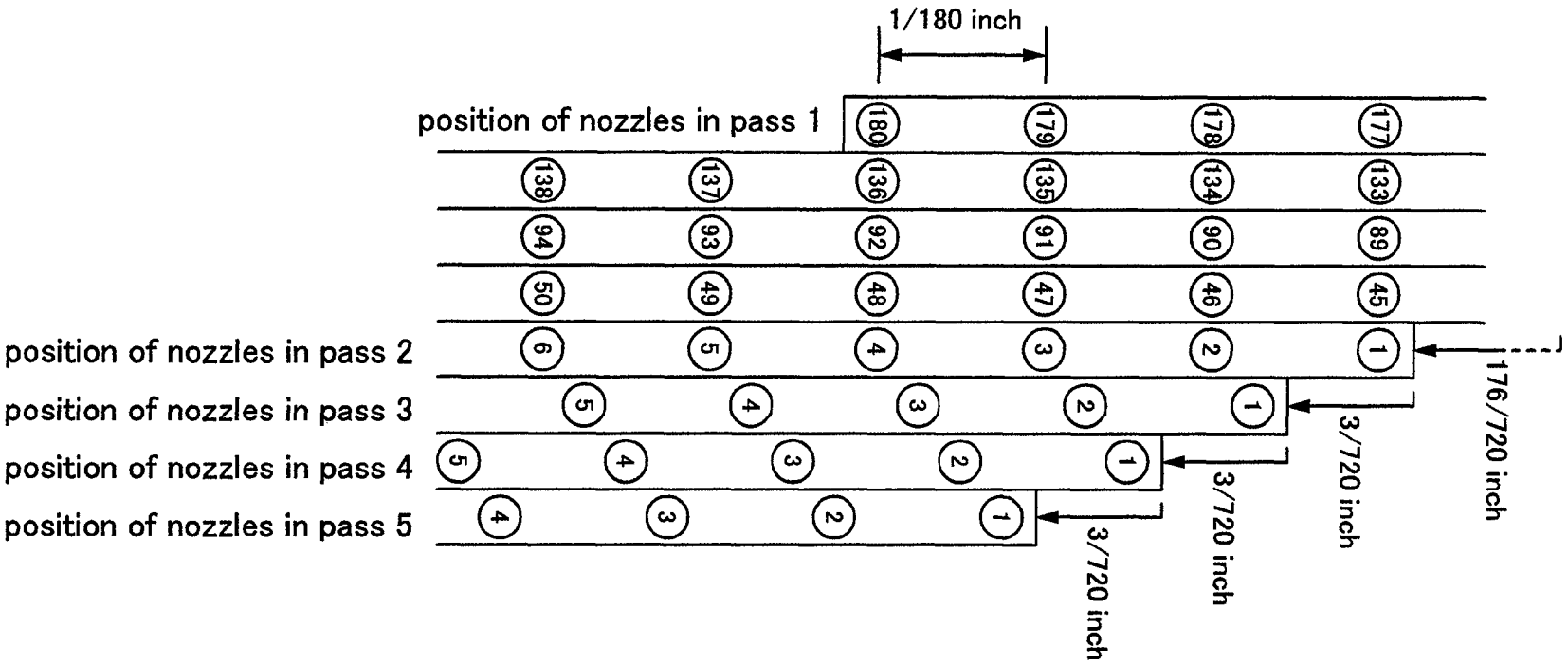
FIG. 22 is an explanatory diagram showing the positional relationship between the nozzles and the paper in the method for printing the test pattern according to the present embodiment.

First, the method for printing the test pattern according to the present embodiment is described using FIG. 21 and FIG. 22. The various operations that are described below are achieved by the controller 60 controlling the various units in accordance with a program stored on the memory 63. This program has codes for performing the various processes.

FIG. 21 is an explanatory diagram of the method for printing the test pattern of the present embodiment. The method for printing the test pattern of the present embodiment that is described below is carried out during S102 described above. It should be noted that the elongate shapes 41A to 41H that are drawn on the left side in the drawing indicate the positions of the head 41 with respect to the paper S, and are not printed on the paper S. Also, the numbers within the elongate shapes representing the head 41 indicate the number of the pass (a pass refers to the dot formation process of S003) of the relative position of the head. However, in this embodiment, the first dot formation process after the rear end of the paper S has passed the carry roller is referred to as the "first pass." For example, the head 41C in the drawing indicates the relative position of the head 41 in the third pass after the rear end of the paper S has passed the carry roller. Here, if a number is not written in the elongate shape, then this means that when the head 41 is positioned at the position of that elongate shape, the dot formation process is not performed. In this drawing it appears as if the head 41 is moving with respect to the paper S, but this drawing only shows the relative position between the head 41 and the paper S, and in practice, the relative positions of both are moving due to the paper S being carried in the carrying direction.

In this embodiment, the test pattern that is printed on the paper has five correction patterns. Each correction pattern is made of two band-shaped patterns (band patterns), namely a first band pattern and a second band pattern. Here, the band pattern on the front end side of the paper S (upper side in the drawing) is referred to as the first band pattern, and the band pattern on the rear end side of the paper S (lower side in the drawing) is referred to as the second band pattern. The first band pattern and the second band pattern are formed adjacent to one another in the carrying direction, and a boundary section is formed due to these two band patterns. Also, the two band patterns are formed shifted in the scanning direction such that the position of the boundary section formed by the two band patterns is clear. It should be noted that the numbers within the elongate shapes representing the band patterns in the figure indicate the number of the pass in which that pattern is formed. As will be become clear from the subsequent description, in the present embodiment the first band pattern is the pre-carry pattern that is formed before carrying by the carry unit, and the second band pattern is the post-carry pattern that is formed after carrying by the carry unit.

FIG. 22 is an explanatory diagram of the positional relationship between the nozzles and the paper in the method for printing the test pattern of the present embodiment. This drawing shows the relative positions between the head 41 and the paper S, and in practice the relative positions of both are moved due to the paper S being carried in the carrying direction. In this embodiment, the head 41 has a plurality of nozzle rows that correspond to the type of ink to be ejected, and each nozzle row has 180 nozzles in the carrying direction. However, for the sake of simplifying the description, here the relative position between a single nozzle row and the paper S is described. The nozzles of the nozzle row are arranged in a line at a spacing of 180 dpi (=1/180 inch) in the carrying direction. The numbers within the circles in the drawing indicate the number of the nozzle. For example, the circle including "180" in the drawing indicates the position of nozzle # 180.

The order in which the test pattern is printed is described next using FIG. 21 and FIG. 22.

When the rear end of the paper S has passed the carry roller, the head 41 is in the position of head 41A in the drawing with respect to the paper S. Then, the controller 60 moves the carriage 31 in the scanning direction and causes the ejection of ink from the head 41, thereby executing the first dot formation process (pass 1). At this time, the head 41 forms five first band patterns using nozzles on the upstream side (nozzle #180 side) in the carrying direction. Because the five first band patterns are formed in a single pass, the positions of these first band patterns in the carrying direction are the same. It should be noted that in pass 1, the head 41 also forms the numbers associated with the correction patterns (for example, "Number=1") on the paper S using the nozzles on the downstream side (nozzle #1 side) in the carrying direction.

Next, the controller 60 causes the carry unit 20 to intermittently carry the paper four times by a target carry amount of approximately ¼ inch (in the present embodiment, 176/720 inch). The target carry amount at this time is substantially equal to the target carry amount when printing in accordance with the intended use of the printer (printing that is carried out by the user after the test pattern has been printed). If the target carry amount when printing in accordance with the intended use of the printer is ⅛ inch, for example, then the paper is intermittently carried eight times by a target carry amount of approximately 1/8 inch (for example, 176/1440 inch) after pass 1.

It should be noted that during the intermittent carrying mentioned above, in practice, the paper S is carried in a state that includes carry error. Thus, after intermittent carrying, the paper S is in a state where it has accumulated four carries worth of carry error. The test pattern of the present embodiment is for finding the most suitable correction amount for the carry error that has accumulated during the intermittent carrying (the carrying that is carried out from pass 1 until pass 2).

After the intermittent carrying, the head 41 is in the position of head 41E in the drawing with respect to the paper S. The controller 60 then moves the carriage 31 in the scanning direction and causes the ejection of ink from the head 41, thereby executing the second dot formation process (pass 2). At this time, the head 41 forms the second band pattern of the correction pattern P3 denoted by "Number=3" (the correction pattern in the middle among the five correction patterns) using nozzle #5 and a nozzle upstream in the carrying direction of nozzle #5 (such as nozzle #6). Thus, the correction pattern P3 denoted by "Number=3" is completed.

The controller 60 then causes the carry unit 20 to carry the paper S by a target carry amount of 3/720 inch. However, carry error does not occur when the carry unit 20 carries the paper because the amount by which the paper is carried at this time is small. That is, the paper is carried at a carry amount of 3/720 inch, which is the same as the target carry amount. As a result, the head 41 is in the position of head 41F in the drawing with respect to the paper S. The controller 60 then moves the carriage 31 in the scanning direction and causes the ejection of ink from the head 41, thereby executing the third dot formation process (pass 3). At this time, the head 41 forms the second band pattern of the correction pattern P4 denoted by "Number=4" (the correction pattern second from the right among the five correction patterns) using nozzle #4 and a nozzle upstream in the carrying direction of nozzle #4 (such as nozzle #5). Thus, the correction pattern P4 denoted by "Number=4" is completed.

Next, the controller 60 causes the carry unit 20 to carry the paper S by a target carry amount of 3/720 inch. However, carry error does not occur when the carry unit 20 carries the paper because the amount by which the paper is carried at this time is small. That is, the paper is carried at a carry amount of 3/720 inch, which is the same as the target carry amount. As a result, the head 41 is in the position of head 41G in the drawing with respect to the paper S. The controller 60 then moves the carriage 31 in the scanning direction and causes the ejection of ink from the head 41, thereby executing the fourth dot formation process (pass 4). First, the head 41 forms the second band pattern of the correction pattern P1 denoted by "Number=1" (the correction pattern furthest left among the five correction patterns) using nozzle #4 and a nozzle upstream in the carrying direction of nozzle #4 (such as nozzle #5). Thus, the correction pattern P1 denoted by "Number=1" is completed. Also, the head 41 forms the second band pattern of the correction pattern P5 denoted by "Number=5" (the correction pattern furthest right among the five correction patterns) using nozzle #3 and a nozzle upstream in the carrying direction of nozzle #3 (such as nozzle #4). Thus, the correction pattern P5 denoted by "Number=5" is completed. That is, in the dot formation process of pass 4, the controller 60 causes the head 41 to form the second band pattern of two correction patterns at different positions with respect to the carrying direction using different nozzles for ejecting ink.

Next, the controller 60 causes the carry unit 20 to carry the paper S by a target carry amount of 3/720 inch. However, carry error does not occur when the carry unit 20 carries the paper because the amount by which the paper is carried at this time is small. That is, the paper is carried at a carry amount of 3/720 inch, which is the same as the target carry amount. As a result, the head 41 is in the position of head 41H in the drawing with respect to the paper S. The controller 60 then moves the carriage 31 in the scanning direction and causes the ejection of ink from the head 41, thereby executing the fifth dot formation process (pass 5). At this time, the head 41 forms the second band pattern of the correction pattern P4 denoted by "Number=2" (the correction pattern second from the left among the five correction patterns) using nozzle #3 and a nozzle upstream in the carrying direction of nozzle #3 (such as nozzle #4). Thus, the correction pattern P2 denoted by "Number=2" is completed.

The test pattern that is formed in this manner is a pattern in which, as described below, the plurality of correction patterns are arranged in the order of the correction amount.

<Regarding the Correction Amount Corresponding to the Correction Patterns>

Figure 23:
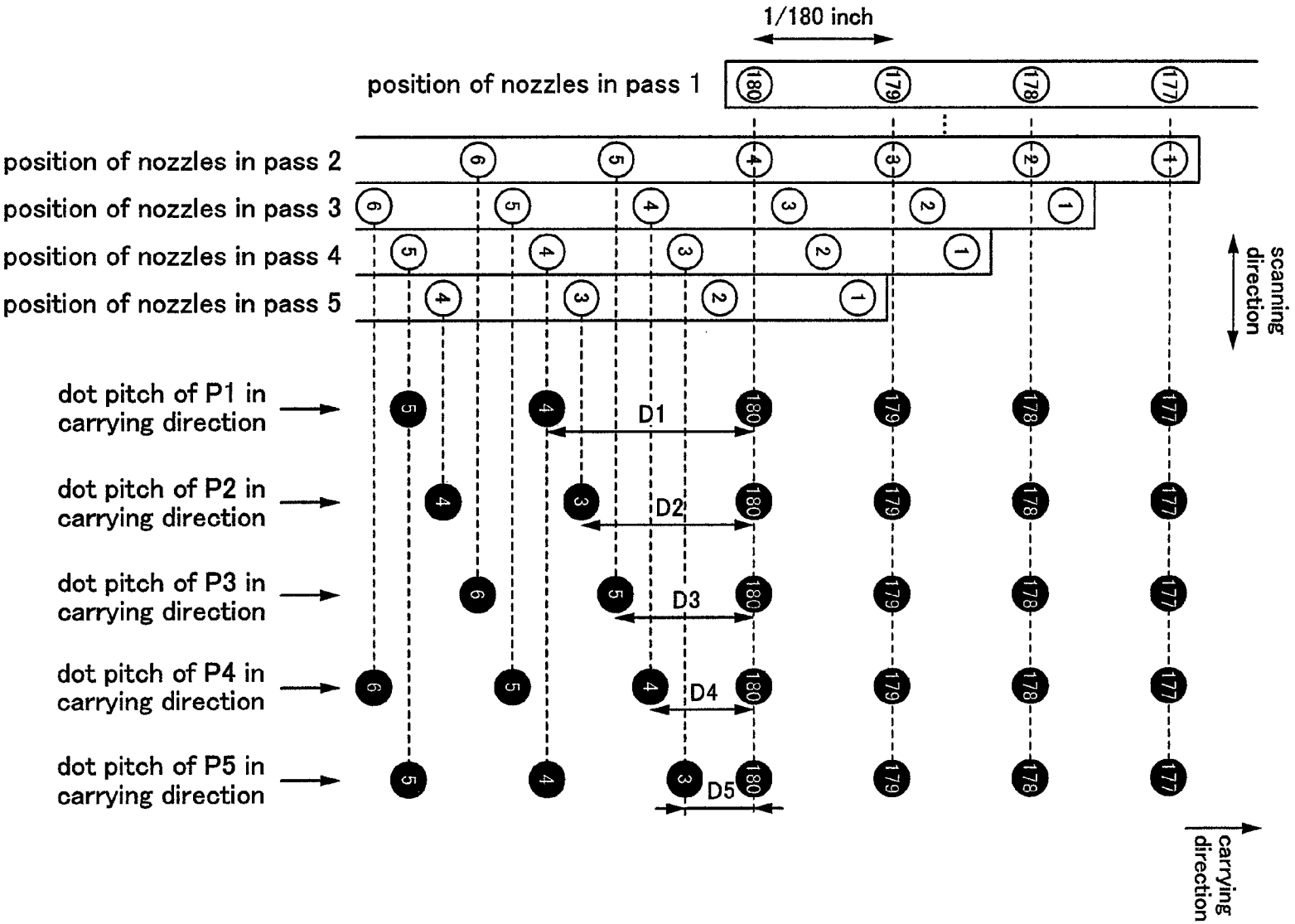
FIG. 23 is an explanatory diagram of the area between the first and second band patterns when there is no carry error.

FIG. 23 is an explanatory diagram of the dot spacing at the boundary between the first band pattern and the second band pattern of each of the correction patterns if there is no carry error. The relative positions of the head in each pass is shown on the left side of the drawing. The black circles on the right side of the drawing indicate the dots making up the correction patterns. Only a single row of dots in the carrying direction is shown for each correction pattern on the right side of the drawing, but in practice, there are numerous such dot rows lined up in the scanning direction, forming correction patterns having the shape shown in FIG. 15 and FIG. 21 (discussed later). It should be noted that the numbers within the black circles on the right side of the drawing indicate the number of the nozzle that forms that dot.

If there is no carry error, then the spacing D3 between the most upstream dot of the dots making up the first band pattern (the dot formed by the nozzle #180 in pass 1) and the most downstream dot of the dots making up the second band pattern (the dot formed by the nozzle #5 in pass 2) of the correction pattern P3 is equal to the nozzle pitch (=1/180 inch). For that reason, a striped pattern does not occur at the boundary section between the first band pattern and the second band pattern of the correction pattern P3.

On the other hand, if there is no carry error, then the spacing D2 between the most upstream dot of the dots making up the first band pattern (the dot formed by the nozzle #180 in pass 1) and the most downstream dot of the dots making up the second band pattern (the dot formed by the nozzle #3 in pass 5) of the correction pattern 2 becomes wider than the nozzle pitch (=1/180 inch) by 1/720 inch. For that reason, a white stripe pattern occurs at the boundary section between the first band pattern and the second band pattern of the correction pattern P2. Similarly, the spacing D1 of the correction pattern P1 becomes wider than the nozzle pitch by 2/720 inch. For that reason, a thick white stripe pattern occurs at the boundary section of the correction pattern P1.

Also, if there is no carry error, then the spacing D4 between the most upstream dot of the dots making up the first band pattern (the dot formed by the nozzle #180 in pass 1) and the most downstream dot of the dots making up the second band pattern (the dot formed by the nozzle #4 in pass 3) of the correction pattern 4 is narrower than the nozzle pitch (=1/180 inch) by 1/720 inch. For that reason, a black stripe pattern occurs at the boundary section between the first band pattern and the second band pattern of the correction pattern P4. Similarly, the spacing D5 of the correction pattern P5 is narrower than the nozzle pitch by 2/720 inch. For that reason, a thick black stripe pattern occurs at the boundary section of the correction pattern P5.

In this manner, the spacing between the first band pattern and the second band pattern of each correction pattern changes by 1/720 inch increments. As long as there is no carry error during the four intermittent carries from pass 1 to pass 2, a striped pattern does not occur in the correction pattern P3 denoted by "Number=3," and thus this correction pattern is selected as the most suitable pattern (see S103).

Figure 24:
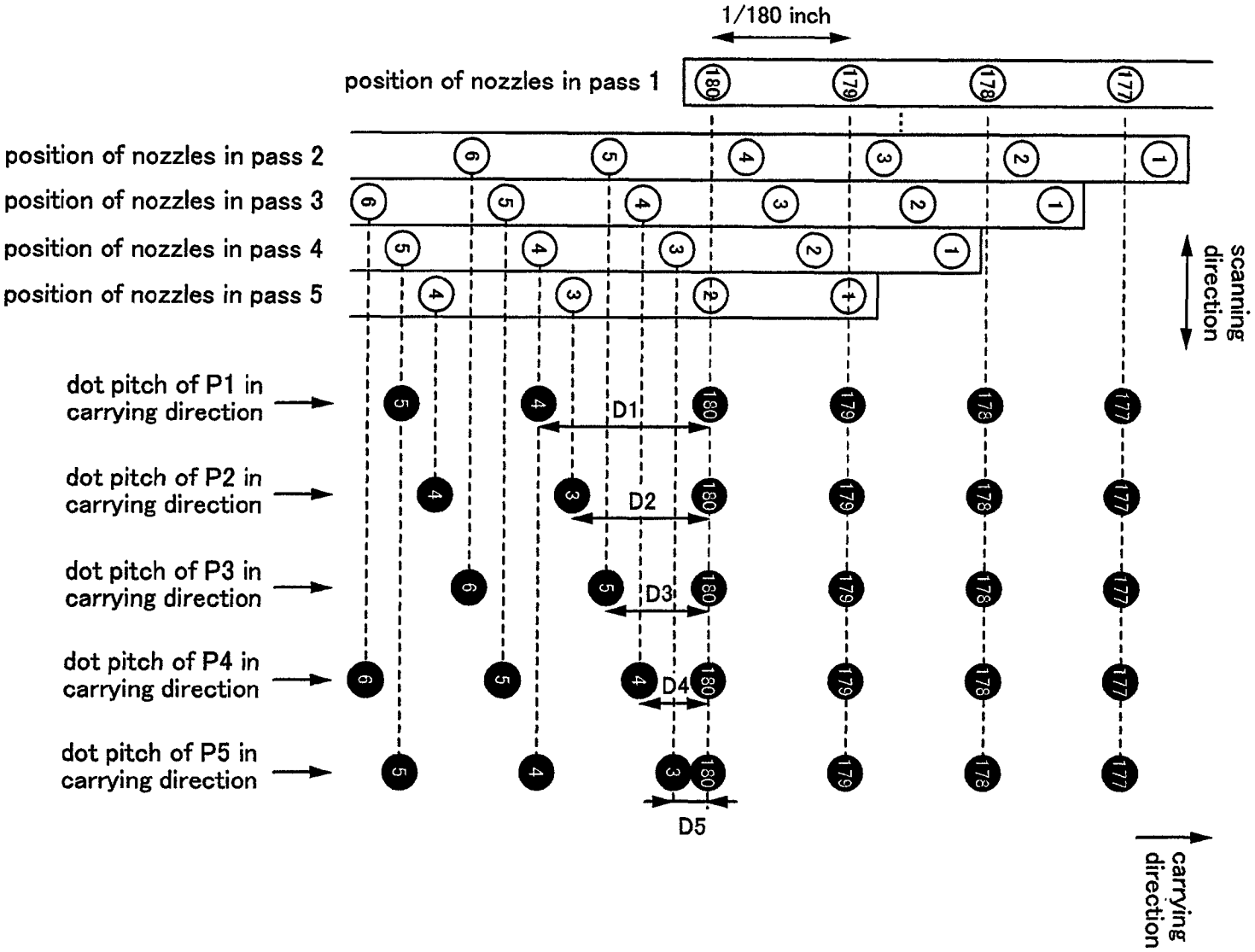
FIG. 24 is an explanatory diagram of the area between the first and second band patterns when there is carry error.

FIG. 24 is an explanatory diagram of the dot spacing at the boundary between the first band pattern and the second band pattern of the correction patterns if a "carry error of −1/720 inch" occurs during the four intermittent carries. Here, a "carry error of —1/720 inch" means that the actual carry amount when the paper is carried based on the target correction amount is 1/720 inch less than the target carry amount. Because a "carry error of −1/720 inch" occurs during the four intermittent carries, the relative positions of the nozzles in pass 2 and thereafter are shifted by 1/720 inch compared to the positions of the nozzles in FIG. 23.

If a "carry error of −1/720 inch" has occurred during the four intermittent carries, then the spacing D2 between the most upstream dot of the dots making up the first band pattern (the dot formed by the nozzle #180 in pass 1) and the most downstream dot of the dots making up the second band pattern (the dot formed by the nozzle #3 in pass 5) of the correction pattern P2 is equal to the nozzle pitch (=1/180 inch). For that reason, a striped pattern does not occur at the boundary section between the first band pattern and the second band pattern of the correction pattern P2. In other words, if a "carry error of —1/720 inch" has occurred during the four intermittent carries, then the correction pattern P2 denoted by "Number=2" is selected as the most suitable pattern (see S103).

Put differently, if the correction pattern P2 is the most suitable pattern, then it is detected that the carry error that occurs during the four intermittent carries is "−1/720 inch." As a result, if the correction pattern P2 is the most suitable pattern, then it is detected that a carry error of "−1/2880 inch" occurs in each carry (carrying by a target carry amount of approximately ¼ inch).

For that reason, in a case where the correction pattern P2 is selected as the most suitable pattern, a correction amount 2 C (=2/5760 inch) is added to the target carry amount of approximately ¼ inch, and if the paper S is carried based on this corrected target carry amount (i.e., if the counter of S041 is set based on the corrected target carry amount), then the actual carry amount of the paper becomes the target carry amount. That is, the correction pattern P2 corresponds to the correction amount 2 C.

Similarly, the correction pattern P1 corresponds to a correction amount 4 C, the correction pattern P3 corresponds to a correction amount of 0, the correction pattern P4 corresponds to a correction amount −2 C, and the correction pattern P5 corresponds to a correction amount −4 C.

According to the present embodiment, the five first band patterns of the five correction patterns are formed at the same position with respect to the carrying direction in a single dot formation process. Further, the five second band patterns of the five correction patterns are formed at different positions with respect to the carrying direction. Thus, correction patterns each with a different spacing between the first band pattern and the second band pattern are formed in the scanning direction. In the test pattern of the reference example, the correction patterns are arranged in the carrying direction, and thus a wide print region is required. On the other hand, with the test pattern of the present embodiment, the correction patterns are arranged in the scanning direction, and thus many correction patterns can be formed in a narrow print region whose length in the carrying direction is L.

Also, according to the present embodiment, after the second band pattern of one correction pattern (for example, the correction pattern P3 denoted by "Number=3") has been formed, the paper is carried by 3/720 inch by the carrying unit and the second band pattern of another correction pattern (for example, the correction pattern P4 denoted by "Number=4") is formed. Thus, the carry amount by which carrying is performed between the formation of the first pattern and the formation of the second pattern of one correction pattern is different from the carry amount by which carrying is performed between the formation of the first pattern and the formation of the second pattern of another correction pattern. Thus, the spacing between the first band pattern and the second band pattern becomes different for each correction pattern. In other words, the correction amounts corresponding to the correction patterns become different from one another. Further, with the present embodiment, many correction patterns each corresponding to different correction amounts can be formed in a narrow print region.

Also, according to the present embodiment, the nozzle that forms the second band pattern of the correction pattern P1 denoted by "Number=1" (a nozzle upstream of nozzle #4) and the nozzle that forms the second band pattern of the correction pattern P5 denoted by "Nozzle=5" (a nozzle upstream of nozzle #3) are different. Because the positions in the carrying direction of the nozzles used when forming the correction patterns are different, the positions in the carrying direction of the second patterns that are formed are different. Thus, in a single pass it is possible to form the second patterns at different positions in the carrying direction. Also, according to the present embodiment, for example the nozzle that forms the second band pattern of the correction pattern P3 denoted by "Number=3" (a nozzle upstream of nozzle #5) and the nozzle that forms the second band pattern of the correction pattern P4 denoted by "Nozzle=4" (a nozzle upstream of nozzle #4) are different. Due to the nozzles that are used being different and the additional carrying by 3/720 inch, it is possible to set the spacing between the first band pattern and the second band pattern of the correction patterns to 1/720 inch. The carry unit carries the paper using a motor and gears, for example, and thus it is difficult to accurately carry the paper by a short carry amount (such as 1/720 inch). However, in the present embodiment, the nozzles that are used are different and there is additional carrying of the paper, and therefore, correction patterns each with a spacing 1/720 inch different from the next can be formed in sequence.

Also, according to the present embodiment, the 180 nozzles lined up in the carrying direction are moved in the scanning direction. Thus, by a plurality of nozzles intermittently ejecting ink while moving, it is possible to form, on the paper, band patterns made of dots arranged in rows in the carrying direction and the scanning direction.

Also, according to the present embodiment, L (approximately 3.5 cm) is the length in the carrying direction of the print region in which the five correction patterns are formed, and this length L is shorter than twice the width of the head (the length from the most upstream nozzle #180 to the most downstream nozzle #1, that is, one inch (=2.54 cm)). In the test pattern of the reference example, the correction patterns are arranged in the carrying direction, and thus it was possible to form only a single correction pattern in a print region whose length is L in the carrying direction. However, the test pattern is for selecting the most suitable pattern from among a plurality of correction patterns, and thus it is necessary to form a plurality of correction patterns in the test pattern. With the present embodiment, it is possible to form many correction patterns in a narrow print region such as this.

Also, according to the present embodiment, the carry unit has an upstream side roller (carry roller) positioned on the upstream side of the print region (region in opposition to the head 31) and a downstream side roller (paper discharge roller) positioned on the downstream side of the print region. Also, in the present embodiment, correction patterns are formed on the paper when the paper is carried only by the downstream side roller (when the rear end of the paper has passed the carry roller). The carrying state in which two rollers are employed and the carrying state in which a single roller is employed are different carrying states. Thus, there is a possibility that the image quality will drop when the correction amount corresponding to the carrying state in which two rollers are employed is adopted for the correction amount corresponding to the carrying state in which a single roller is employed. On the other hand, the print region of the carrying state in which a single roller is employed is narrow. According to the present embodiment, it is possible to form many correction patterns in the narrow print region of the state in which the medium is carried by a single roller.

Also, in the present embodiment, the correction amount corresponding to the normal carrying process state (the carrying state in which two rollers (the upstream side roller and the downstream side roller) are employed) is different from the carry amount corresponding to the carrying state in which only the downstream side roller is employed (the carrying state when the rear end of the paper has passed the carry roller). This is because there is a possibility that the image quality will drop when the correction amount corresponding to the carrying state in which two rollers are employed is adopted as the correction amount corresponding to the carrying state in which a single roller is employed. In the present embodiment, the memory 63 stores not only the information on the correction amount corresponding to the normal carrying process state but also information corresponding to the correction amount that is adopted after the rear end of the paper has passed the carry roller. The rear end of the paper passes the carry roller if the paper is carried by a predetermined carry amount after the paper detection sensor 53 has detected the rear end of the paper, and thus when correcting the target carry amount after the rear end of the paper has passed the carry roller, the controller 60 switches the correction amount from the correction amount corresponding to the normal carrying process state to the correction amount corresponding to the carrying state in which only the paper discharge roller is employed.

Also, in the present embodiment, the first band pattern of one correction pattern (such as the correction pattern P3 denoted by "Number=3") is formed away from the first band pattern of another correction pattern (such as the correction pattern P4 denoted by "Number=4") in the scanning direction. This allows the plurality of correction patterns to be visually recognized separately. This is therefore convenient when the user is selecting the most suitable correction pattern from among the plurality of correction patterns.

Also, in the present embodiment, the carrying unit performs carrying four times between formation of the first band pattern and formation of the second band pattern of, for example, the correction pattern P3 denoted by "Number=3." Thus, the spacing between the first band pattern and the second band pattern reflects the carry error that accumulates during the four carries (four times the carry error of a single carry). That is, if the most suitable correction pattern is selected from among the plurality of correction patterns, then it is possible to detect the accumulated carry error.

Also, according to the present embodiment, notation such as "Number=1" is attached to the correction patterns in order to identify each correction pattern. As a result, this is convenient when the user is selecting the most suitable correction pattern from among the plurality of correction patterns. Since the numbers corresponding to the correction patterns are displayed on the display device connected to the computer when the test pattern for correcting the carry amount is printed, the user can select the most suitable pattern by correlating the numbers added to the test pattern and the numbers displayed on the display device.

Also, according to the present embodiment, notation such as "Number=1" for identifying the correction patterns is formed when the first band patterns are formed. For example, when a nozzle on the upstream side in the carrying direction forms the first band pattern of the correction pattern P1, the nozzles on the downstream side in the carrying direction form "Number=1." Thus, many correction patterns as well as notation for identifying the correction patterns can be formed in the narrow print region.

Also, according to the present embodiment, notation such as "Number=1" for identifying the correction patterns is formed adjacent in the carrying direction to the correction patterns. When a reference number such as "Number=1" is adjacent in the scanning direction to the correction pattern as in the test pattern of the reference example, the distance between correction patterns widens even if the correction patterns are arranged lined up in the scanning direction, and thus numerous correction patterns cannot be arranged lined up in the scanning direction. On the other hand, with the present embodiment, the spacing between the plurality of correction patterns can be shortened, allowing a large number of correction patterns to be formed in a narrow print region.

===(1) Configuration of the Band Patterns===

The band patterns (first band pattern and second band pattern) of the correction patterns are made of innumerable dots arranged in the carrying and scanning directions. The dots constituting the band patterns are described next.

FIGS. 25A to 25D are examples of the dots making up the band patterns. As shown in the drawings, the band patterns are arranged in rows in the carrying direction and the scanning direction. The dot pitch in the carrying direction is equal to the nozzle pitch, and is 1/180 inch. However, the dot pitch in the scanning direction can be 1/180 inch or can be another pitch.

In the band pattern of FIG. 25A, adjacent dots are not in contact with one another. In the band pattern of FIG. 25B, adjacent dots are in contact with one another. Thus, in the band patterns of the test pattern described above, it is both possible for adjacent dots to be in contact or not to be in contact with one another.

The band pattern of FIG. 25C is made of dots of different sizes (large dots, medium dots, and small dots). In the band patterns of the test pattern described above, it is possible to mix dots of different sizes in this manner. It is possible to form band patterns with an overall uniform darkness even if dots of different sizes are mixed. The influence of the degree at which the ink dries or at which the ink bleeds can lead to the most suitable correction pattern of a test pattern made exclusively of large dots and the most suitable correction pattern of a test pattern made exclusively of small dots being different. Therefore, if the most suitable correction pattern is selected using a test pattern made of dots of different sizes then it is possible to specify an average correction amount.

The band pattern of FIG. 25D is made of dots of different colors (black, cyan, magenta, and yellow). The letter "K" in the drawing indicates black dots made of black ink. The letter "C" in the drawing indicates cyan dots made of cyan ink. The letter "M" in the drawing indicates magenta dots made of magenta ink. The letter "Y" in the drawing indicates yellow dots made of yellow ink. The effects of assembly error and dimension tolerance, for example, of the nozzle rows for each color can lead to the most suitable correction patterns made of dots of the respective colors being different. Therefore, if the most suitable correction pattern is selected using a test pattern that is made of different color dots then it is possible to specify an average correction amount.

The band patterns of the test pattern discussed above can be any of the foregoing band patterns. They can also be band patterns combining the concepts of the foregoing band patterns.

===(1) Other Implementations of the First Embodiment===

Other implementations of the first embodiment are described below. However, description of aspects that are the same as the embodiment discussed above are omitted for the sake of simplifying the description.

Figure 26:
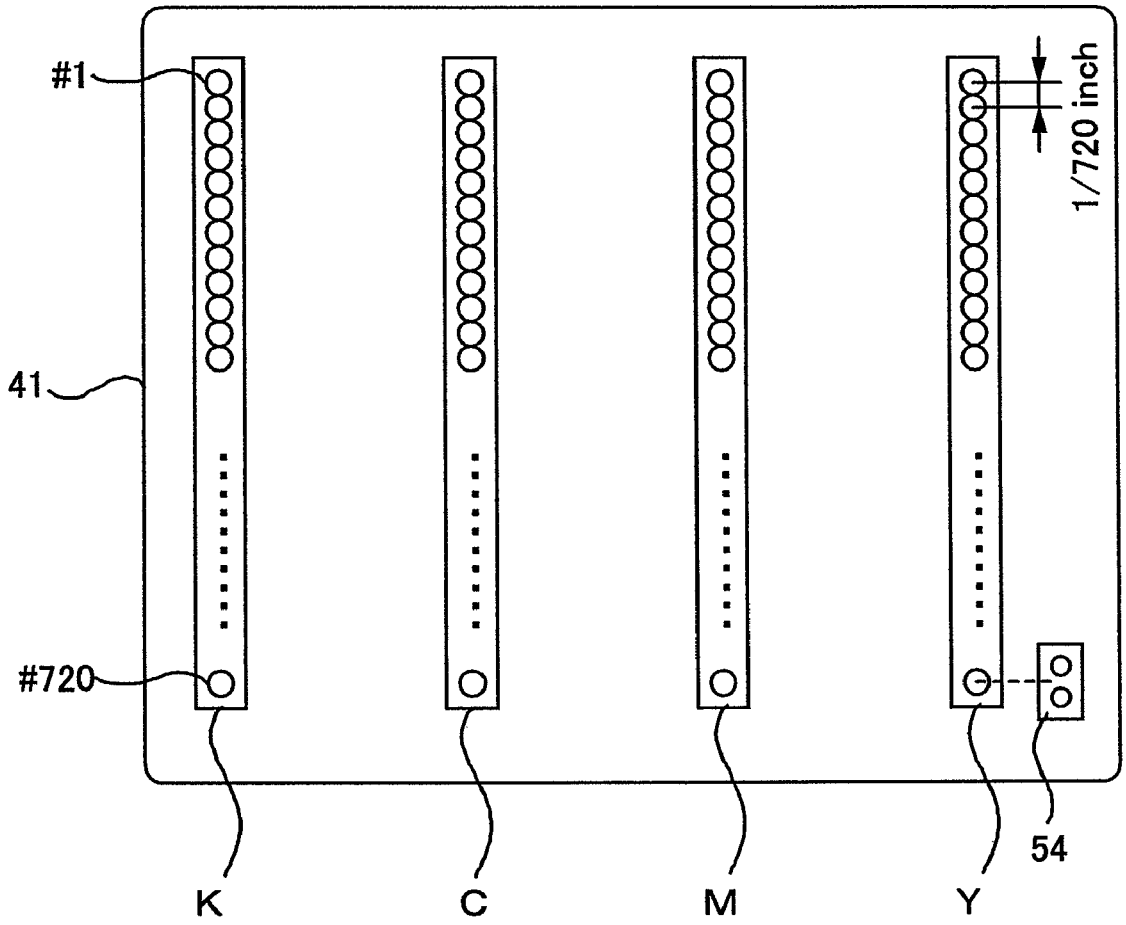
FIG. 26 is an explanatory diagram showing the arrangement of the nozzles according to a separate implementation of the first embodiment.

FIG. 26 is an explanatory diagram showing the arrangement of the nozzles according to a separate implementation of the first embodiment. A black ink nozzle row K, a cyan ink nozzle row C, a magenta ink nozzle row M, and a yellow ink nozzle row Y are formed in the lower surface of the head 41. Each nozzle row is provided with a plurality of nozzles (in this embodiment, 720), which are ejection openings for ejecting the inks of the respective colors. Also, in this embodiment, the nozzle pitch is different from that of the foregoing embodiment. In the present embodiment, the nozzle pitch is 720 dpi (1/720 inch).

Figure 27:
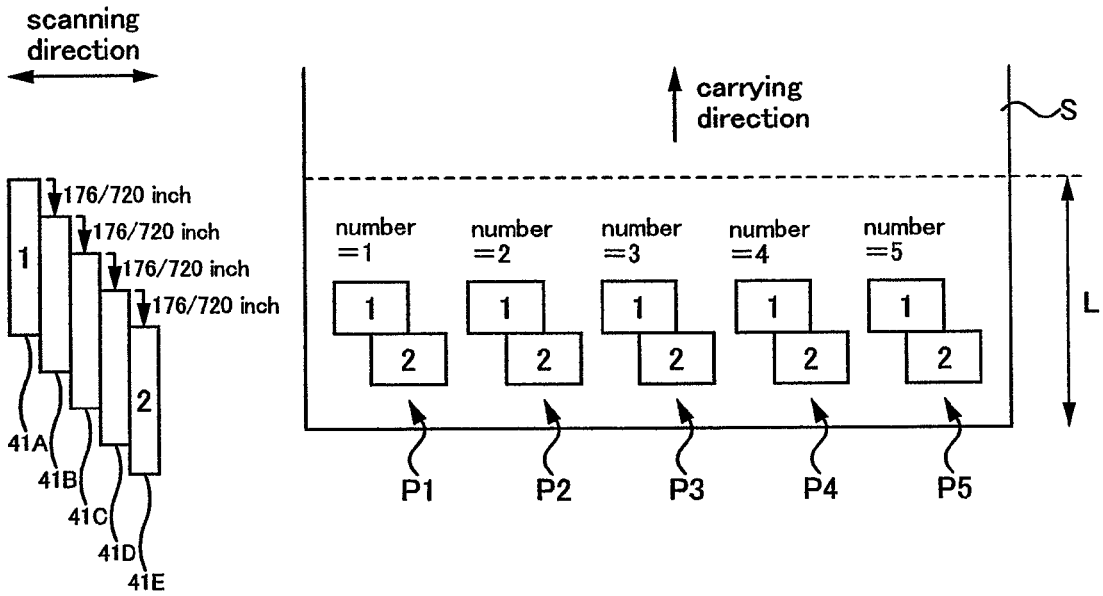
FIG. 27 is an explanatory diagram of the method for printing a test pattern according to a separate implementation of the first embodiment.
Figure 28:
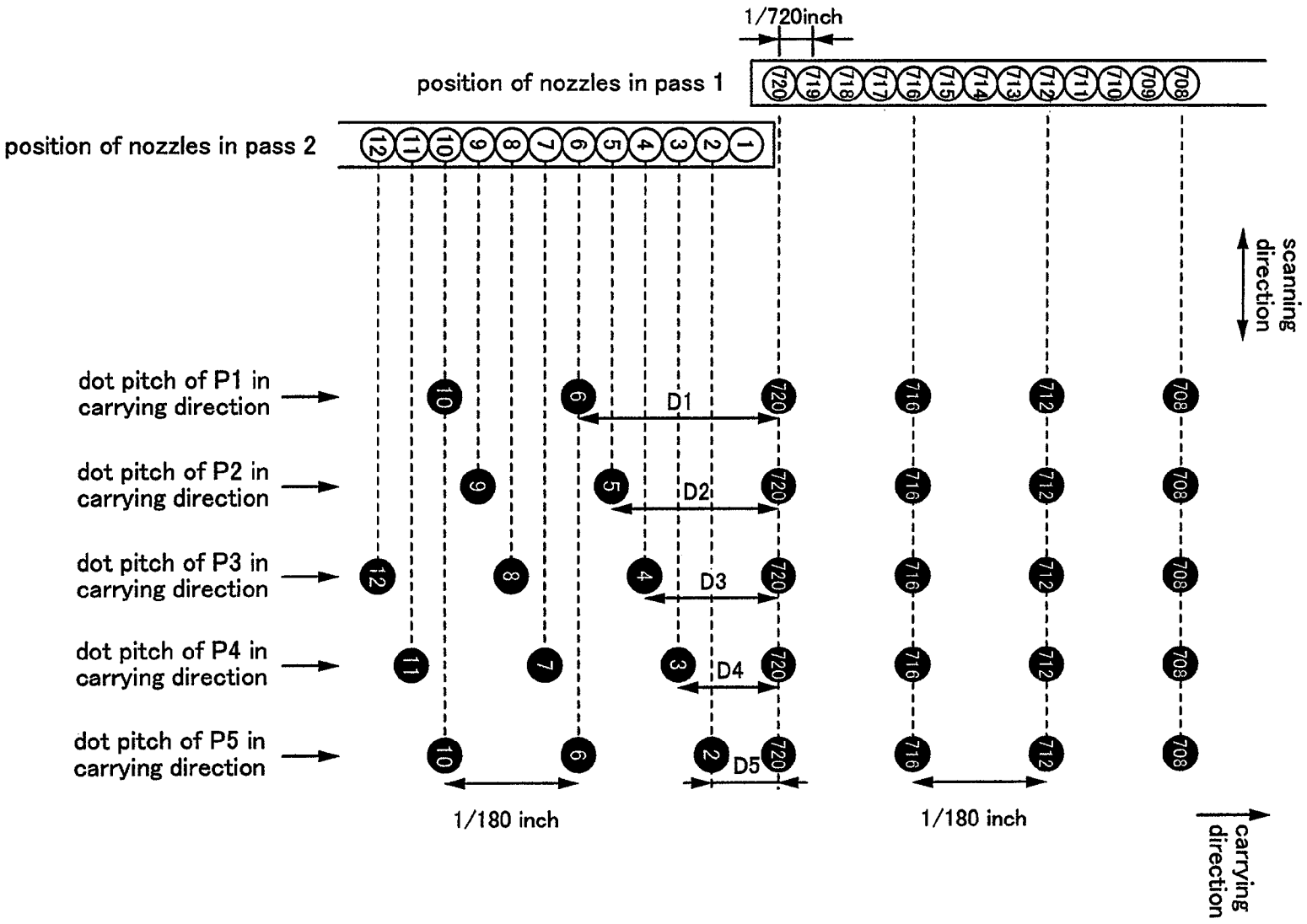
FIG. 28 is an explanatory diagram showing the positional relationship between the nozzles and the paper in the method for printing the test pattern according to a separate implementation of the first embodiment.

The method for forming the test pattern of the present embodiment is described next using FIG. 27 and FIG. 28. The various operations that are described below are achieved by the controller 60 controlling the various units in accordance with a program stored on the memory 63. This program has codes for executing the various processes.

When the rear end of the paper S has passed the carry roller, the head 41 is in the position of head 41A in the drawing with respect to the paper S. Then, the controller 60 moves the carriage 31 in the scanning direction and causes the ejection of ink from the head 41, thereby executing the first dot formation process (pass 1). At this time, the head 41 forms five first band patterns using nozzles on the upstream side (nozzle #180 side) in the carrying direction. However, the nozzles used for forming the first band patterns are nozzles whose numbers increase in increments of four. Thus, the spacing between the dots in the carrying direction of the dots making up the first band patterns is 1/180 inch. Also, the nozzles used to form the five first band patterns are the same. Thus, the first band patterns have the same position with respect to the carrying direction.

Next, the controller 60 causes the carry unit 20 to intermittently carry the paper four times by a target carry amount of 1/4 inch (in the present embodiment, 180/720 inch). The target carry amount at this time is substantially equal to the target carry amount when printing in accordance with the intended use of the printer (printing that is carried out by the user after the test pattern has been printed). If the target carry amount when printing in accordance with the intended use of the printer is one inch, then the paper is intermittently carried one time by a target carry amount of one inch after pass 1.

It should be noted that during the intermittent carrying mentioned above (the carrying performed from pass 1 until pass 2), in practice, the paper S is carried in a state that includes carry error. Thus, after intermittent carrying the paper S is in a state where it has accumulated four carries worth of carry error. The test pattern of the present embodiment is for finding the most suitable correction amount for the carry error that has accumulated during the intermittent carrying (the carrying that is performed from pass 1 until pass 2).

After the intermittent carrying, the head 41 is in the position of head 41E in the drawing with respect to the paper S. The controller 60 then moves the carriage 31 in the scanning direction and causes the ejection of ink from the head 41, thereby executing the second dot formation process (pass 2).

Here, in the present embodiment the controller 60 causes the head 41 to use different nozzles for ejecting ink in order to form the second band patterns of the plurality of correction patterns at different locations in the carrying direction. This aspect is described in greater detail below. It should be noted that in the following description the head 41 moves from left to right in the drawing.

First, the head 41 uses nozzle #6 and nozzles #4N+2 (for example, nozzle #10 etc.; here, N is an integer) upstream of nozzle #6 to form the second band pattern of the correction pattern P1 denoted by "Number=1." Thus, the correction pattern P1 denoted by "Number=1" is completed.

Next, while the second dot formation process (pass 2) is being executed, the head 41 uses nozzle #5 and nozzles #4N+1 (for example, nozzle #9 etc.) upstream of nozzle #5 to form the second band pattern of the correction pattern P2 denoted by "Number=2." Thus, the correction pattern P2 denoted by "Number=2" is completed.

Moreover, while the second dot formation process (pass 2) is being executed, the head 41 uses nozzle #4 and nozzles #4N (for example, nozzle #8 etc.) upstream of nozzle #4 to form the second band pattern of the correction pattern P3 denoted by "Number=3." Thus, the correction pattern P3 denoted by "Number=3" is completed.

Also, while the second dot formation process (pass 2) is being executed, the head 41 uses nozzle #3 and nozzles #4N−1 (for example, nozzle #7 etc.) upstream of nozzle #3 to form the second band pattern of the correction pattern P4 denoted by "Number=4." Thus, the correction pattern P4 denoted by "Number=4" is completed.

Lastly, while the second dot formation process (pass 2) is being executed, the head 41 uses nozzle #2 and nozzles #4N−2 (for example, nozzle #6 etc.) upstream of nozzle #2 to form the second band pattern of the correction pattern P5 denoted by "Number=5." Thus, the correction pattern P5 denoted by "Number=5" is completed.

The test pattern formed in this manner, as described below, is a test pattern in which a plurality of correction patterns are arranged in the order of the correction amount.

The nozzles forming the second band pattern of the correction pattern P1 denoted by "Number=1" (nozzles #6, 10, 14, etc.) are positioned more upstream by an amount of one nozzle than the nozzles forming the second band pattern of the correction pattern P2 denoted by "Number=2" (nozzles #5, 9, 13, etc.). On the other hand, the nozzle pitch is 1/720 inch. Thus, the second band pattern of the correction pattern P1 denoted by "Number=1" is formed upstream of the second band pattern of the correction pattern P2 denoted by "Number=2" by 1/720 inch. As a result, the spacing D1 of the correction pattern P1 is 1/720 inch wider than the spacing D2 of the correction pattern P2.

In this manner, the spacing between the first band pattern and the second band pattern of the correction patterns changes in 1/720 inch increments. As long as there is no carry error during the four intermittent carries from pass 1 to pass 2, the spacing D3 of the correction pattern P3 denoted by "Number=3" is 1/180 inch and thus a striped pattern does not occur in the correction pattern P3 denoted by "Number=3". Therefore the correction pattern P3 is selected as the most suitable pattern (see S103).

If a "carry error of −1/720 inch" occurs during the four intermittent carries, then because the spacing D2 of the correction pattern P2 denoted by "Number=2" becomes 1/180 inch, a striped pattern does not occur in the correction pattern P2, and therefore the correction pattern P2 is selected as the most suitable pattern (see S103).

Put differently, if the correction pattern P2 is the most suitable pattern, then it is detected that the carry error that occurs during the four intermittent carries is "−1/720 inch." As a result, if the correction pattern P2 is the most suitable pattern, then it is detected that a carry error of "−1/2880 inch" occurs in each carry (carrying by a target carry amount of approximately ¼ inch).

For that reason, in a case where the correction pattern P2 is selected as the most suitable pattern, a correction amount 2 C (=2/5760 inch) is added to the target carry amount of approximately ¼ inch, and if the paper S is carried based on this corrected target carry amount (i.e., if the counter of S041 is set based on the corrected target carry amount), then the actual carry amount of the paper becomes the target carry amount. That is, the correction pattern P2 corresponds to the correction amount 2 C.

Similarly, the correction pattern P1 corresponds to a correction amount 4 C, the correction pattern P3 corresponds to a correction amount of 0, the correction pattern P4 corresponds to a correction amount −2 C, and the correction pattern P5 corresponds to a correction amount −4 C.

With the present embodiment as well, the correction patterns are arranged in the scanning direction, and thus many correction patterns can be formed in a narrow print region whose length in the carrying direction is L, allowing the same effects as in the embodiment discussed above to be obtained.

Also, with the present embodiment, the nozzle that forms the second band pattern of one correction pattern (for example, the correction pattern P1 denoted by "Number=1") and the nozzle that forms the second band pattern of another correction pattern (for example, the correction pattern P2 denoted by "Number=2") are different. Because the positions in the carrying direction of the nozzles used when forming the correction patterns are different, the positions in the carrying direction of the second patterns that are formed are different. Thus, in a single pass, it is possible to form the second patterns at different positions with respect to the carrying direction.

===(1) Other Embodiments===

The foregoing embodiment described primarily a printer. However, it goes without saying that the foregoing description also includes the disclosure of printing apparatuses, recording apparatuses, liquid ejection apparatuses, printing methods, recording methods, liquid ejection methods, printing systems, recording systems, computer systems, programs, storage media storing programs, display screens, screen display methods, and methods for producing printed material, for example.

Also, a printer, for example, serving as an embodiment was described above. However, the foregoing embodiment is for the purpose of elucidating the present invention and is not to be construed as limiting the present invention. The invention can of course be altered and improved without departing from the gist thereof and includes equivalents. In particular, the implementations mentioned below are also included in the invention.

<(1) Regarding the First Band Pattern and the Second Band Pattern>

With the embodiment discussed above, the first band patterns of the plurality of correction patterns are formed in the same position with respect to the carrying direction and the second band patterns of the plurality of correction patterns are formed in different positions in the carrying direction. However, it is also possible for the first band patterns and the second band patterns to be reversed. That is, it is also possible for the second band patterns of the plurality of correction patterns to be formed in the same position with respect to the carrying direction and for the first band patterns of the plurality of correction patterns to be formed in different positions in the carrying direction. In this case as well, it is possible to achieve the same effects as the above embodiment.

<(1) Regarding the First Band Patterns>

According to the above embodiment, the first band pattern of one correction pattern (for example, the correction pattern P3 denoted by "Number=3") is formed on the paper away from the first band pattern of another correction pattern (for example, the correction pattern P2 denoted by "Number=2"). However, it is not necessary that the first band patterns of the correction patterns be formed away from one another.

Figure 29:
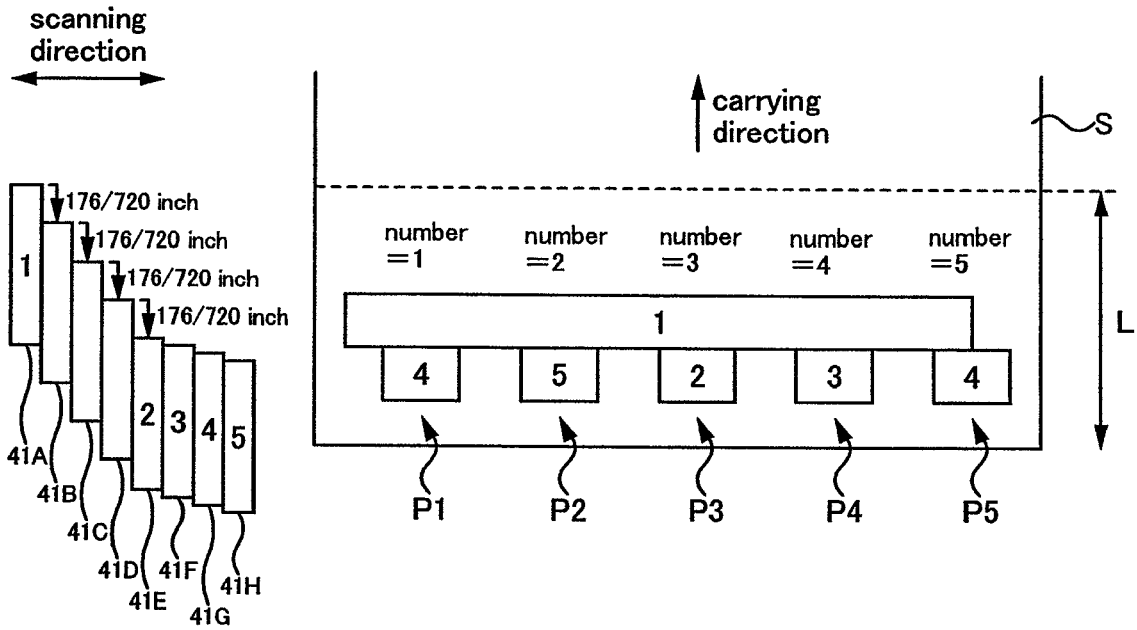
FIG. 29 is an explanatory diagram of the first band pattern according to a separate implementation of the first embodiment.

FIG. 29 is an explanatory diagram of the first band pattern in another implementation. In this implementation, the first band patterns of the five correction patterns are formed as a single pattern during pass 1. That is, in this implementation, the first band pattern of one correction pattern (for example, the correction pattern P3 denoted by "Number=3") is formed integrally with the first band pattern of another correction pattern (for example, the correction pattern P2 denoted by "Number=2"). The same effects as those of the above embodiment can be obtained even when the first band patterns are formed in this manner. However, forming the first band patterns away from each other as in the above embodiment is convenient when selecting the most suitable pattern.

<(1) Regarding the Rear End>

In the above embodiment, the test pattern is formed on the rear end side of the paper after the rear end of the paper has passed the carry roller. However, the position where the test pattern is formed is not limited to this.

For example, it is also possible to form the test pattern on the front end side of the paper. This is because before the front end of the paper that is carried by the carry roller passes the paper discharge roller, the paper is not carried by both the carry roller and the paper discharge roller, but rather it is carried by only the carry roller, and thus, the paper is in a carrying state that is different from the normal carrying process state. Also, the print region in the state when carrying by only the carry roller becomes narrow because, like in the state when carrying by only the paper discharge roller, the length in the carrying direction is short. Accordingly, like the above embodiment, by forming a plurality of correction patterns in the scanning direction in a narrow region on the front end side of the paper, it is possible to form many correction patterns therein.

In this implementation, the memory 63 stores not only the information on the correction amount corresponding to the normal carrying process state but also information corresponding to the correction amount that is adopted before the front end of the paper has passed the paper discharge roller. The front end of the paper passes the paper discharge roller if the paper is carried by a predetermined carry amount after the paper detection sensor 53 has detected the front end of the paper, and thus when correcting the target carry amount after the front end of the paper has passed the paper discharge roller, the controller 60 switches the correction amount from the correction amount corresponding to the carrying state in which only the carry roller is employed to the correction amount corresponding to the normal carrying process state.

It is also possible for a similar test pattern to be formed in the print region in the normal carrying process state (i.e., the state in which the paper is carried by two rollers, namely the carry roller and the paper discharge roller). In this case as well, it is possible to achieve the effect of printing numerous correction patterns in a narrow print region.

<Regarding the Arrangement of the Correction Patterns>

With the above embodiment, the first band patterns of the plurality of correction patterns are formed at the same position in the carrying direction. However, it is not absolutely necessary that they are formed at the same position. For example, it is also possible for the first band patterns of the correction patterns to be formed at positions shifted in the carrying direction. That is to say, it is only necessary that a plurality of correction patterns can be formed in a narrow print region (for example, the print region with a length of L in the carrying direction such as that shown in FIG. 20) by lining up the plurality of correction patterns in the direction (scanning direction) intersecting the carrying direction.

<(1) Regarding the Printing Apparatus>

In the above embodiment, the printing apparatus was an inkjet printer for ejecting ink from nozzles. However, the printing apparatus is not limited to inkjet printers. That is, it is only necessary that the printing apparatus is provided with a carry unit for carrying media such as paper, and that it sets a correction amount for canceling out carry error of that carry unit. Also, as long as test patterns for correcting the target carry amount of the carry unit of the printing apparatus are formed on the paper in the same way as in the above embodiment, then numerous correction patterns can be printed in a narrow region of the paper, and thus the same effects as those of the above embodiment can be obtained.

<(1) Regarding the Ink>

Since the foregoing embodiment was an embodiment of a printer, a dye ink or a pigment ink was ejected from the nozzles. However, the liquid that is ejected from the nozzles is not limited to such inks. For example, it is also possible to eject from the nozzles a liquid (including water) including metallic material, organic material (particularly macromolecular material), magnetic material, conductive material, wiring material, film-formation material, electronic ink, processed liquid, and genetic solutions. A reduction in material, process steps, and costs can be achieved if such liquids are directly ejected toward a target object.

<(1) Regarding the Nozzles>

In the foregoing embodiment, ink was ejected using piezoelectric elements. However, the method for ejecting liquid is not limited to this. Other methods may also be employed, such as a method for generating bubbles in the nozzles through heat.

Second Embodiment

===(2) Configuration of the Printing System===

The configuration of the printing system of the second embodiment is the same as the configuration of the printing system of the first embodiment, and thus description thereof is omitted.

===(2) Configuration of the Printer===

The configuration of the printer according to the second embodiment is the same as the configuration of the inkjet printer according to the first embodiment, and thus description thereof is omitted.

However, the arrangement of the nozzles in the second embodiment is different from the arrangement of the nozzles in the first embodiment.

Figure 30:
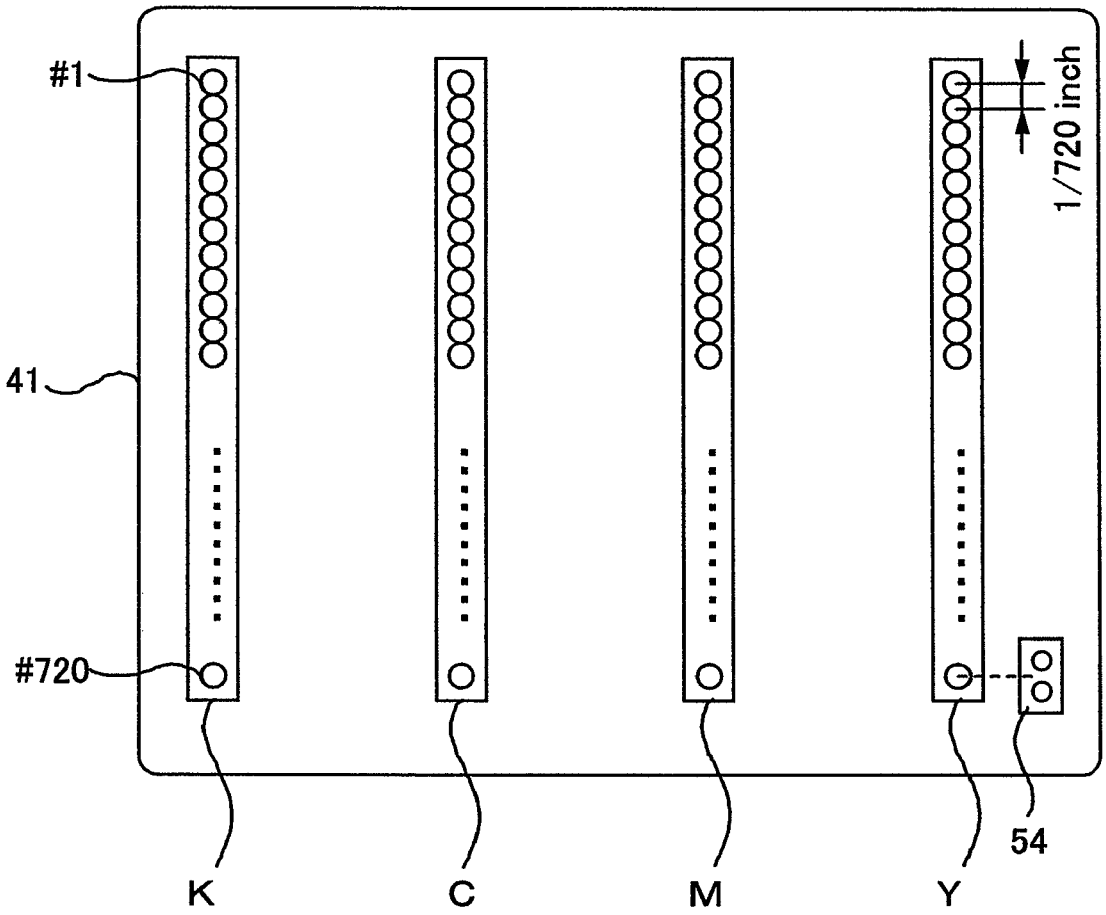
FIG. 30 is an explanatory diagram showing the arrangement of the nozzles according to a second embodiment.

FIG. 30 is an explanatory diagram showing the arrangement of the nozzles in the lower surface of the head 41 according to the second embodiment. A black ink nozzle row K, a cyan ink nozzle row C, a magenta ink nozzle row M, and a yellow ink nozzle row Y are formed in the lower surface of the head 41. Each nozzle row is provided with a plurality of nozzles (in this embodiment, 720), which are ejection openings for ejecting the inks of the respective colors.

The plurality of nozzles of the nozzle rows are arranged in rows at a constant spacing (nozzle pitch) in the carrying direction. In the present embodiment the nozzle pitch is 720 dpi ($1/720$ inch).

The nozzles of the nozzle rows are each assigned numbers (#1 to #720) that become smaller the more downstream the nozzle. That is, nozzle #1 is positioned more downstream in the carrying direction than nozzle #720. Each nozzle is provided with a piezo element (not shown) as a drive element for driving the nozzle and causing it to eject an ink droplet. Also, the optical sensor 54 is provided substantially in the same position as the nozzle #720, which is on the most upstream side, as regards its position in the paper carrying direction.

===(2) Carrying Process===

The carrying process of the second embodiment is the same as the first carrying process and thus description thereof is omitted.

However, in this embodiment, the rotary encoder is capable of detecting the rotation amount of the carry roller 23 in $1/1440$ inch units. Also, the controller is set to perform correction of the target carry amount using $1/1440$ inch as the smallest correction amount unit.

===(2) Method for Determining the Correction Amount===

The method for determining the carry amount according to the second embodiment is the same as that of the first embodiment, and thus description thereof is omitted.

However, in the second embodiment, the test pattern for carry amount correction that is printed on the paper S is different from the test pattern of the first embodiment.

Figure 31:
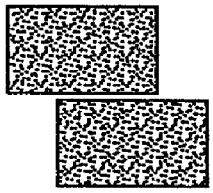
FIG. 31 is an example of the test pattern for carry amount correction according to the second embodiment.
Figure 31:
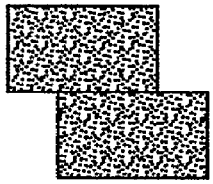
Figure 31:
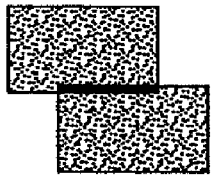
Figure 31:
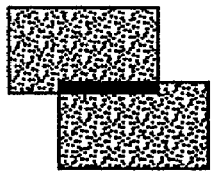
Figure 31:
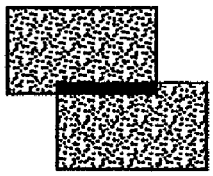

FIG. 31 is an example of the test pattern for carry amount correction that is printed on the paper S. In the present embodiment, the distance between the first band pattern and the second band pattern becomes smaller, and the corresponding correction amount also becomes smaller, in order from the top correction pattern.

Also, in the present embodiment, as discussed above, the carrying process is performed using $1/1440$ inch units. Thus, if the paper S is to be carried by one inch, then the value of the counter becomes 1440 unless the target carry amount has been corrected. On the other hand, if the correction amount that is stored in the memory corresponds to "+2 C (=+$2/1440$ inch)", then the value of the counter becomes 1442 (=1440+2).

Thus, even though the carrying process is executed with the value of the counter at 1442, the carry error and the correction amount cancel each other out, resulting in an actual carry amount of the paper S of one inch.

===(2) Reference Description===

<(2) Regarding the Test Pattern of the Reference Example>

Figure 32:
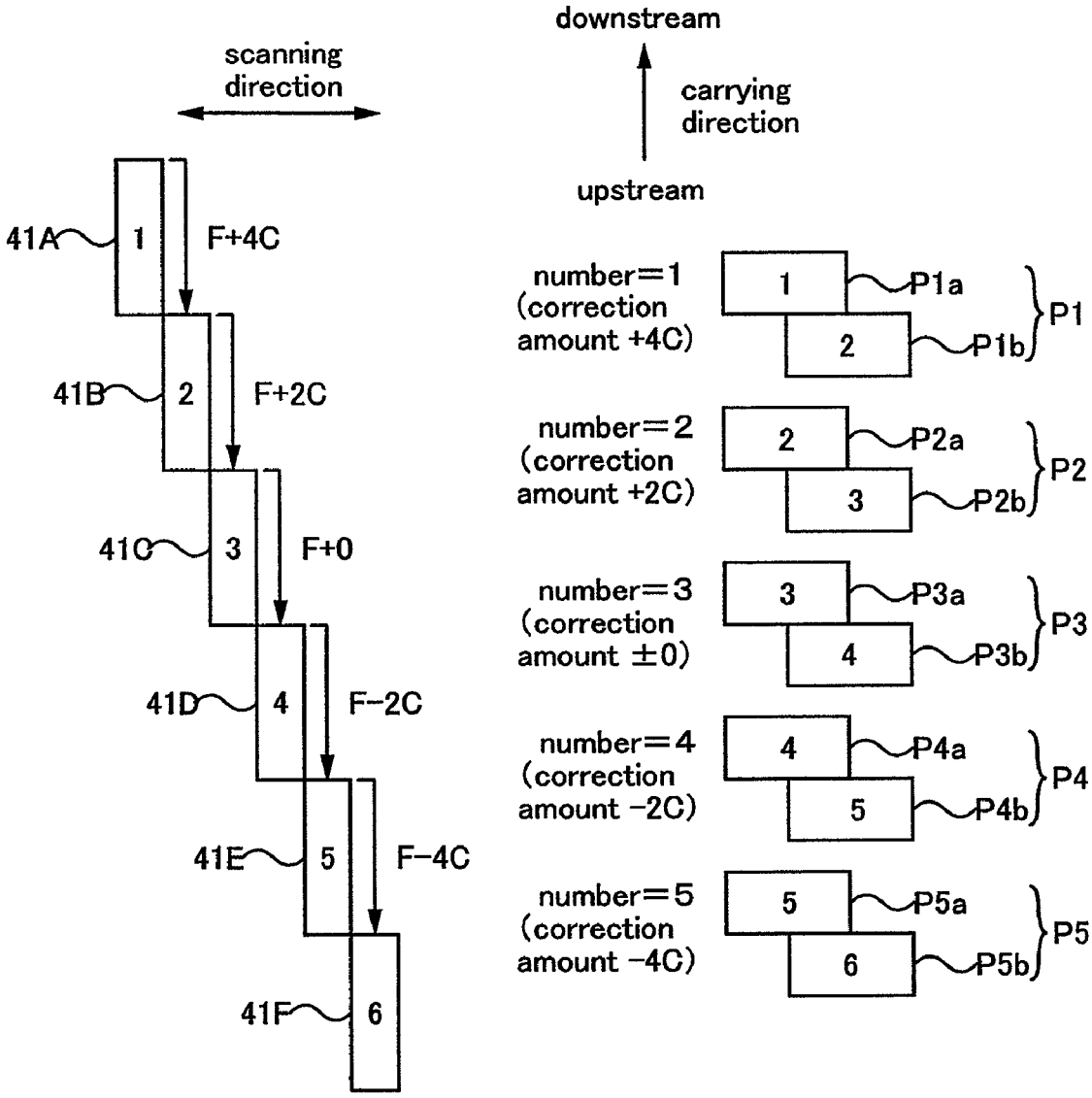
FIG. 32 is an explanatory diagram of the method for printing the test pattern according to a reference example.

FIG. 32 is an explanatory diagram of the method for printing the test pattern according to a reference example. The method for printing the test pattern of the reference example that is described below is performed during S102 mentioned above. It should be noted that the elongate shapes 41A to 41F that are drawn on the left side in the drawing indicate the positions of the head 41 with respect to the paper S, and are not printed on the paper S. Also, the numbers within the elongate shapes representing the head 41 indicate the number of the pass (a pass refers to the dot formation process of S003) of the relative position of the head. For example, the head 41C in the drawing indicates the relative position of the head 41 in the third pass. In this drawing it appears as if the head 41 is moving with respect to the paper S, but this drawing only shows the relative position between the head 41 and the paper S, and in practice, the relative positions of both are moving due to the paper S being carried in the carrying direction.

The correction patterns of the test pattern of the reference example are made of two band-shaped patterns (band patterns). Of the two band patterns, the band pattern (first band pattern) on the front end side of the paper (upper side in the drawing) is formed by the nozzles on the upstream side in the carrying direction (nozzle #720 side). On the other hand, of the two band patterns, the band pattern (second band pattern) on the rear end side of the paper (lower side in the drawing) is formed by the nozzles on the downstream side in the carrying direction (nozzle #1 side). Also, the first band pattern and the second band pattern are formed adjacent to one another in the carrying direction, and a boundary section is formed by these two band patterns. In this manner, the paper S is carried by substantially the width of the head 41 during the period between when the first band pattern has been formed until when the second band pattern is formed. Also, the two band patterns are formed shifted in the scanning direction such that the position of the boundary section formed by the two band patterns is clear. It should be noted that the numbers within the elongate shapes representing the band patterns in the figure indicate the number of the pass in which that pattern is formed.

The correction patterns are each formed by changing the carrying amount in a stepwise manner, and thus the state of the boundary section between the band patterns is different for each correction pattern. As a result, each correction pattern (or boundary section) corresponds to a different correction amount. As described below, with the method for printing a test pattern according to the reference example, the carry amount is changed in a stepwise manner in increments of 2 C (=2/1440 inch) as the plurality of correction patterns (that is, boundary sections) are formed.

First, the paper S is carried such that the head 41 is positioned at the position of head 41A with respect to the paper S. Then, the first printing operation (pass 1) is performed, printing a first band pattern Pla of a correction pattern P1 denoted by "Number=1."

Next, the paper S is carried by the target carry amount F+4 C, thereby bringing the head 41 at the position of head 41B in the drawing with respect to the paper S. Here, the target carry amount F is a carry amount that substantially corresponds to the width of the head 41. For example, in a case where 720 nozzles are formed in the head 31 arranged at a spacing of 720 dpi, the target carry amount F is one inch. Then, the second dot formation operation (pass 2) is performed, printing a second band pattern P1*b* of the correction pattern P2 denoted by "Number=1." Thus, the correction pattern P1 denoted by "Number=1" is completed. When the second pass (pass 2: second dot formation process) is performed, the first band pattern P2*a* of the correction pattern P2 denoted by "Number=2" is printed at the same time that the second band pattern Plb is printed. That is, two band patterns (P1*b* and P2*a*) are printed in the second pass. A blank space is left as these two band patterns are formed.

Next, the paper S is carried by the target carry amount F+2 C, thereby bringing the head 41 at the position of head 41C in the drawing with respect to the paper S. Then, the third dot formation operation (pass 3) is performed, printing the second band pattern P2*b* of the correction pattern P2 denoted by "Number=2." Thus, the correction pattern P2 denoted by "Number=2" is completed. When the third pass (pass 3: third dot formation process) is performed, the first band pattern P3*a* of the correction pattern P3 denoted by "Number=3" is printed at the same time that the second band pattern P2*b* is printed. That is, two band patterns (P2*b* and P3*a*) are printed in the third pass. A blank space is left as these two band patterns are formed.

Then, substantially the same operations as the operations described above are performed to print the other correction patterns P3 to P5 on the print paper S. However, the target carry amount when carrying the paper S is changed in a stepwise manner in increments of 2 C (=2/1440 inch) each time the paper S is carried by the width of the head. As a result, they are printed such that the spacing between the first band pattern and the second band pattern is different for each correction pattern.

With the method for printing a test pattern according to the reference example, the carry amount of the carrying from formation of the first pattern until formation of the second band pattern is different for each correction pattern. That is, the carry amount when forming each of the correction patterns is not constant. For that reason, it is difficult to achieve an accurate carry amount of the carry unit. In other words, in a case such as when the carry error differs depending on the carry amount, there is no guarantee that the difference between the spacing between the two band patterns of the correction pattern P1 and the spacing between the two band patterns of the correction pattern P2 is reliably a difference of 2 C.

===(2) Method 1 for Printing the Test Pattern of the Present Embodiment===

Figure 33:
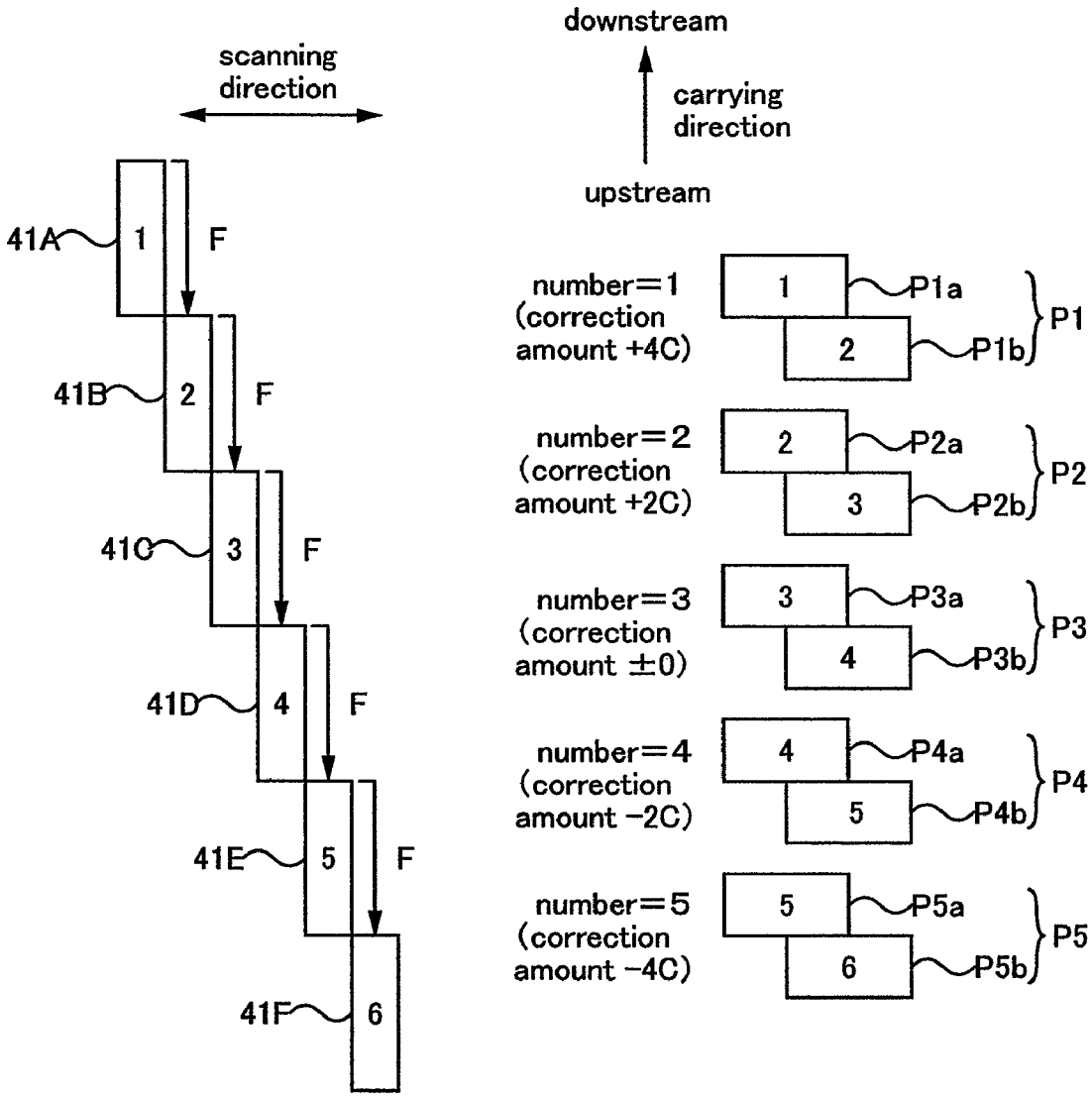
FIG. 33 is an explanatory diagram of the method for printing the test pattern according to the present embodiment.

Next, the method for printing the test pattern according to the present embodiment is described using FIG. 33. The various operations that are described below are achieved by the controller 60 controlling the various units in accordance with a program stored on the memory 63. This program has codes for performing the various processes.

FIG. 33 is an explanatory diagram of the method for printing the test pattern of the present embodiment. The method for printing the test pattern of the present embodiment that is described below is carried out during S102 described above. It should be noted that the elongate shapes 41A to 41H that are drawn on the left side in the drawing indicate the positions of the head 41 with respect to the paper S, and are not printed on the paper S. Also, the numbers within the elongate shapes representing the head 41 indicate the number of the pass (a pass refers to the dot formation process of S003) of the relative position of the head. However, in this embodiment, the first dot formation process after the rear end of the paper S has passed the carry roller is referred to as the "first pass." For example, the head 41C in the drawing indicates the relative position of the head 41 in the third pass after the rear end of the paper S has passed the carry roller. In this drawing it appears as if the head 41 is moving with respect to the paper S, but this drawing only shows the relative position between the head 41 and the paper S, and in practice, the relative positions of both are moving due to the paper S being carried in the carrying direction.

In this embodiment, the test pattern that is printed on the paper has five correction patterns. Each correction pattern is made of two band-shaped patterns (band patterns), namely a first band pattern and a second band pattern. Here, the band pattern on the front end side of the paper S (upper side in the drawing) is referred to as the first band pattern, and the band pattern on the rear end side of the paper S (lower side in the drawing) is referred to as the second band pattern. The first band pattern and the second band pattern are formed adjacent to one another in the carrying direction, and a boundary section is formed due to these two band patterns. It should be noted that the numbers within the elongate shapes representing the band patterns in the figure indicate the number of the pass in which that pattern is formed. As will be become clear from the subsequent description, in the present embodiment the first band pattern is the pre-carry pattern that is formed before carrying by the carry unit, and the second band pattern is the post-carry pattern that is formed after carrying by the carry unit. Also, as described later, in the present embodiment, the same nozzle group is used to form the first band patterns of all of the correction patterns, and thus the first band patterns serve as reference patterns. On the other hand, in the present embodiment, the nozzle group that is used to form the second band pattern is different for each correction pattern, and thus the second band patterns serve as comparative patterns.

(First Pass) First, the paper S is carried such that the head 41 is in the position of head 41A in the drawing with respect to the paper S. Then, the controller 60 moves the carriage 31 in the scanning direction and causes the ejection of ink from the head 41, thereby executing the first dot formation process (pass 1). At this time, the head 41 forms the first band pattern of correction pattern P1 denoted by "Number=1" using nozzles on the upstream side (nozzle #720 side) in the carrying direction. However, the nozzles that are used to form the first band pattern are a nozzle group whose numbers increase in increments of four. Thus, the dot pitch in the carrying direction of the dots making up the first band pattern is 1/180 inch.

(Second Pass) Next, the controller 60 causes the carry unit 20 to carry the paper by a target carry amount of one inch. After carrying, the head 41 is in the position of head 41B in the drawing with respect to the paper S. The controller 60 then moves the carriage 31 in the scanning direction and causes the ejection of ink from the head 41, thereby executing the second dot formation process (pass 2). At this time, the head 41 uses a nozzle group made of nozzle #6 and nozzles #4N+2 (for example, nozzle #10 etc.; here, N is an integer) upstream of nozzle #6 to form the second band pattern Plb of the correction pattern P1 denoted by "Number=1." Thus, the dot pitch in the carrying direction of the dots making up the second band pattern is 1/180 inch, and the correction pattern P1 denoted by "Number=1" is completed. When the second pass (pass 2: the second dot formation process) is being carried out, the first band pattern P2*a* of the correction pattern P2 denoted by "Number=2" is printed using a nozzle group on the upstream side (nozzle #720 side) in the carrying direction at the same time that the second band pattern P1*b* is printed. However, the nozzles that are used to form the first band pattern, like that nozzles that are used to form the first band pattern P1*a* mentioned above, are a nozzle group whose numbers increase in increments of four. Thus, the dot pitch in the carrying direction of the dots making up the first band pattern P2*a* is 1/180 inch. As described above, two band patterns (P1*b* and P2*a*) are printed in the second pass. A blank space is left in the carrying direction as these two band patterns are formed.

(Third Pass) Next, the controller 60 causes the carry unit 20 to carry the paper by the target carry amount of one inch. This carry amount is equal to the carry amount by which carrying is performed between formation of the first band pattern P1*a* and the second band pattern P1*b* of the correction pattern P. Consequently, the paper S is carried in a state that includes the same carry error. After carrying, the head 41 is in the position of head 41C in the drawing with respect to the paper S. The controller 60 then moves the carriage 31 in the scanning direction and causes the ejection of ink from the head 41, thereby executing the third dot formation process (pass 3). At this time, the head 41 uses a nozzle group made of nozzle #5 and nozzles #4N+1 (for example, nozzle #9 etc.) upstream of nozzle #5 to form the second band pattern P2*b* of the correction pattern P2 denoted by "Number=2." Thus, the dot pitch in the carrying direction of the dots making up the second band pattern is 1/180 inch, and the correction pattern P2 denoted by "Number=2" is completed. When the third pass (pass 3: the third dot formation process) is being carried out, the first band pattern P3*a* of the correction pattern P3 denoted by "Number=3" is printed using a nozzle group on the upstream side (nozzle #720 side) in the carrying direction at the same time that the second band pattern P2*b* is printed. However, the nozzles that are used to form the first band pattern, like that nozzles that are used to form the first band pattern P1*a* and the first band pattern P2*a* mentioned above, are a nozzle group whose numbers increase in increments of four. Thus, the dot pitch in the carrying direction of the dots making up the first band pattern P3*a* is 1/180 inch. As described above, two band patterns (P2*b* and P3*a*) are printed in the third pass. A blank space is left in the carrying direction as these two band patterns are formed.

(Fourth Pass) Next, the controller 60 causes the carry unit 20 to carry the paper by the target carry amount of one inch. This carry amount is equal to the carry amount by which carrying is performed between formation of the first band pattern P1*a* and the second band pattern P1*b* of the correction pattern P. Consequently, the paper S is carried in a state that includes the same carry error. After carrying, the head 41 is in the position of head 41D in the drawing with respect to the paper S. The controller 60 then moves the carriage 31 in the scanning direction and causes the ejection of ink from the head 41, thereby executing the fourth dot formation process (pass 4). At this time, the head 41 uses a nozzle group made of nozzle #4 and nozzles #4N (for example, nozzle #8 etc.) upstream of nozzle #4 to form the second band pattern P3*b* of the correction pattern P3 denoted by "Number=3." Thus, the dot pitch in the carrying direction of the dots making up the second band pattern is 1/180 inch, and the correction pattern P3 denoted by "Number=3" is completed. When the fourth pass (pass 4: the fourth dot formation process) is being carried out, the first band pattern P4*a* of the correction pattern P4 denoted by "Number=4" is printed using a nozzle group on the upstream side (nozzle #720 side) in the carrying direction at the same time that the second band pattern P3*b* is printed. However, the nozzles that are used to form the first band pattern, like that nozzles that are used to form the first band patterns P1*a* to P3*a* mentioned above, are a nozzle group whose numbers increase in increments of four. Thus, the dot pitch in the carrying direction of the dots making up the first band pattern P3*a* is 1/180 inch. As described above, two band patterns (P3*b* and P4*a*) are printed in the fourth pass. A blank space is left in the carrying direction as these two band patterns are formed.

(Fifth Pass) Next, the controller 60 causes the carry unit 20 to carry the paper by the target carry amount of one inch. This carry amount is equal to the carry amount by which carrying is performed between formation of the first band pattern Pla and the second band pattern P1*b* of the correction pattern P. Consequently, the paper S is carried in a state that includes the same carry error. After carrying, the head 41 is in the position of head 41E in the drawing with respect to the paper S. The controller 60 then moves the carriage 31 in the scanning direction and causes the ejection of ink from the head 41, thereby executing the fifth dot formation process (pass 5). At this time, the head 41 uses a nozzle group made of nozzle #3 and nozzles #4N−1 (for example, nozzle #7 etc.) upstream of nozzle #3 to form the second band pattern P4*b* of the correction pattern P4 denoted by "Number=4." Thus, the dot pitch in the carrying direction of the dots making up the second band pattern is 1/180 inch, and the correction pattern P4 denoted by "Number=4" is completed. When the fifth pass (pass 5: the fourth dot formation process) is being carried out, the first band pattern P5*a* of the correction pattern P5 denoted by "Number=5" is printed using a nozzle group on the upstream side (nozzle #720 side) in the carrying direction at the same time that the second band pattern P4*b* is printed. However, the nozzles that are used to form the first band pattern, like that nozzles that are used to form the first band patterns P1*a* to P4*a* mentioned above, are a nozzle group whose numbers increase in increments of four. Thus, the dot pitch in the carrying direction of the dots making up the first band pattern P5*a* is 1/180 inch. As described above, two band patterns (P4*b* and P5*a*) are printed in the fifth pass. A blank space is left in the carrying direction as these two band patterns are formed.

(Sixth Pass) Next, the controller 60 causes the carry unit 20 to carry the paper by the target carry amount of one inch. This carry amount is equal to the carry amount by which carrying is performed between formation of the first band pattern P1*a* and the second band pattern P1*b* of the correction pattern P1. Consequently, the paper S is carried in a state that includes the same carry error. After carrying, the head 41 is in the position of head 41F in the drawing with respect to the paper S. The controller 60 then moves the carriage 31 in the scanning direction and causes the ejection of ink from the head 41, thereby executing the sixth dot formation process (pass 6). At this time, the head 41 uses a nozzle group made of nozzle #2 and nozzles #4N−2 (for example, nozzle #6 etc.) upstream of nozzle #2 to form the second band pattern P5*b* of the correction pattern P5 denoted by "Number=5." Thus, the dot pitch in the carrying direction of the dots making up the second band pattern is 1/180 inch, and the correction pattern P5 denoted by "Number=3" is completed.

The test pattern that is formed in this manner is a pattern in which, as described below, the plurality of correction patterns are arranged in the order of the correction amount.

<(2) Regarding the Correction Amount Corresponding to the Correction Patterns>

Figure 34:
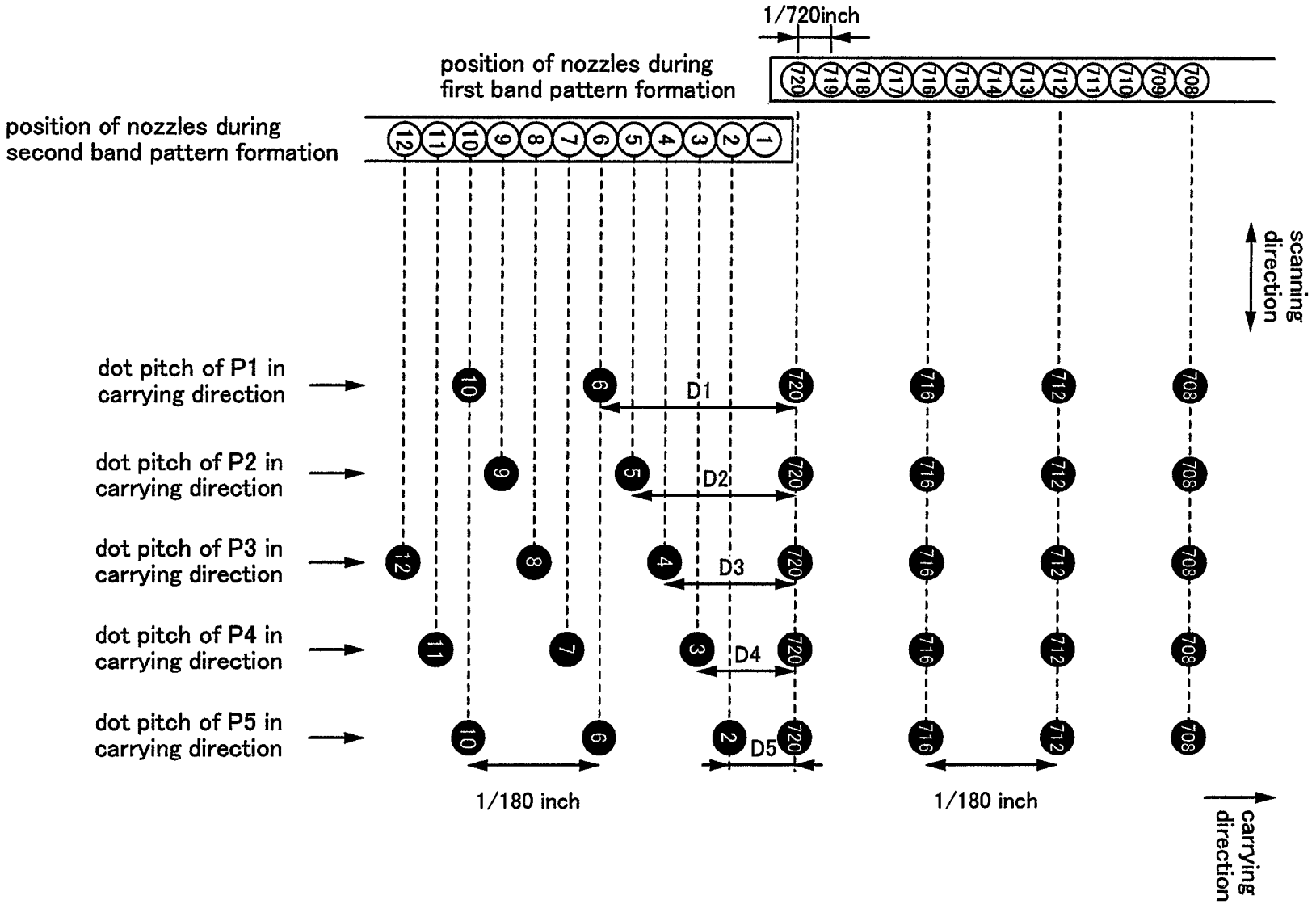
FIG. 34 is an explanatory diagram of the area between the first and second band patterns when there is no carry error.

FIG. 34 is an explanatory diagram of the dot spacing at the boundary between the first band pattern and the second band pattern of the correction patterns when there is no carry error. The relative position of the head in each pass is shown on the left side of the drawing. The black circles on the right side of the drawing indicate the dots making up the correction patterns. Only a single row of dots in the carrying direction is shown for each correction pattern on the right side of the drawing, but in practice, there are numerous such dot rows lined up in the scanning direction, forming correction patterns having the shape shown in FIG. 31 and FIG. 33 (discussed later). It should be noted that the numbers within the black circles on the right side of the drawing indicate the number of the nozzle that forms that dot.

If there is no carry error, then the spacing D3 between the most upstream dot of the dots making up the first band pattern (the dot formed by the nozzle #720 in pass 3) and the most downstream dot of the dots making up the second band pattern (the dot formed by the nozzle #4 in pass 4) of the correction pattern P3 is equal to the dot pitch in the carrying direction in the first band pattern (=1/180 inch) and the dot pitch in the carrying direction in the second band pattern (=1/180 inch). For that reason, a striped pattern does not occur at the boundary section between the first band pattern and the second band pattern of the correction pattern P3.

The nozzles (nozzles #5, 9, 13, etc.) forming the second band pattern of the correction pattern P2 denoted by "Number=2" are positioned more upstream by an amount of one nozzle than the nozzle group (nozzles #4, 8, 12, etc.) that forms the second band pattern of the correction pattern P3 denoted by "Number=3." On the other hand, the nozzle pitch is 1/720 inch. Thus, the second band pattern of the correction pattern P2 denoted by "Number=2" is formed upstream of the second band pattern of the correction pattern P3 denoted by "Number=3" by 1/720 inch, as regards its relative position with respect to the first band pattern. As a result, the spacing D2 of the correction pattern P2 is 1/720 inch wider than the spacing D3 of the correction pattern P3. In other words, the spacing D2 between the most upstream dot of the dots making up the first band pattern (the dot formed by the nozzle #720 in pass 2) and the most downstream dot of the dots making up the second band pattern (the dot formed by the nozzle #5 in pass 3) of the correction pattern 2 is wider than the dot spacing D3 (=1/180 inch) by 1/720 inch. For that reason, a white stripe pattern occurs at the boundary section between the first band pattern and the second band pattern of the correction pattern P2 if there is no carry error. Similarly, the spacing D1 of the correction pattern P1 is wider than the dot spacing D3 (=1/180 inch) by 2/720 inch. For that reason, a thick white stripe pattern occurs at the boundary section of the correction pattern P1.

The nozzle group (nozzles #3, 7, 11, etc.) forming the second band pattern of the correction pattern P4 denoted by "Number=4" is positioned more downstream by an amount of one nozzle than the nozzle group (nozzles #4, 8, 12, etc.) that forms the second band pattern of the correction pattern P3 denoted by "Number=3." On the other hand, the nozzle pitch is 1/720 inch. Thus, the second band pattern of the correction pattern P4 denoted by "Number=4" is formed downstream of the second band pattern of the correction pattern P3 denoted by "Number=3" by 1/720 inch, as regards its relative position with respect to the first band pattern. As a result, the spacing D4 of the correction pattern P4 is 1/720 inch wider than the spacing D3 of the correction pattern P3. In other words, the spacing D4 between the most upstream dot of the dots making up the first band pattern (the dot formed by the nozzle #720 in pass 4) and the most downstream dot of the dots making up the second band pattern (the dot formed by the nozzle #3 in pass 5) of the correction pattern 4 is narrower than the dot spacing D3 (=1/180 inch) by 1/720 inch. For that reason, a black stripe pattern occurs at the boundary section between the first band pattern and the second band pattern of the correction pattern P4. Similarly, the spacing D5 of the correction pattern P5 is narrower than the dot spacing D3 by 2/720 inch. For that reason, if there is no carry error, then a thick black stripe pattern occurs at the boundary section of the correction pattern P5.

In this manner, the spacing between the first band pattern and the second band pattern of the correction patterns changes by 1/720 inch increments. As long as there is no carry error during the carrying at a target carry amount of one inch, a striped pattern does not occur in the correction pattern P3 denoted by "Number=3," and thus this correction pattern is selected as the most suitable pattern (see S103).

Figure 35:
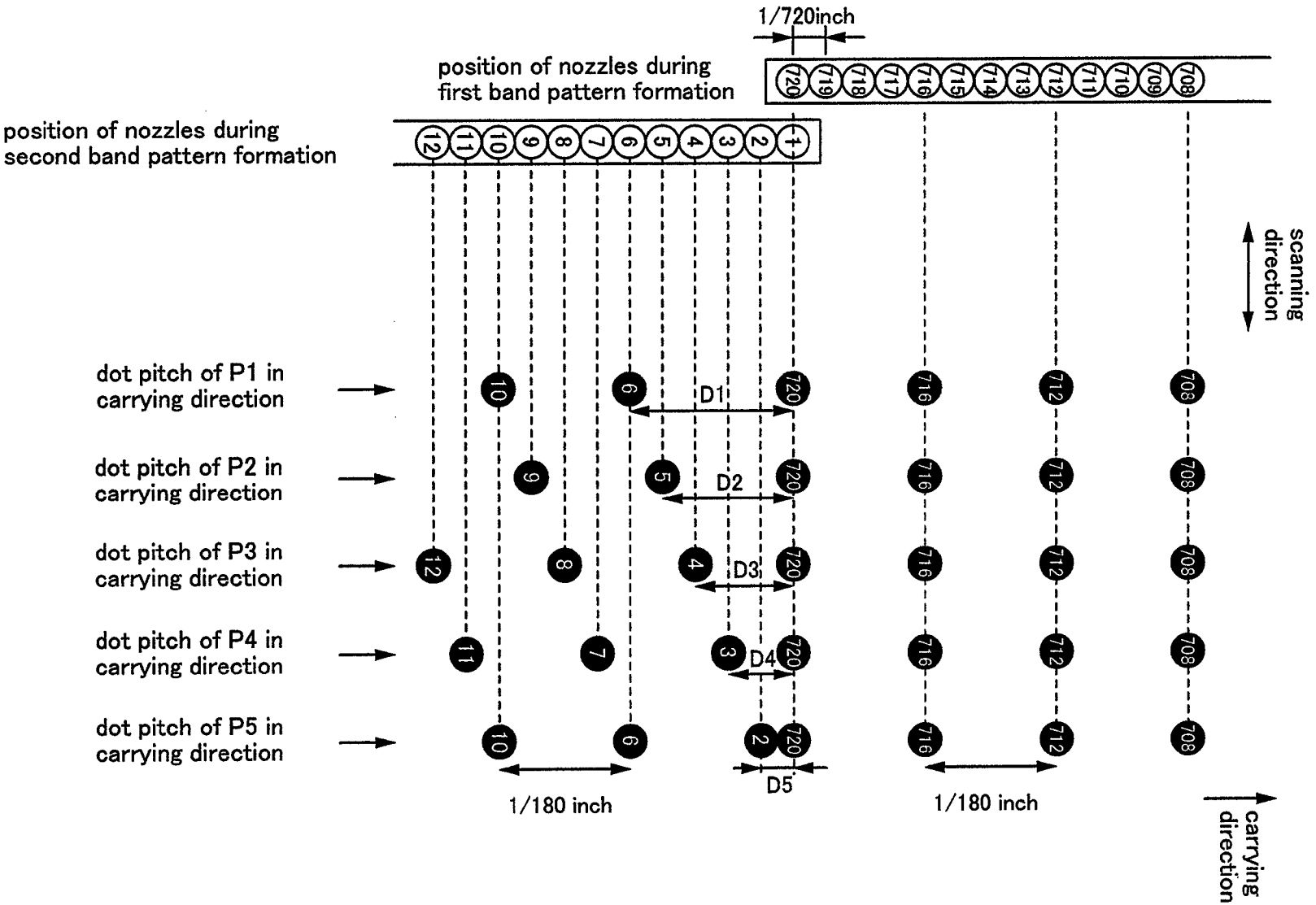
FIG. 35 is an explanatory diagram of the area between the first and second band patterns when there is carry error.

FIG. 35 is an explanatory diagram of the dot spacing at the boundary between the first band pattern and the second band pattern of the correction patterns if a "carry error of −1/720 inch" occurs during carrying by one inch. Here, a "carry error of −1/720 inch" means that the actual carry amount when the paper is carried according to the target correction amount is 1/720 inch less than the target carry amount. Because a "carry error of −1/720 inch" occurs during carrying by one inch, the relative positions of the nozzles when forming the second band patterns are shifted by 1/720 inch compared to the positions of the nozzles in FIG. 34.

If a "carry error of −1/720 inch" occurs during carrying by one inch, then the spacing D2 between the most upstream dot of the dots making up the first band pattern (the dot formed by the nozzle #720 in pass 2) and the most downstream dot of the dots making up the second band pattern (the dot formed by the nozzle #5 in pass 3) of the correction pattern P2 is equal to the dot pitch (=1/180 inch) in the carrying direction in the first band pattern and the dot pitch (=1/180 inch) in the carrying direction in the second band pattern. For that reason, a striped pattern does not occur at the boundary section between the first band pattern and the second band pattern of the correction pattern P2. In other words, if a "carry error of −1/720 inch" has occurred during carrying by one inch, then the correction pattern P2 denoted by "Number=2" is selected as the most suitable pattern (see S103).

Put differently, if the correction pattern P2 is the most suitable pattern, then it is detected that the carry error that occurs during carrying by one inch is "−1/720 inch." Thus, in a case where the correction pattern P2 is selected as the most suitable pattern, a correction amount 2 C (=2/1440 inch) is added to the target carry amount of one inch, and if the paper S is carried based on this corrected target carry amount (i.e., if the counter of S041 is set based on the corrected target carry amount), then the actual carry amount of the paper becomes the target carry amount. That is, the correction pattern P2 corresponds to the correction amount 2 C.

Similarly, the correction pattern P1 corresponds to a correction amount 4 C, the correction pattern P3 corresponds to a correction amount of 0, the correction pattern P4 corresponds to a correction amount −2 C, and the correction pattern P5 corresponds to a correction amount −4 C.

With the test pattern of the reference example, the carry amount of the carry unit is changed in a stepwise manner for each correction pattern so as to change the distance between the first band pattern and the second band pattern of the correction patterns. However, with the test pattern of the reference example, if the carry amount of the carry unit is not properly changed in a stepwise manner, then the spacing between the first band pattern and the second band pattern of the correction patterns will not properly change in steps. However, in the reference example, the carry amount of the correction unit is changed each time, and thus it is difficult to maintain an appropriate carry amount for all of the carries.

On the other hand, according to the present embodiment, the second band patterns, which are the comparative patterns, are formed using different nozzle groups. Further, it is guaranteed that the nozzles are formed at an interval of 1/720 inch. Thus, with the present embodiment, by printing the second band patterns using different nozzle groups, it is possible to properly change the relative position in the carrying direction of the second band patterns.

Also, with the present embodiment, all the reference patterns are formed using the same nozzle group (nozzle group such as #180 on the carrying direction upstream side). Thus, by printing the second band patterns using different nozzle groups, the positions of the second band patterns with respect to the first band patterns will become different for each correction pattern. Thus, the spacing between the first band pattern and the second band pattern becomes different for each correction pattern.

Also, with the present embodiment, a plurality of nozzles are lined up at an interval of 1/720 inch, and the correction patterns are each different from one another by 1/720 inch, which is the nozzle pitch, in a stepwise manner. Thus, it is possible to form a plurality of correction patterns whose corresponding correction amounts are each different by 1/720 inch.

Also, with the present embodiment, the plurality of correction patterns are formed in the carrying direction. Further, the carry amount of the carry unit by which carrying is performed between formation of the first band pattern and formation of the second band pattern of one correction pattern is equal to the carry amount for other correction patterns. In other words, when printing the test pattern, the carry amount can be kept constant without having to add a correction amount to the target carry amount. Due to this, the carry amount of the carry unit is stable, and carrying is performed in the same carrying state regardless of the correction pattern that is to be formed, and thus the spacing between the first band pattern and the second band pattern can be properly changed in 1/720 inch steps.

===(2) Method 2 for Printing the Test Pattern of the Present Embodiment===

In the printing method described above, a plurality of correction patterns are formed in the carrying direction. However, as described below, there are cases in which it is difficult to form a plurality of correction patterns in the carrying direction.

<(2) Regarding the Difficulty of Printing the Test Pattern at the Lower End>

Figure 36A:
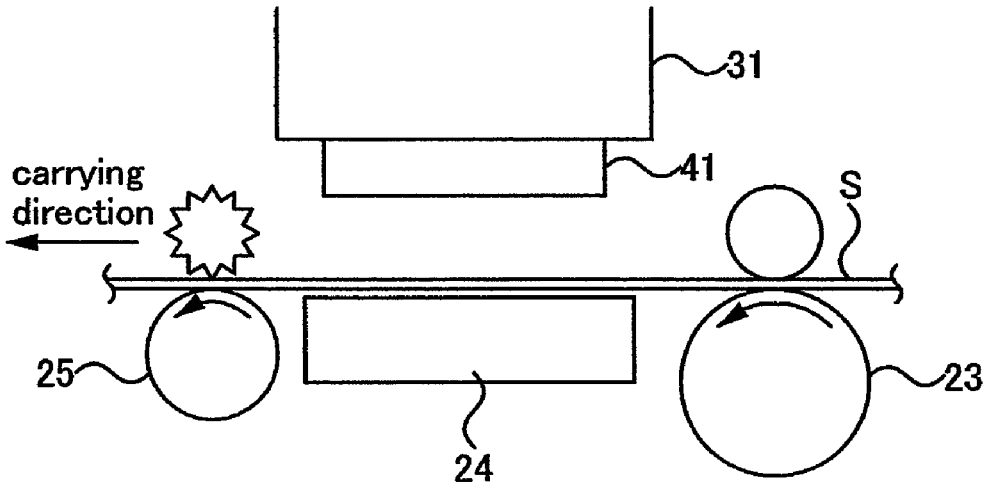
FIG. 36A is an explanatory diagram of the state during a normal carrying process.
Figure 36B:
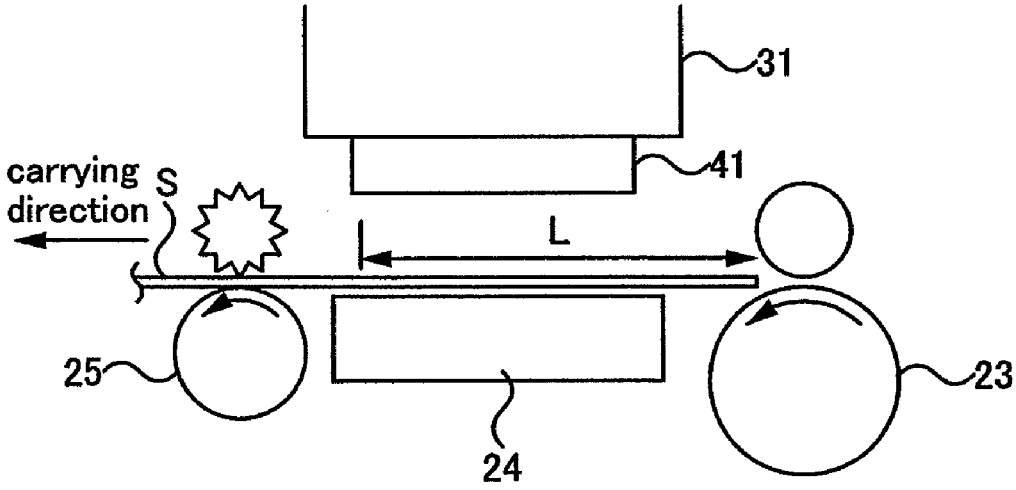
FIG. 36B is an explanatory diagram of the state during a carrying process after the rear end of the paper has passed the carry roller.

FIG. 36A is an explanatory diagram of a normal carrying process. FIG. 36B is an explanatory diagram of a carrying process after the rear end of the paper has passed the carry roller. In these drawings, structural elements that have already been described are assigned identical reference numerals and thus description thereof is omitted.

The carry roller 23 (upstream side roller) positioned on the upstream side of the print region and the paper discharge roller 25 (downstream side roller) positioned on the downstream side of the print region are rotated in synchronization with one another. Also, during the normal carrying process, the paper S is carried by these two rollers, the carry roller 23 and the paper discharge roller 25. Carrying of the paper S is almost always performed through this normal carrying process. That is, a wide print region is secured for the normal carrying process. For this reason, the correction amount of the target carry amount during the normal carrying process can be determined by printing the test pattern described above.

However, the carrying states before and after the rear end of the paper S passes the carry roller 23 are different. For example, after the rear end of the paper S has passed the carry roller 23, the paper S is carried by only the paper discharge roller 25, and thus this becomes a different state from the state when the paper is carried by both rollers (the state of the normal carrying process). Also, the shape (for example, the radius and the cross-sectional shape) of the carry roller 23 and the paper discharge roller 25 is different. Further, the roller provided in opposition to the paper discharge roller 25 has a different shape from the driven roller on the carry roller 23 side, in order to reduce contact with the print surface. Also, to prevent creases from forming in the paper during the normal carrying process, the carrying velocity of the paper discharge roller 25 is designed to be slightly faster than the carrying velocity of the carry roller 23. Because of these factors, the carrying state after the rear end of the paper S has passed the carry roller 23 is different from the normal carrying process state.

Thus, although the paper S is carried by the same target carry amount, the carry amount of the paper after the rear end of the paper S has passed the carry roller 23 is different from the carry amount of the paper during the normal carrying process. In other words, even though the target carry amount has been corrected based on the correction amount for the normal carrying process, proper carrying will not be carried out (i.e., the paper S will be carried in a state where there is carry error) after the rear end of the paper S has passed the carry roller 23. Consequently, it is necessary to correct the target carry amount in accordance with a correction amount for carrying the rear end of the paper S after the rear end of the paper S has passed the carry roller 23.

Accordingly, it is necessary to print a test pattern in order to determine the correction amount for when carrying the rear end of the paper S. However, the test pattern for determining the correction amount for when carrying the rear end of the paper S must be printed under the same conditions as when carrying the rear end of the paper S. In other words, it is necessary to print this test pattern after the rear end of the paper S has passed the carry roller 23.

However, after the rear end of the paper S has passed the carry roller 23, there is only a narrow region in which the printer can print the paper S.

Figure 37:
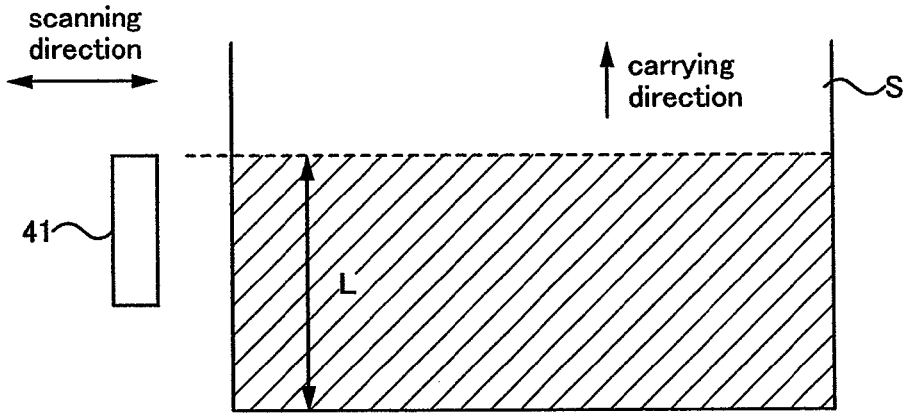
FIG. 37 is an explanatory diagram showing the positional relationship between the paper and the head when the rear end of the paper has passed the carry roller.

FIG. 37 is an explanatory diagram showing the positional relationship between the paper and the head when the rear end of the paper has passed the carry roller 23. In this drawing, structural elements that have already been explained are assigned identical reference numerals and therefore are not described.

The hatched section in the drawing indicates the region that can be printed by the head 41 after the rear end of the paper has passed the carry roller 23. This print region indicated by the hatched section is only secured for the length L in the carrying direction. This length L is determined based on the design positions of the structural elements (particularly the head 41 and the carry roller 23) of the printer. Normally, the head 41 and the carry roller 23 are positioned near one another in order to make the printer 1 compact, and thus the length L is not more than twice the width of the head (the length from the most upstream nozzle #720 to the most downstream nozzle #1). In the present embodiment, the width F of the head 41 is one inch (=2.54 cm), and the length L is approximately 3.5 cm.

Thus, the region that can be printed by the head 41 after the rear end of the paper has passed the carry roller 23 is a narrow region in the carrying direction. Since a print region that is wide in the carrying direction is required in order to print the test pattern described above, it is not possible to print the above test pattern after the rear end of the paper has passed the carry roller 23. If the test pattern described above were to be printed in a print region having the length L in the carrying direction, it would be possible to print only one correction pattern.

Accordingly, in the present embodiment, test pattern is printed as described below such that the plurality of correction patterns are lined up in the scanning direction.

<(2) Method for Printing the Test Pattern>

Figure 38:
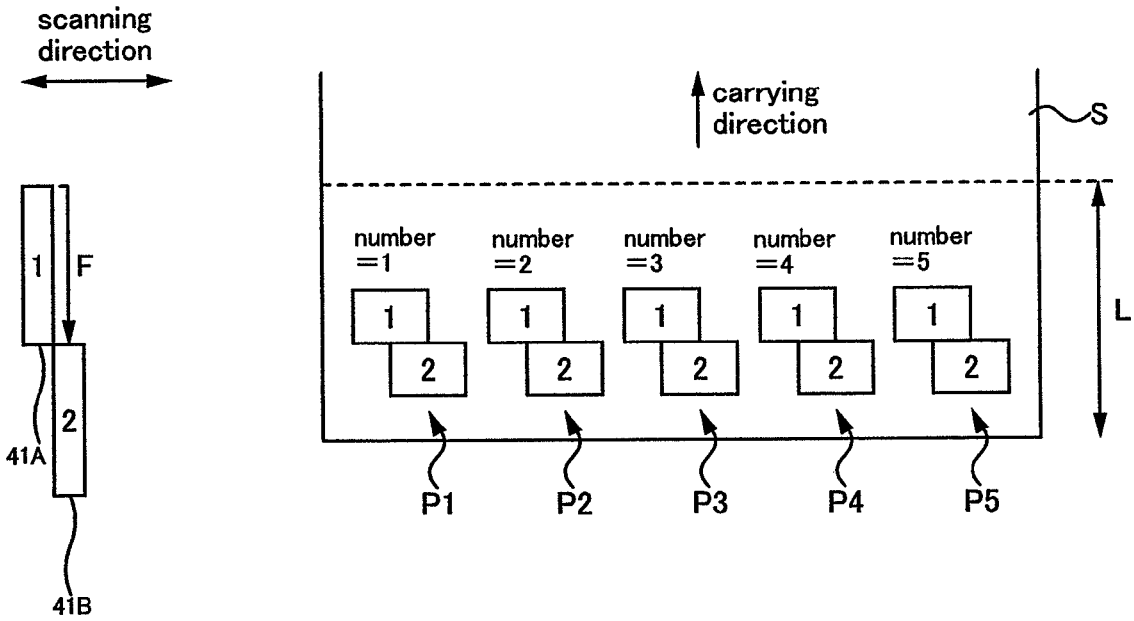
FIG. 38 is an explanatory diagram of the method for printing the test pattern according to the present embodiment.

First, the method for printing the test pattern according to the present embodiment is described using FIG. 38 and FIG. 34. The various operations that are described below are achieved by the controller 60 controlling the various units in accordance with a program stored on the memory 63. This program has codes for performing the various processes.

FIG. 38 is an explanatory diagram of the method for printing the test pattern of the present embodiment. The method for printing the test pattern of the present embodiment that is described below is carried out during S102 described above. It should be noted that the elongate shapes 41A to 41H that are drawn on the left side in the drawing indicate the positions of the head 41 with respect to the paper S, and are not printed on the paper S. Also, the numbers within the elongate shapes representing the head 41 indicate the number of the pass (a pass refers to the dot formation process of S003) of the relative position of the head. However, in this embodiment, the first dot formation process after the rear end of the paper S has passed the carry roller is referred to as the "first pass." For example, the head 41C in the drawing indicates the relative position of the head 41 in the third pass after the rear end of the paper S has passed the carry roller. In this drawing it appears as if the head 41 is moving with respect to the paper S, but this drawing only shows the relative position between the head 41 and the paper S, and in practice, the relative positions of both are moving due to the paper S being carried in the carrying direction.

In this embodiment, the test pattern that is printed on the paper has five correction patterns. Each correction pattern is made of two band-shaped patterns (band patterns), namely a first band pattern and a second band pattern. Here, the band pattern on the front end side of the paper S (upper side in the drawing) is referred to as the first band pattern, and the band pattern on the rear end side of the paper S (lower side in the drawing) is referred to as the second band pattern. The first band pattern and the second band pattern are formed adjacent to one another in the carrying direction, and a boundary section is formed due to these two band patterns. Also, the two band patterns are formed shifted in the scanning direction such that the position of the boundary section formed by the two band patterns is clear. It should be noted that the numbers within the elongate shapes representing the band patterns in the figure indicate the number of the pass in which that pattern is formed. As will be become clear from the subsequent description, in the present embodiment the first band pattern is the pre-carry pattern that is formed before carrying by the carry unit, and the second band pattern is the post-carry pattern that is formed after carrying by the carry unit. Also, as described later, in the present embodiment, the same nozzle group is used to form the first band patterns of all of the correction patterns, and thus the first band patterns serve as reference patterns. On the other hand, in the present embodiment, the nozzle group that is used to form the second band pattern is different for each correction pattern, and thus the second band patterns serve as comparative patterns.

(First Pass) When the rear end of the paper S has passed the carry roller, the head 41 is in the position of head 41A in the drawing with respect to the paper S. Then, the controller 60 moves the carriage 31 in the scanning direction and causes the ejection of ink from the head 41, thereby executing the first dot formation process (pass 1). At this time, the head 41 forms five first band patterns using the nozzle group on the upstream side (nozzle #180 side) in the carrying direction. However, the nozzles that are used to form the first band pattern are a nozzle group whose numbers increase in increments of four. Thus, the dot pitch in the carrying direction of the dots making up the first band pattern is 1/180 inch. Also, the nozzles that are used to form the five first band patterns are the same. Thus, the positions with respect to the carrying direction of these first band patterns are the same (see FIG. 34).

(Second Pass) Next, the controller 60 causes the carry unit 20 to carry the paper by a target carry amount of one inch. After carrying, the head 41 is in the position of head 41B in the drawing with respect to the paper S. The controller 60 then moves the carriage 31 in the scanning direction and causes the ejection of ink from the head 41, thereby executing the second dot formation process (pass 2).

Here, in the present embodiment, the controller 60 causes the head 41 to use different nozzles for ejecting ink in order to form the second band patterns of the plurality of correction patterns at different locations in the carrying direction. This aspect is described in greater detail below. It should be noted that in the following description the head 41 moves from left to right in the drawing.

First, the head 41 uses a nozzle group made of nozzle #6 and nozzles #4N+2 (for example, nozzle #10 etc.; here, N is an integer) upstream of nozzle #6 to form the second band pattern of the correction pattern P1 denoted by "Number=1." Thus, the correction pattern P1 denoted by "Number=1" is completed (see FIG. 34).

Next, while the second dot formation process (pass 2) is being executed, the head 41 uses a nozzle group made of nozzle #5 and nozzles #4N+1 (for example, nozzle #9 etc.) upstream of nozzle #5 to form the second band pattern of the correction pattern P2 denoted by "Number=2." Thus, the correction pattern P2 denoted by "Number=2" is completed (see FIG. 34).

Also, while the second dot formation process (pass 2) is being executed, the head 41 uses a nozzle group made of nozzle #4 and nozzles #4N (for example, nozzle #8 etc.) upstream of nozzle #4 to form the second band pattern of the correction pattern P3 denoted by "Number=3." Thus, the correction pattern P3 denoted by "Number=3" is completed (see FIG. 34).

Also, while the second dot formation process (pass 2) is being executed, the head 41 uses a nozzle group made of nozzle #3 and nozzles #4N−1 (for example, nozzle #7 etc.) upstream of nozzle #3 to form the second band pattern of the correction pattern P4 denoted by "Number=4." Thus, the correction pattern P4 denoted by "Number=4" is completed (see FIG. 34).

Lastly, while the second dot formation process (pass 2) is being executed, the head 41 uses a nozzle group made of nozzle #2 and nozzles #4N−2 (for example, nozzle #6 etc.) upstream of nozzle #2 to form the second band pattern of the correction pattern P5 denoted by "Number=5." Thus, the correction pattern P5 denoted by "Number=5" is completed (see FIG. 34).

The test pattern formed in this manner, as described below, is a test pattern in which a plurality of correction patterns are arranged in the order of the correction amount.

The nozzle group (nozzles #6, 10, 14, etc.) forming the second band pattern of the correction pattern P1 denoted by "Number=1" is positioned more upstream by an amount of one nozzle than the nozzle group (nozzles #5, 9, 13, etc.) forming the second band pattern of the correction pattern P2 denoted by "Number=2." On the other hand, the nozzle pitch is 1/720 inch. Thus, the second band pattern of the correction pattern P1 denoted by "Number=1" is formed upstream of the second band pattern of the correction pattern P2 denoted by "Number=2" by 1/720 inch. As a result, the spacing D1 of the correction pattern P1 is 1/720 inch wider than the spacing D2 of the correction pattern P2.

In this manner, the spacing between the first band pattern and the second band pattern of the correction patterns is changed in 1/720 inch increments. As long as there is no carry error during the four intermittent carries between pass 1 and pass 2, the spacing D3 of the correction pattern P3 denoted by "Number=3" is 1/180 inch, and thus a striped pattern does not occur in the correction pattern P3 denoted by "Number=3". Therefore the correction pattern P3 is selected as the most suitable pattern (see S103).

If a "carry error of −1/720 inch" occurs during the four intermittent carries, then because the spacing D2 of the correction pattern P2 denoted by "Number=2" becomes 1/180 inch, a striped pattern does not occur in the correction pattern P2, and therefore the correction pattern P2 is selected as the most suitable pattern (see S103).

Put differently, if the correction pattern P2 is the most suitable pattern, then it is detected that the carry error that occurs during carrying by one inch is "−1/720 inch." Thus, if the correction pattern P2 is selected as the most suitable pattern, then a correction amount 2 C (=2/1440 inch) is added to the target carry amount of one inch, and if the paper S is carried based on this corrected target carry amount (i.e., if the counter of S041 is set based on the corrected target carry amount), then the actual carry amount of the paper becomes the target carry amount. That is, the correction pattern P2 corresponds to the correction amount 2 C.

Similarly, the correction pattern P1 corresponds to a correction amount 4 C, the correction pattern P3 corresponds to a correction amount of 0, the correction pattern P4 corresponds to a correction amount −2 C, and the correction pattern P5 corresponds to a correction amount −4 C.

According to the present embodiment, for the same reasons as in the embodiment mentioned above, the spacing between the first band patterns and the second band patterns can be set to a proper spacing for each correction pattern.

According to the present embodiment, correction patterns each with a different spacing between the first band pattern and the second band pattern are formed in the scanning direction. In the test pattern of the above embodiment, the correction patterns are arranged in the carrying direction, and thus a wide print region is required. On the other hand, with the test pattern of the present embodiment, the correction patterns are arranged in the scanning direction, and thus many correction patterns can be formed in a narrow print region whose length in the carrying direction is L.

Also, according to the present embodiment, L (approximately 3.5 cm) is the length in the carrying direction of the print region in which the five correction patterns are formed, and this length L is shorter than twice the width of the head (the length from the most upstream nozzle #180 to the most downstream nozzle #1, that is, one inch (=2.54 cm)). In the above test pattern, the correction patterns are arranged in the carrying direction, and thus it was possible to form only a single correction pattern in a print region whose length is L in the carrying direction. However, the test pattern is for selecting the most suitable pattern from among a plurality of correction patterns, and thus it is necessary to form a plurality of correction patterns in the test pattern. With the present embodiment, it is possible to form many correction patterns in a narrow print region such as this.

Also, according to the present embodiment, the carry unit has an upstream side roller (carry roller) positioned on the upstream side of the print region (region in opposition to the head 31) and a downstream side roller (paper discharge roller) positioned on the downstream side of the print region. Also, in the present embodiment, correction patterns are formed on the paper when the paper is carried by only the downstream side roller (when the rear end of the paper has passed the carry roller). A carrying state in which two rollers are employed and a carrying state in which a single roller is employed are different carrying states. Thus, there is a possibility that the image quality will drop when the correction amount corresponding to the carrying state in which two rollers are employed is adopted for the correction amount corresponding to the carrying state in which a single roller is employed. On the other hand, the print region of the carrying state in which a single roller is employed is narrow. According to the present embodiment, it is possible to form many correction patterns in the narrow print region of the state in which the paper is carried by a single roller.

Also, in the present embodiment, the correction amount corresponding to the normal carrying process state (the carrying state in which two rollers (the upstream side roller and the downstream side roller) are employed) is different from the carry amount corresponding to the carrying state in which only the downstream side roller is employed (the carrying state when the rear end of the paper has passed the carry roller). This is because there is a possibility that the image quality will drop when the correction amount corresponding to the carrying state in which two rollers are employed is adopted as the correction amount corresponding to the carrying state in which a single roller is employed. In the present embodiment, the memory 63 stores not only the information on the correction amount corresponding to the normal carrying process state but also information on the correction amount that is adopted after the rear end of the paper has passed the carry roller. The rear end of the paper passes the carry roller if the paper is carried by a predetermined carry amount after the paper detection sensor 53 has detected the rear end of the paper, and thus when correcting the target carry amount after the rear end of the paper has passed the carry roller, the controller 60 switches the correction amount from the correction amount corresponding to the normal carrying process state to the correction amount corresponding to the carrying state in which only the paper discharge roller is employed.

===(2) Method 3 for Printing the Test Pattern of the Present Embodiment===

In the above embodiment, the carry amount between formation of the first band pattern and formation of the second band pattern was one inch. However, because the test pattern is for detecting carry error during actual printing, it is desirable that the carry amount when printing the test pattern is equal to the carry amount during actual printing.

Figure 39:
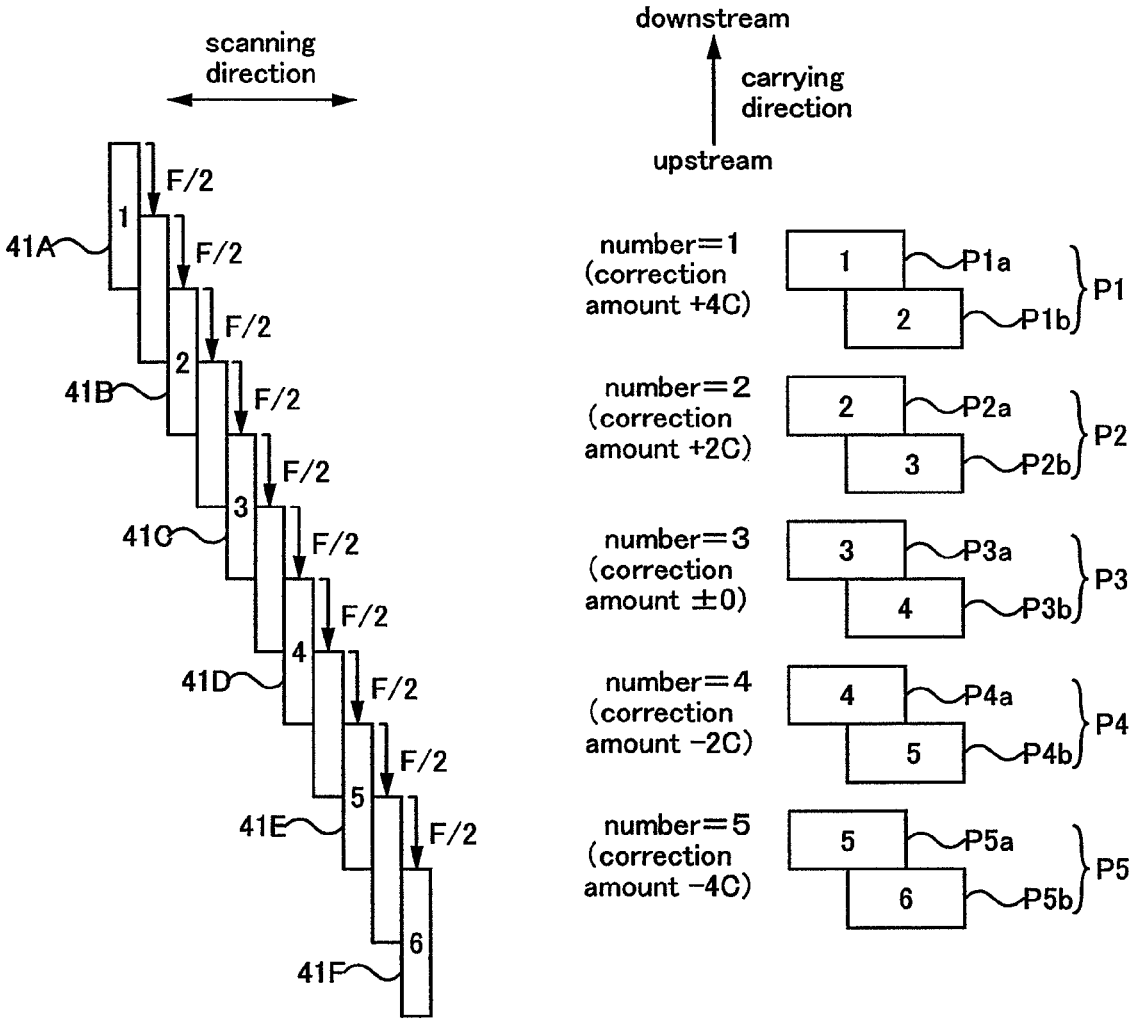
FIG. 39 is an explanatory diagram of the method for printing the test pattern in a case where the carry amount is ½ inch.

FIG. 39 is an explanatory diagram of the method for printing a test pattern in a case where the carry amount during actual printing is ½ inch. In this diagram, structural elements that have already been described are assigned identical reference numerals and thus description thereof is omitted. Also, the ejection of ink from the nozzles in the passes is the same as in the implementations of FIG. 33 and FIG. 34 discussed above. It should be noted that if a number is not written in the elongate shapes indicating the position of the head 41 in FIG. 39, then this means that a dot formation process is not performed when the head 41 is positioned at the position of that elongate shape.

In the present embodiment, the controller 60 causes the carry unit 20 to twice intermittently carry the paper by a target carry amount of ½ inch between formation of the first band pattern and formation of the second band pattern. The target carry amount at this time is substantially equal to the target carry amount during printing that is in accordance with the intended use of the printer (printing that is performed by the user after printing the test pattern). If the target amount during printing that is in accordance with the intended use of the printer is ¼ inch, then after pass 1 the paper is intermittently carried four times by a target carry amount of ¼ inch.

It should be noted that during the intermittent carrying mentioned above, in practice, the paper S is carried in a state that includes carry error. Thus, after intermittent carrying, the paper S is in a state where it has accumulated two carries worth of carry error. The test pattern of the present embodiment is for finding the most suitable correction amount for the carry error that has accumulated during the intermittent carrying (the carrying that is carried out from pass 1 until pass 2).

If a "carry error of $-1/720$ inch" occurs during the two intermittent carries, then the spacing D2 between the most upstream dot of the dots making up the first band pattern (the dot formed by the nozzle #720 in pass 2) and the most downstream dot of the dots making up the second band pattern (the dot formed by the nozzle #5 in pass 3) of the correction pattern P2 is $1/180$ inch, and thus a striped pattern does not occur at the boundary section between the first band pattern and the second band pattern of the correction pattern P2. In other words, if a "carry error of $-1/720$ inch" has occurred during the four intermittent carries, then the correction pattern P2 denoted by "Number=2" is selected as the most suitable pattern (see S103).

Put differently, if the correction pattern P2 is the most suitable pattern, then it is detected that the carry error that occurs during the two intermittent carries is "$-1/720$ inch." As a result, if the correction pattern P2 is the most suitable pattern, then it is detected that a carry error of "$-1/1440$ inch" occurs per carry (carrying at a target carry amount of ½ inch).

Thus, in a case where the correction pattern P2 is selected as the most suitable pattern, a correction amount C ($=1/1440$ inch) is added to the target carry amount of ½ inch, and if the paper S is carried based on this corrected target carry amount (i.e., if the counter of S041 is set based on the corrected target carry amount), then the actual carry amount of the paper becomes the target carry amount. That is, the correction pattern P2 corresponds to the correction amount C.

Similarly, the correction pattern P1 corresponds to a correction amount 2 C, the correction pattern P3 corresponds to a correction amount of 0, the correction pattern P4 corresponds to a correction amount −C, and the correction pattern P5 corresponds to a correction amount −2 C.

According to the present embodiment, for the same reasons as in the embodiment mentioned above, the spacing between the first patterns and the second patterns can be set to a proper spacing for each correction pattern.

Also, in the present embodiment, the carrying unit performs carrying twice between formation of the first band pattern and formation of the second band pattern of, for example, the correction pattern P1 denoted by "Number=1." Thus, the spacing between the first band pattern and the second band pattern reflects the carry error that accumulates during the two carries (twice the carry error of a single carry). That is, by selecting the most suitable correction pattern from among the plurality of correction patterns, then it is possible to detect the accumulated carry error.

===(2) Method 4 for Printing the Test Pattern of the Present Embodiment===

In the above embodiment, a plurality of correction patterns are formed such that the spacing of the correction patterns changes in a stepwise manner in increments of the nozzle pitch ($=1/720$ inch). However, it is also possible to carry out printing such that the spacing of the correction patterns changes in a stepwise manner by an increment that is smaller than the nozzle pitch.

<(2) Regarding the Configuration of the Head>

Figure 40:
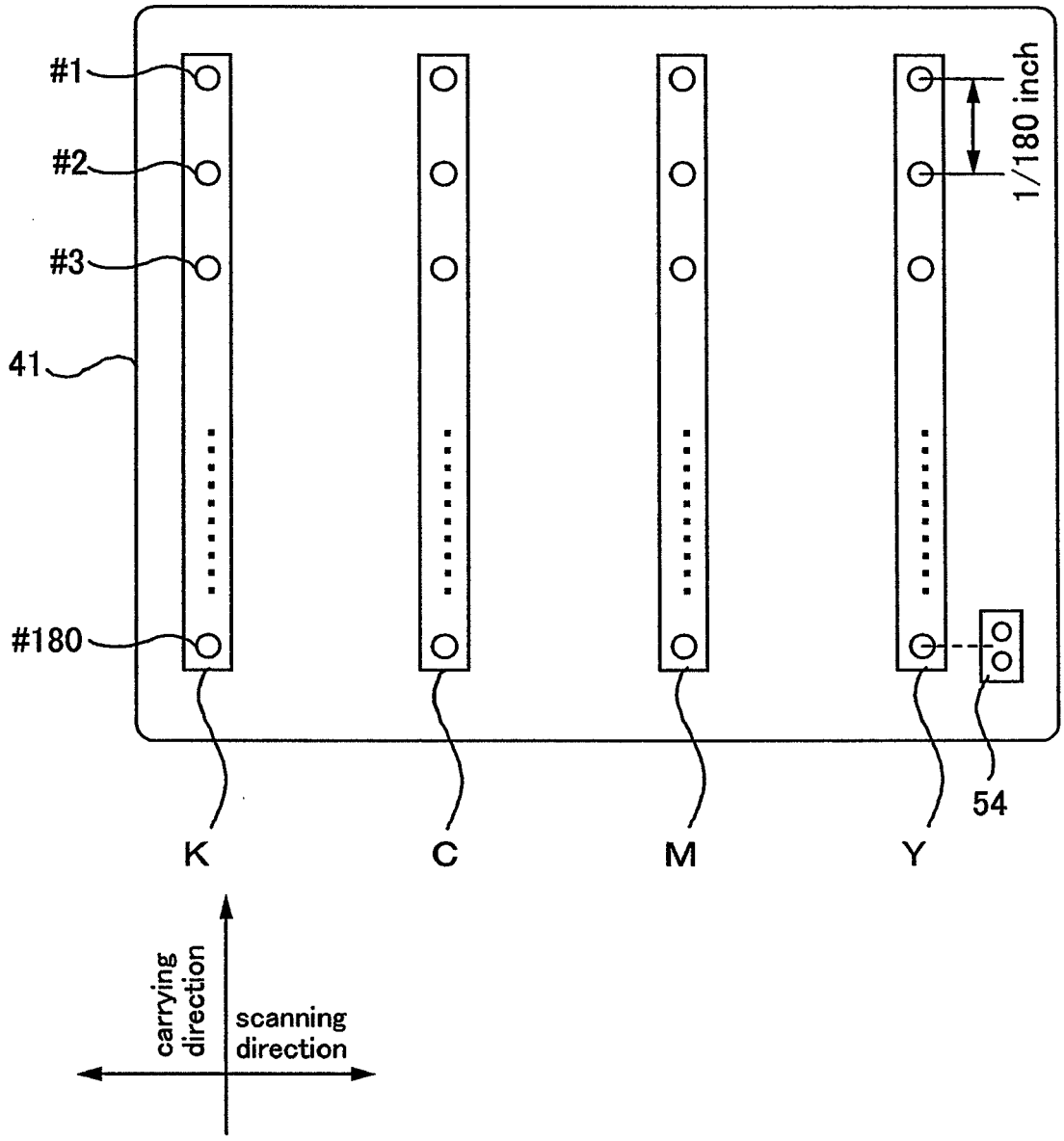
FIG. 40 is an explanatory diagram showing the arrangement of the nozzles according to a separate implementation of the second embodiment.

FIG. 40 is an explanatory diagram showing the arrangement of the nozzles in the present embodiment. A black ink nozzle row K, a cyan ink nozzle row C, a magenta ink nozzle row M, and a yellow ink nozzle row Y are formed in the lower surface of the head 41. Each nozzle row is provided with a plurality of nozzles (in this embodiment, 180), which are ejection openings for ejecting the inks of the respective colors. Also, in this embodiment, the nozzle pitch is different from that of the embodiment described above. In this embodiment, the nozzle pitch is 180 dpi ($1/180$ inch).

<(2) Method for Printing the Test Pattern>

The method for printing the test pattern of the present embodiment is described next using FIG. 41 and FIG. 42.

Figure 41:
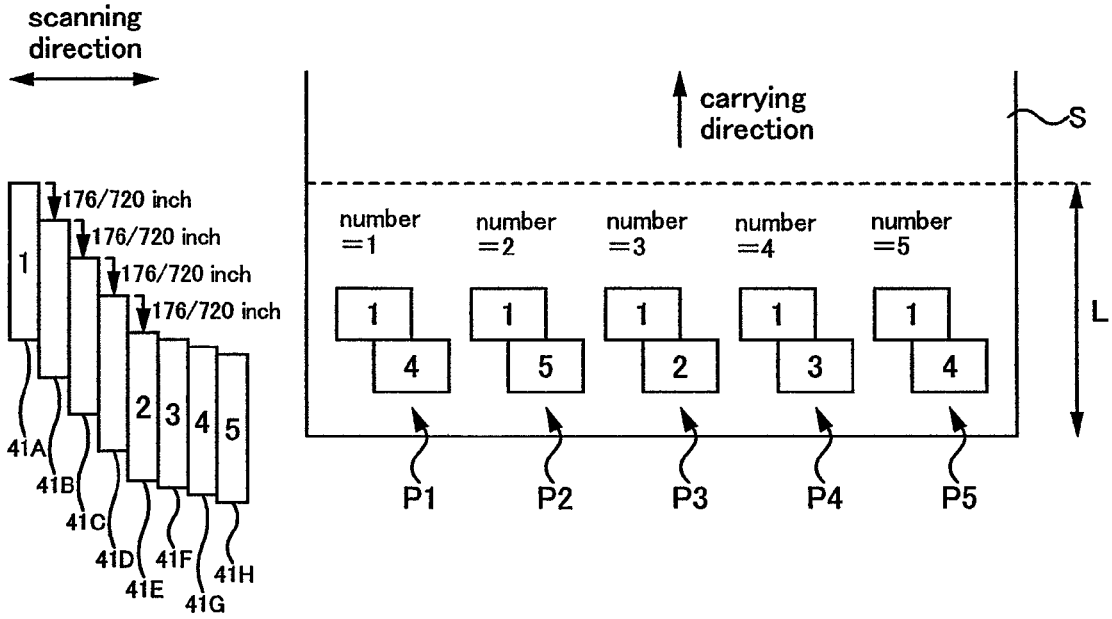
FIG. 41 is an explanatory diagram of the method for printing the test pattern according to a separate implementation of the second embodiment.
Figure 42:
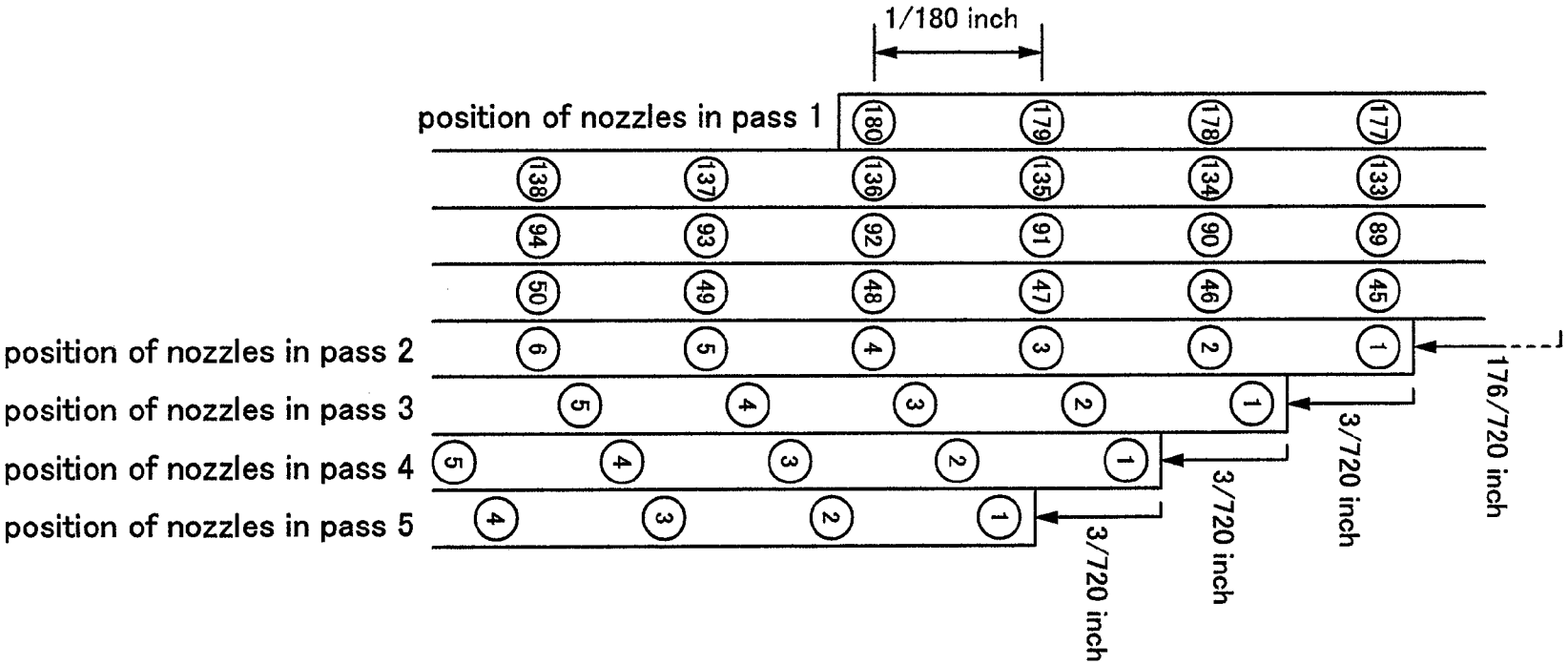
FIG. 42 is an explanatory diagram of the relative positions of the nozzles during printing.

FIG. 41 is an explanatory diagram of the method for printing the test pattern of the present embodiment. FIG. 42 is an explanatory diagram of the relative position of the nozzles during printing. In this diagram, structural elements that have already been described are assigned identical reference numerals and thus description thereof is omitted. The various operations that are described below are achieved by the controller 60 controlling the various units in accordance with a program stored on the memory 63. This program has codes for executing the various processes.

(First Pass) When the rear end of the paper S has passed the carry roller, the head 41 is in the position of head 41A in the drawing with respect to the paper S. Then, the controller 60 moves the carriage 31 in the scanning direction and causes the ejection of ink from the head 41, thereby executing the first dot formation process (pass 1). At this time, the head 41 forms five first band patterns using a nozzle group on the upstream side (nozzle #180 side) in the carrying direction. Since the five first band patterns are formed in a single pass, the positions of these first band patterns with respect to the carrying direction are the same. It should be noted that in pass 1, the head 41 uses a nozzle group on the downstream side (nozzle #1 side) in the carrying direction to also form the number added to each correction pattern (for example, "Number=1") on the paper S.

Next, the controller 60 causes the carry unit 20 to intermittently carry the paper four times by a target carry amount of approximately ¼ inch (in the present embodiment, 176/720 inch). The target carry amount at this time is substantially equal to the target carry amount when printing in accordance with the intended use of the printer (printing that is carried out by the user after the test pattern has been printed). If the target carry amount when printing in accordance with the intended use of the printer is ⅛ inch, then after pass 1 the paper is intermittently carried eight times by a target carry amount of ⅛ inch (for example, 176/1440 inch).

It should be noted that during the intermittent carrying mentioned above, in practice, the paper S is carried in a state that includes carry error. Thus, after intermittent carrying the paper S is in a state where it has accumulated four carries worth of carry error. The test pattern of the present embodiment is for finding the most suitable correction amount for the carry error that has accumulated during the intermittent carrying (the carrying that is performed from pass 1 until pass 2).

(Second Pass) After intermittent carrying, the head 41 is in the position of head 41E in the drawing with respect to the paper S. The controller 60 then moves the carriage 31 in the scanning direction and causes the ejection of ink from the head 41, thereby executing the second dot formation process (pass 2). At this time, the head 41 uses a nozzle group made of nozzle #5 and a nozzle upstream of nozzle #5 in the carrying direction (such as nozzle #6) to form the second band pattern of the correction pattern P3 denoted by "Number=3" (the correction pattern in the middle of the five correction patterns). Thus, the correction pattern P3 denoted by "Number=3" is completed.

(Third Pass) Next, the controller 60 causes the carry unit 20 to carry the paper S by a target carry amount of 3/720 inch. However, carry error does not occur when the carry unit 20 carries the paper because the amount by which the paper is carried at this time is small. That is, the paper is carried at a carry amount of 3/720 inch, which is the same as the target carry amount. Due to this, the head 41 is in the position of head 41F in the drawing with respect to the paper S. The controller 60 then moves the carriage 31 in the scanning direction and causes the ejection of ink from the head 41, thereby executing the third dot formation process (pass 3). At this time, the head 41 forms the second band pattern of the correction pattern P4 denoted by "Number=4" (the correction pattern second from the right among the five correction patterns) using a nozzle group made of nozzle #4 and a nozzle upstream of nozzle #4 in the carrying direction (such as nozzle #5). Thus, the correction pattern P4 denoted by "Number=4" is completed.

(Fourth Pass) Next, the controller 60 causes the carry unit 20 to carry the paper S by a target carry amount of 3/720 inch. However, carry error does not occur when the carry unit 20 carries the paper because the amount by which the paper is carried at this time is small. That is, the paper is carried at a carry amount of 3/720 inch, which is the same as the target carry amount. As a result, the head 41 is in the position of head 41G in the drawing with respect to the paper S. The controller 60 then moves the carriage 31 in the scanning direction and causes the ejection of ink from the head 41, thereby executing the fourth dot formation process (pass 4). First, the head 41 forms the second band pattern of the correction pattern P1 denoted by "Number=1" (the correction pattern furthest left among the five correction patterns) using a nozzle group made of nozzle #4 and a nozzle upstream of nozzle #4 in the carrying direction (such as nozzle #5). Thus, the correction pattern P1 denoted by "Number=1" is completed. Also, the head 41 forms the second band pattern of the correction pattern P5 denoted by "Number=5" (the correction pattern furthest right among the five correction patterns) using a nozzle group made of nozzle #3 and a nozzle upstream in the carrying direction of nozzle #3 (such as nozzle #4). Thus, the correction pattern P5 denoted by "Number=5" is completed. That is, in the dot formation process of pass 4, the controller 60 causes the head 41 to form the second band pattern of two correction patterns at different positions with respect to the carrying direction using different nozzles for ejecting ink.

(Fifth Pass) Next, the controller 60 causes the carry unit 20 to carry the paper S by a target carry amount of 3/720 inch. However, carry error does not occur when the carry unit 20 carries the paper because the amount by which the paper is carried at this time is small. That is, the paper is carried by a carry amount of 3/720 inch, which is the same as the target carry amount. As a result, the head 41 is in the position of head 41H in the drawing with respect to the paper S. The controller 60 then moves the carriage 31 in the scanning direction and causes the ejection of ink from the head 41, thereby executing the fifth dot formation process (pass 5). At this time, the head 41 forms the second band pattern of the correction pattern P4 denoted by "Number=2" (the correction pattern second from the left among the five correction patterns) using a nozzle group made of nozzle #3 and a nozzle upstream in the carrying direction of nozzle #3 (such as nozzle #4). Thus, the correction pattern P2 denoted by "Number=2" is completed.

The test pattern that is formed in this manner is a pattern in which, as described below, a plurality of correction patterns are arranged in the order of the correction amount.

<(2) Regarding the Correction Amount Corresponding to the Correction Patterns>

Figure 43:
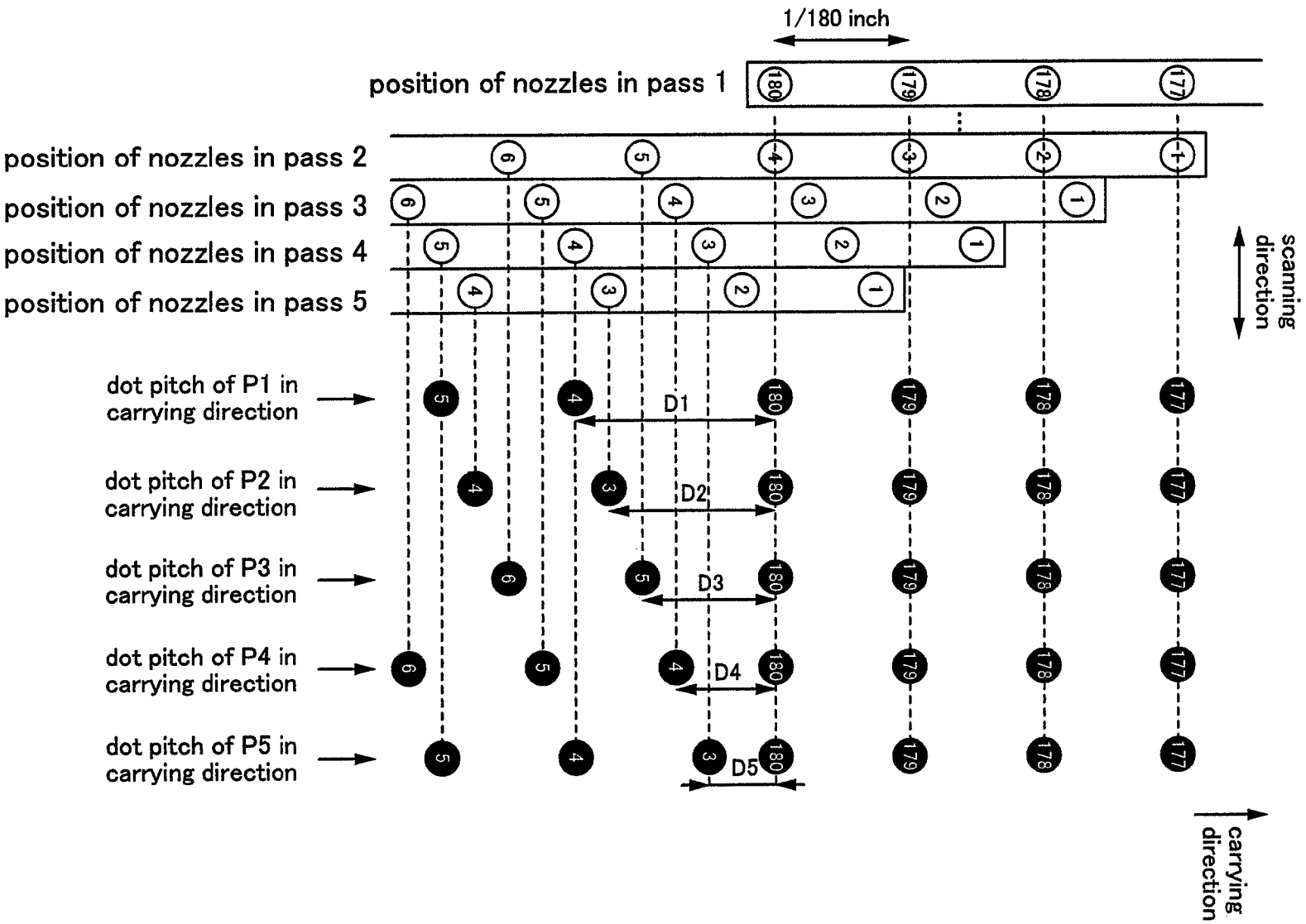
FIG. 43 is an explanatory diagram of the area between the first and second band patterns when there is no carry error in a separate implementation of the second embodiment.

FIG. 43 is an explanatory diagram of the dot spacing at the boundary between the first band pattern and the second band pattern of the correction patterns when there is no carry error. The relative position of the head in each pass is shown on the left side of the drawing. The black circles on the right side of the drawing indicate the dots making up the correction patterns. Only a single row of dots in the carrying direction is shown for each correction pattern on the right side of the drawing, but in practice, there are numerous such dot rows lined up in the scanning direction, forming the correction patterns (discussed later). It should be noted that the numbers within the black circles on the right side of the drawing indicate the number of the nozzle that forms that dot.

If there is no carry error, then the spacing D3 between the most upstream dot of the dots making up the first band pattern (the dot formed by the nozzle #180 in pass 1) and the most downstream dot of the dots making up the second band pattern (the dot formed by the nozzle #5 in pass 2) of the correction pattern P3 is equal to the nozzle pitch (=1/180 inch). For that reason, a striped pattern does not occur at the boundary section between the first band pattern and the second band pattern of the correction pattern P3.

On the other hand, if there is no carry error, then the spacing D2 between the most upstream dot of the dots making up the first band pattern (the dot formed by the nozzle #180 in pass 1) and the most downstream dot of the dots making up the second band pattern (the dot formed by the nozzle #3 in pass 5) of the correction pattern 2 is wider than the nozzle pitch (=1/180 inch) by 1/720 inch. For that reason, a white stripe pattern occurs at the boundary section between the first band pattern and the second band pattern of the correction pattern P2. Similarly, the spacing D1 of the correction pattern P1 is wider than the nozzle pitch by 2/720 inch. For that reason, a thick white stripe pattern occurs at the boundary section of the correction pattern P1.

Also, if there is no carry error, then the spacing D4 between the most upstream dot of the dots making up the first band pattern (the dot formed by the nozzle #180 in pass 1) and the most downstream dot of the dots making up the second band pattern (the dot formed by the nozzle #4 in pass 3) of the correction pattern 4 is narrower than the nozzle pitch (=1/180 inch) by 1/720 inch. For that reason, a black stripe pattern occurs at the boundary section between the first band pattern and the second band pattern of the correction pattern P4. Similarly, the spacing D5 of the correction pattern P5 is narrower than the nozzle pitch by 2/720 inch. For that reason, a thick black stripe pattern occurs at the boundary section of the correction pattern P5.

In this manner, the spacing between the first band pattern and the second band pattern of the correction patterns changes by 1/720 inch increments. As long as there is no carry error during the four intermittent carries from pass 1 to pass 2, a striped pattern does not occur in the correction pattern P3 denoted by "Number=3," and thus this correction pattern is selected as the most suitable pattern (see S103).

Figure 44:
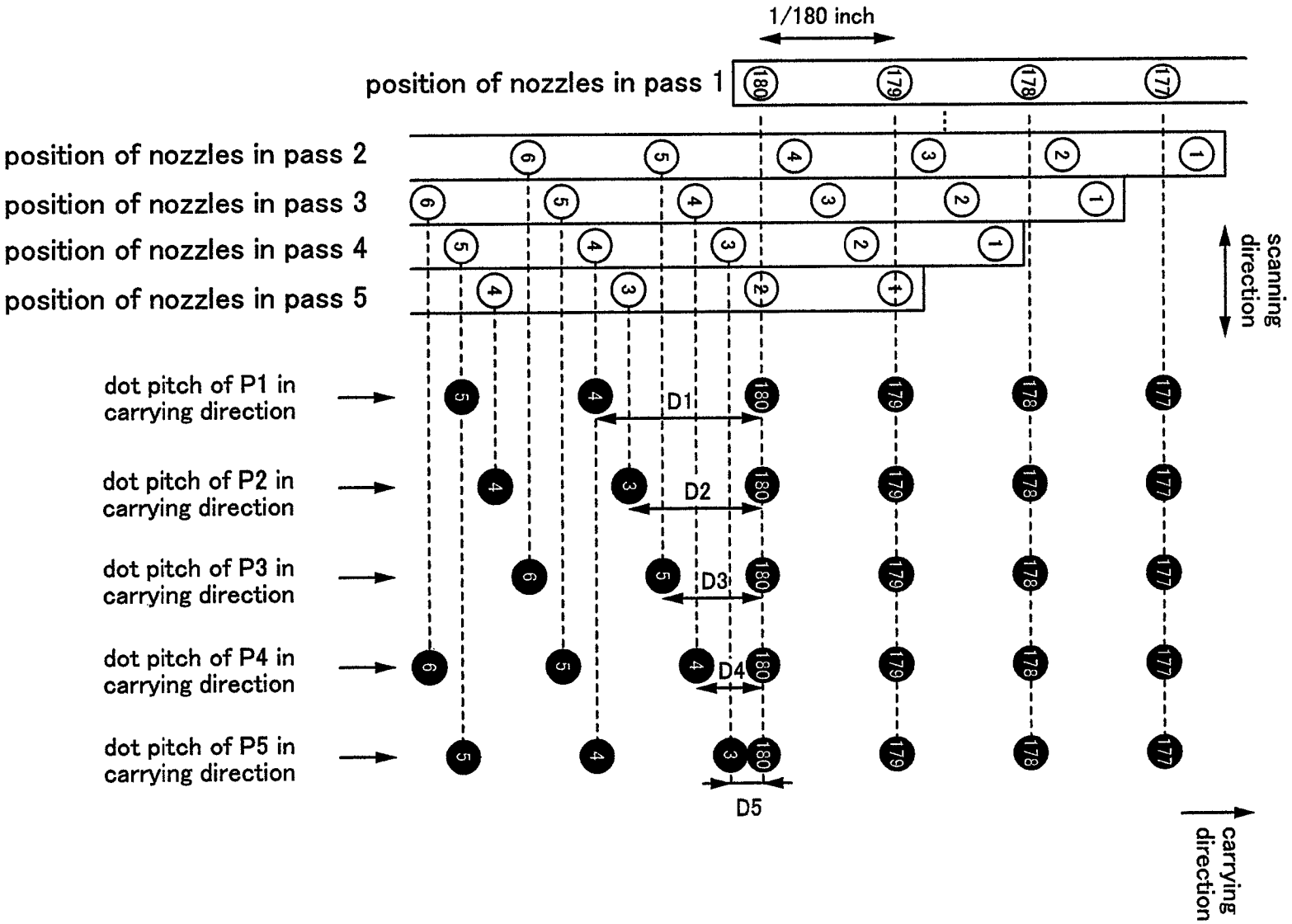
FIG. 44 is an explanatory diagram of the area between the first and second band patterns when there is carry error in a separate implementation of the second embodiment.
Figure 45A:
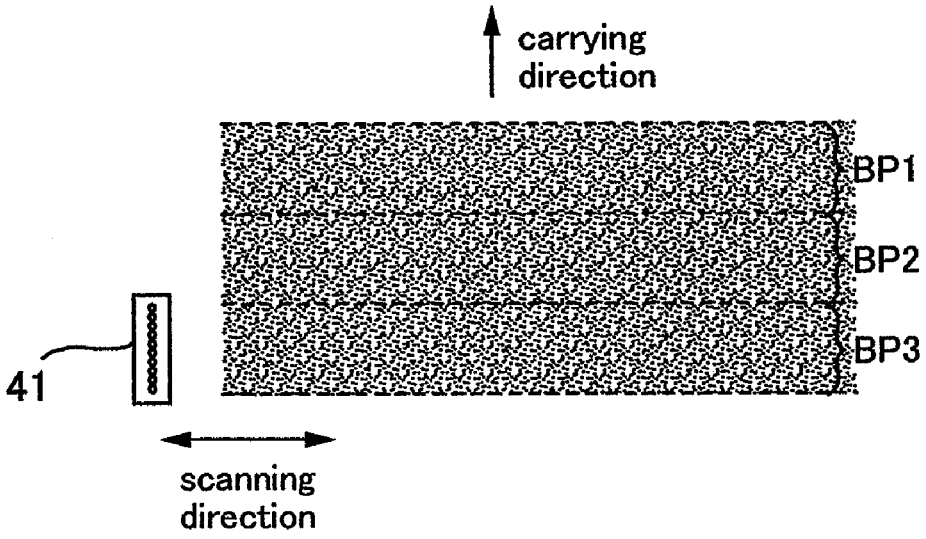
FIG. 45A is an explanatory diagram of the ejection operation and the carrying operation.
Figure 45B:
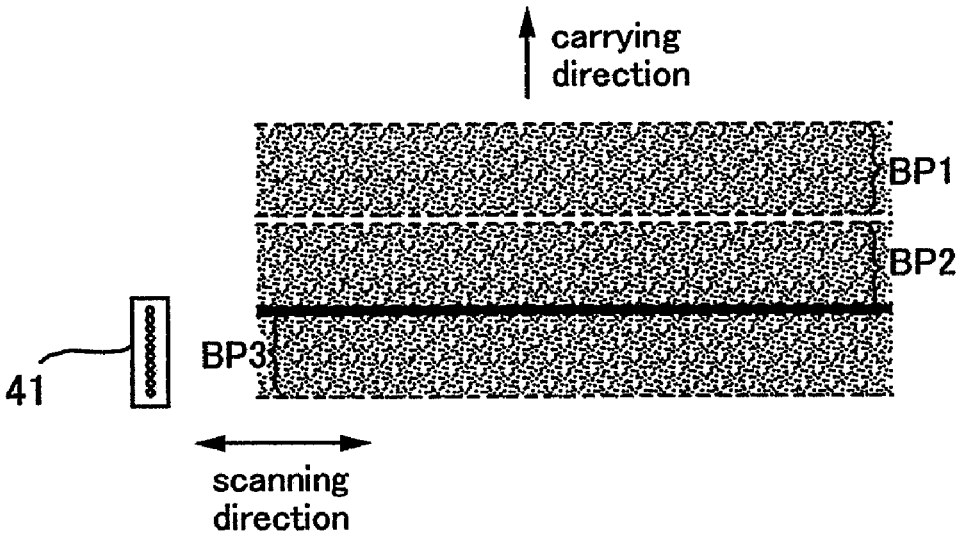
FIG. 45B is an explanatory diagram of the drop in image quality due to carry error.

FIG. 44 is an explanatory diagram of the dot spacing at the boundary between the first band pattern and the second band pattern of the correction patterns if a "carry error of −1/720 inch" occurs during the four intermittent carries. Here, a "carry error of −1/720 inch" means that the actual carry amount when the paper is carried based on the target correction amount is 1/720 inch less than the target carry amount. Because a "carry error of −1/720 inch" occurs during the four intermittent carries, the relative positions of the nozzles in pass 2 and thereafter are shifted by 1/720 inch compared to the positions of the nozzles in FIG. 43.

If a "carry error of −1/720 inch" has occurred during the four intermittent carries, then the spacing D2 between the most upstream dot of the dots making up the first band pattern (the dot formed by the nozzle #180 in pass 1) and the most downstream dot of the dots making up the second band pattern (the dot formed by the nozzle #3 in pass 5) of the correction pattern P2 is equal to the nozzle pitch (=1/180 inch). For that reason, a striped pattern does not occur at the boundary section between the first band pattern and the second band pattern of the correction pattern P2. In other words, if a "carry error of −1/720 inch" has occurred during the four intermittent carries, then the correction pattern P2 denoted by "Number=2" is selected as the most suitable pattern (see S103).

Put differently, if the correction pattern P2 is the most suitable pattern, then it is detected that the carry error that occurs during the four intermittent carries is "−1/720 inch." As a result, if the correction pattern P2 is the most suitable pattern, then it is detected that a carry error of "−1/2880 inch" occurs in each carry (carrying by a target carry amount of approximately 1/4 inch).

For that reason, in a case where the correction pattern P2 is selected as the most suitable pattern, a correction amount C (=1/1440 inch) is added to the target carry amount of approximately 1/4 inch at a rate of one time per two carries, and if the paper S is carried based on this corrected target carry amount (i.e., if the counter of S041 is set based on the corrected target carry amount), then the actual carry amount of the paper during intermittent carrying comes near the target carry amount. That is, the correction pattern P2 corresponds to the correction amount 0.5 C.

Similarly, the correction pattern P1 corresponds to a correction amount 1 C, the correction pattern P3 corresponds to a correction amount of 0, the correction pattern P4 corresponds to a correction amount −0.5 C, and the correction pattern P5 corresponds to a correction amount −C.

According to the present embodiment, for the same reasons as in the embodiment mentioned above, the spacing between the first patterns and the second patterns can be set to a proper spacing for each correction pattern.

===(2) Configuration of the Band Patterns===

The configuration of the band patterns of the second embodiment is the same as the configuration of the band patterns of the first embodiment, and thus description thereof is omitted.

===(2) Other Embodiments===

The foregoing embodiment described primarily a printer. However, it goes without saying that the foregoing description also includes the disclosure of printing apparatuses, recording apparatuses, liquid ejection apparatuses, printing methods, recording methods, liquid ejection methods, printing systems, recording systems, computer systems, programs, storage media storing programs, display screens, screen display methods, and methods for producing printed material, for example.

Also, a printer, for example, serving as an embodiment was described above. However, the foregoing embodiment is for the purpose of elucidating the present invention and is not to be construed as limiting the present invention. The invention can of course be altered and improved without departing from the gist thereof and includes equivalents. In particular, the implementations mentioned below are also included in the invention.

<(2) Regarding the First Band Pattern and the Second Band Pattern>

In the above embodiment, the first band patterns are reference patterns and the second band patterns are comparative patterns. However, it is also possible for the first band patterns and the second band patterns to be reversed. That is, it is also possible for the nozzle groups used to form the first band patterns to be different for each correction pattern such that the first band patterns serve as comparative patterns. Also, the second band patterns can be formed using the same nozzle group such that the second band patterns serve as reference patterns. In this case as well, it is possible to achieve the same effects as the above embodiment.

<(2) Regarding the Rear End>

According to the method 2 etc. for printing the test pattern of the embodiment discussed above, the test pattern is formed on the rear end side of the paper after the rear end of the paper has passed the carry roller. However, the position where the test pattern is formed is not limited to this. The effect that the spacing between the first band patterns and the second band patterns can be set to a proper spacing for each correction pattern can be obtained in other cases as well.

For example, it is also possible to form the test pattern on the front end side of the paper. This is because before the front end of the paper that is carried by the carry roller passes the paper discharge roller, the paper is not carried by both the carry roller and the paper discharge roller, but instead it is carried by only the carry roller, and thus the paper is in a carrying state that is different from the normal carrying process state. Also, the print region in the state when carrying by only the carry roller is narrow because, like in the state when carrying by only the paper discharge roller, the length in the carrying direction is short. Accordingly, like the above embodiment, by forming a plurality of correction patterns in the scanning direction in a narrow region on the front end side of the paper, it is possible to form numerous correction patterns, and it is possible to obtain the effect that the spacing between the first band patterns and the second band patterns can be set to a proper spacing for each correction pattern.

In this implementation, the memory 63 stores not only the information on the correction amount corresponding to the normal carrying process state but also information on the correction amount that is adopted before the front end of the paper has passed the paper discharge roller. The front end of the paper passes the paper discharge roller if the paper is carried by a predetermined carry amount after the paper detection sensor 53 has detected the front end of the paper, and thus when correcting the target carry amount after the front end of the paper has passed the paper discharge roller, the controller 60 switches the correction amount from the correction amount corresponding to the carrying state in which only the carry roller is employed to the correction amount corresponding to the normal carrying process state.

It is also possible for a similar test pattern to be formed in the print region in the normal carrying process state (i.e., the state in which the paper is carried by two rollers, namely the carry roller and the paper discharge roller). In this case as well, it is possible to achieve the effect of printing numerous correction patterns in a narrow print region, and the effect that the spacing between the first band patterns and the second band patterns can be set to a proper spacing for each correction pattern can be obtained.

<(2) Regarding the Nozzle Group>

According to the embodiment discussed above, the first band patterns are formed by a nozzle group on the upstream side in the carrying direction (for example, if there are 720 nozzles, a nozzle group including nozzle #361 to nozzle #720), and the second band patterns are formed by a nozzle group on the downstream side in the carrying direction (for example, if there are 720 nozzles, a nozzle group including nozzle #1 to nozzle #360). However, the nozzle groups for forming the band patterns are not limited to this.

For example, if there are 720 nozzles, then it is possible to form the first band patterns using a nozzle group that includes some of the nozzle group on the downstream side in the carrying direction (for example, nozzle #321 to nozzle #640). It is also possible to form the first band patterns using a nozzle group that is entirely on the downstream side in the carrying direction (for example, nozzle #181 to nozzle #360). In other words, it is only necessary that the nozzle group for forming the second band patterns is positioned more on the downstream side in the carrying direction than the nozzle group for forming the first band patterns.

However, like in the embodiment discussed above, the carry amount when carrying between formation of the first band pattern and formation of the second band pattern becomes large if the first band patterns are formed by a nozzle group on the upstream side in the carrying direction and the second band patterns are formed by a nozzle group on the downstream side in the carrying direction, and thus detection of carry error through the correction patterns becomes easy.

<(2) Regarding the Printing Apparatus>

In the above embodiment, the printing apparatus was an inkjet printer for ejecting ink from nozzles. However, the printing apparatus is not limited to inkjet printers. That is, it is only necessary that the printing apparatus is provided with a carry unit for carrying media such as paper, and that it sets a correction amount for canceling out carry error of that carry unit. Also, as long as test patterns for correcting the target carry amount of the carry unit of the printing apparatus are formed on the paper in the same way as in the above embodiment, then numerous correction patterns can be printed in a narrow region of the paper, and thus the same effects as those of the above embodiment can be obtained.

<(2) Regarding the Ink>

Since the foregoing embodiment was an embodiment of a printer, a dye ink or a pigment ink was ejected from the nozzles. However, the liquid that is ejected from the nozzles is not limited to such inks. For example, it is also possible to eject from the nozzles a liquid (including water) including metallic material, organic material (particularly macromolecular material), magnetic material, conductive material, wiring material, film-formation material, electronic ink, processed liquid, and genetic solutions. A reduction in material, process steps, and costs can be achieved if such liquids are directly ejected toward a target object.

<(2) Regarding the Nozzles>

In the foregoing embodiment, ink was ejected using piezoelectric elements. However, the method for ejecting liquid is not limited to this. Other methods may also be employed, such as a method for generating bubbles in the nozzles through heat.

The invention claimed is:

1. A printing method for forming a plurality of correction patterns on a medium, comprising the steps of:

preparing said medium onto which said correction patterns are to be formed; and forming a plurality of correction patterns on said medium, each correction pattern having each of a pre-carry pattern and a post-carry pattern that has been formed adjacent to said pre-carry pattern in a carrying direction, said pre-carry pattern being formed on said medium by ejecting ink from a plurality of nozzles, said post-carry pattern being formed on said medium by ejecting ink from a plurality of nozzles in a downstream side in said carrying direction than said nozzles that have formed said pre-carry pattern, after said medium that has been formed with said pre-carry pattern has been carried in said carrying direction, wherein (A) said plurality of correction patterns are formed on said medium lined up in a direction that intersects the carrying direction by said plurality of said pre-carry patterns in said plurality of said correction patterns being formed by ink being ejected while said plurality of nozzles are moved once in said moving direction, and said plurality of post-carry patterns in said plurality of said correction patterns being formed by alternately repeating a plurality of times ejecting ink while said plurality of nozzles are moving in said moving direction and carrying said medium by said carrying unit, and (B) said plurality of correction patterns, in which a spacing between said pre-carry pattern and said post-carry pattern changes in a stepwise manner in increments of a spacing shorter than a carry amount, are formed, by said medium being carried in said carrying direction with said carry amount shorter than a nozzle pitch of said plurality of nozzles and by said nozzles that are used to form said post-carry pattern being changed.

2. A printing method according to claim 1, wherein either the pre-carry patterns or the post-carry patterns of said plurality of correction patterns are each formed at the same position with respect to said carrying direction, and the other patterns are each formed at different positions with respect to said carrying direction.

3. A printing method according to claim 2, wherein after the other pattern of one correction pattern has been formed on said medium, said medium is carried, and then the other pattern of another correction pattern is formed on said medium.

4. A printing method according to claim 2, wherein the pattern to be formed at the same position with respect to said carrying direction of one correction pattern is formed on said medium away from the pattern to be formed at the same position with respect to said carrying direction of another correction pattern.

5. A printing method according to claim 2, wherein the pattern to be formed at the same position with respect to said carrying direction of one correction pattern is formed on said medium in a single piece with the pattern to be formed at the same position with respect to said carrying direction of another correction pattern.

6. A printing method according to claim 1, wherein a plurality of nozzles lined up in said carrying direction are moved, and the pre-carry patterns and the post-carry patterns are formed using said nozzles that are moved.

7. A printing method according to claim 6, wherein either said pre-carry patterns or said post-carry patterns of said plurality of correction patterns are each formed at the same position with respect to said carrying direction, and the other patterns are each formed at different positions with respect to said carrying direction; and wherein the nozzles that form the other pattern of one correction pattern are different from the nozzles that form the other pattern of another correction pattern.

8. A printing method according to claim 6, wherein said nozzles are capable of forming dots of a plurality of sizes on said medium; and wherein at least either one of said pre-carry patterns and said post-carry patterns are made of said dots of a plurality of sizes.

9. A printing method according to claim 6, wherein at least either one of said pre-carry patterns and said post-carry patterns are made of a plurality of dots of different colors.

10. A printing method according to claim 6, wherein a length in said carrying direction of a region in which said plurality of correction patterns are formed is shorter than twice the length from a most upstream nozzle to a most downstream nozzle of said plurality of nozzles.

11. A printing method according to claim 1, wherein an upstream side roller positioned on the upstream side of a print region and a downstream side roller positioned on the downstream side of said print region are capable of carrying said medium in said carrying direction; and wherein said correction patterns are formed on said medium when said medium is carried by either one of said upstream side roller and said downstream side roller.

12. A printing method according to claim 11 wherein a correction amount for a carry amount when carrying said medium using said upstream side roller and said downstream side roller is different from a correction amount for a carry amount when carrying said medium using said one of the rollers.

13. A printing method according to claim 11, wherein a shape of said downstream side roller is different from a shape of said upstream side roller.

14. A printing method according to claim 11, wherein a shape of a driven roller in opposition to said downstream side roller is different from a shape of a driven roller in opposition to said upstream side roller.

15. A printing method according to claim 11, wherein a carrying velocity of said downstream side roller is different from a carrying velocity of said upstream side roller.

16. A printing method according to claim 1, wherein an upstream side roller positioned on the upstream side of a print region and a downstream side roller positioned on the downstream side of said print region are capable of carrying said medium in said carrying direction; and wherein said correction patterns are formed on said medium when said medium is carried by said upstream side roller and said downstream side roller.

17. A printing method according to claim 1, wherein said medium is carried a plurality of times between formation of the pre-carry patterns and formation of the post-carry patterns.

18. A printing method according to claim 1, wherein notation for identifying said correction patterns is appended to each of said correction patterns.

19. A printing method according to claim 18, wherein said notation is formed when said pre-carry patterns are formed.

20. A printing method according to claim 18, wherein said notation is formed adjacent in said carrying direction to said correction patterns.

21. A test pattern comprising:

a plurality of correction patterns formed on a medium;

wherein each of said correction patterns has a pre-carry pattern and a post-carry pattern formed adjacent to said pre-carry pattern in a carrying direction of the medium, said pre-carry pattern formed on said medium by ejecting ink from a plurality of nozzles, said post-carry pattern formed on said medium by ejecting ink from a plurality of nozzles in a downstream side in said carrying direction from said nozzles that have formed said pre-carry pattern, wherein (A) said plurality of correction patterns are formed on said medium lined up in a direction that intersects said carrying direction by said plurality of said pre-carry patterns in said plurality of said correction patterns being formed by ink being ejected while said plurality of nozzles are moved once in said moving direction, and said plurality of post-carry patterns in said plurality of said correction patterns being formed by alternately repeating a plurality of times ejecting ink while said plurality of nozzles are moving in said moving direction and carrying said medium by said carrying unit, and (B) said plurality of correction patterns, in which a spacing between said pre-carry pattern and said post-carry pattern changes in a stepwise manner in increments of a spacing shorter than a carry amount, are formed, by said medium being carried in said carrying direction with said carry amount shorter than a nozzle pitch of said plurality of nozzles and by said nozzles that are used to form said post-carry pattern being changed.

22. A method of producing a test pattern having a plurality of correction patterns, comprising:

preparing said medium onto which said correction patterns are to be formed; and forming a plurality of correction patterns on said medium, each correction pattern having each of a pre-carry pattern and a post-carry pattern that has been formed adjacent to said pre-carry pattern in a carrying direction, said pre-carry pattern being formed on said medium by ejecting ink from a plurality of nozzles, said post-carry pattern being formed on said medium by ejecting ink from a plurality of nozzles in a downstream side in said carrying direction than said nozzles that have formed said pre-carry pattern, after said medium that has been formed with said pre-carry pattern has been carried in said carrying direction, wherein (A) said plurality of correction patterns are formed on said medium lined up in a direction that intersects the carrying direction by said plurality of said pre-carry patterns in said plurality of said correction patterns being formed by ink being ejected while said plurality of nozzles are moved once in said moving direction, and said plurality of post-carry patterns in said plurality of said correction patterns being formed by alternately repeating a plurality of times ejecting ink while said plurality of nozzles are moving in said moving direction and carrying said medium by said carrying unit, and (B) said plurality of correction patterns, in which a spacing between said pre-carry pattern and said post-carry pattern changes in a stepwise manner in increments of a spacing shorter than a carry amount, are formed, by said medium being carried in said carrying direction with said carry amount shorter than a nozzle pitch of said plurality of nozzles and by said nozzles that are used to form said post-carry pattern being changed.

23. A printing apparatus for forming on a medium a plurality of correction patterns each having a pre-carry pattern and a post-carry pattern, comprising:

a carry unit for carrying said medium in a carrying direction; and a head unit for ejecting ink onto said medium, having a plurality of nozzles for forming said pre-carry pattern and a plurality of nozzles for forming said post-carry pattern, wherein a plurality of correction patterns are formed on said medium, each correction pattern having each of a pre-carry pattern and a post-carry pattern that has been formed adjacent to said pre-carry pattern in a carrying direction, said pre-carry pattern being formed on said medium by ejecting ink from said plurality of nozzles, said post-carry pattern being formed on said medium by ejecting ink from said plurality of nozzles in a downstream side in said carrying direction than said nozzles that have formed said pre-carry pattern, after said medium that has been formed with said pre-carry pattern has been carried in said carrying direction; and (A) wherein said plurality of correction patterns are formed on said medium lined up in a direction that intersects said carrying direction by said pre-carry pattern in said plurality of correction patterns being formed by ink being ejected while said plurality of nozzles are moved once in said moving direction, and said plurality of post-carry patterns in said plurality of said correction patterns being formed by alternately repeating a plurality of times ejecting ink while said plurality of nozzles are moving in said moving direction and carrying said medium by said carrying unit, and (B) said plurality of correction patterns, in which a spacing between said pre-carry pattern and said post-carry pattern changes in a stepwise manner in increments of a spacing shorter than a carry amount, are formed, by said medium being carried in said carrying direction with said carry amount shorter than a nozzle pitch of said plurality of nozzles and by said nozzles that are used to form said post-carry pattern being changed.

* * * * *